US009989204B2

(12) United States Patent
Howe

(10) Patent No.: US 9,989,204 B2
(45) **Date of Patent: *Jun. 5, 2018**

(54) SUBSTRATE TENSIONING SYSTEMS

(71) Applicant: Leslie David Howe, Atlanta, GA (US)

(72) Inventor: Leslie David Howe, Atlanta, GA (US)

(73) Assignee: SOUTHPAC TRUST INTERNATIONAL INC., Rarotonga (CK), TRUSTEE OF THE LDH TRUST ( * ) Notice: Subject to any disclaimer, the term of this patent is extended or adjusted under 35 U.S.C. 154(b) by 524 days.

This patent is subject to a terminal disclaimer.

(21) Appl. No.: 14/623,832

(22) Filed: Feb. 17, 2015

(65) Prior Publication Data

US 2015/0159839 A1 Jun. 11, 2015

Related U.S. Application Data

(63) Continuation-in-part of application No. 14/490,188, filed on Sep. 18, 2014, now Pat. No. 9,039,251, which
(Continued)

(51) Int. Cl.
*F21V 3/02* (2006.01)
*F21S 8/02* (2006.01)
(Continued)

(52) U.S. Cl.
CPC ..... *F21S 8/026* (2013.01); *F21K 9/20* (2016.08); *F21K 9/27* (2016.08); *F21K 9/60* (2016.08);
(Continued)

(58) Field of Classification Search
CPC ..... F21S 8/02; F21S 8/026; F21V 5/04
(Continued)

(56) References Cited

U.S. PATENT DOCUMENTS 3,600,569 A 8/1971 Matteson
3,883,732 A 5/1975 Peterson
(Continued)

OTHER PUBLICATIONS

International Search Report and Written Opinion PCT/US2013/039895 dated Aug. 27, 2013.
(Continued)

*Primary Examiner* — Andrew Coughlin
(74) *Attorney, Agent, or Firm* — Troutman Sanders LLP; James E. Schutz; Mark Lehi Jones

(57) ABSTRACT

An example embodiment of substrate tensioning system is disclosed that may comprise a frame including four sides and channels, wherein the channels may comprise a first surface, a second surface that opposes the first surface, and an edge truss retention feature. The substrate tensioning system may further comprise at least one substrate including four major edges and a first surface, wherein each major edge is configured with one or more edge trusses configured from corresponding folds in the at least one substrate, such that the edge trusses may be configured at an angle relative to the first surface of the substrate. The at least one substrate may attach to the frame, wherein each edge truss may nest inside, and be secured inside a corresponding frame channel, wherein a perimeter edge of each outermost edge truss may be engaged by the corresponding frame channel's edge truss retention feature.

18 Claims, 68 Drawing Sheets

Related U.S. Application Data is a continuation-in-part of application No. 14/254,960, filed on Apr. 17, 2014, now Pat. No. 8,876,337, which is a continuation-in-part of application No. 14/225,546, filed on Mar. 26, 2014, now Pat. No. 8,905,594, and a continuation-in-part of application No. PCT/US2013/059919, filed on Sep. 16, 2013, said application No. 14/225,546 is a continuation of application No. PCT/US2013/039895, filed on May 7, 2013, application No. 14/623,832, which is a continuation-in-part of application No. 13/531,515, filed on Jul. 23, 2012, now abandoned, which is a continuation-in-part of application No. 12/952,765, filed on Nov. 23, 2010, now Pat. No. 8,568,002, application No. 14/623,832, which is a continuation-in-part of application No. 14/231,819, filed on Apr. 1, 2014, now abandoned, and a continuation-in-part of application No. 14/534,431, filed on Nov. 6, 2014, now Pat. No. 9,316,805, which is a continuation-in-part of application No. 14/267,940, filed on May 2, 2014, now Pat. No. 8,950,905, and a continuation-in-part of application No. 14/225,546.

(60) Provisional application No. 61/999,519, filed on Jul. 30, 2014, provisional application No. 62/122,158, filed on Oct. 14, 2014, provisional application No. 62/125,347, filed on Jan. 20, 2015, provisional application No. 61/958,559, filed on Jul. 30, 2013, provisional application No. 61/741,669, filed on Jul. 26, 2012, provisional application No. 61/742,251, filed on Aug. 6, 2012, provisional application No. 61/795,420, filed on Oct. 17, 2012, provisional application No. 61/848,526, filed on Jan. 7, 2013, provisional application No. 61/963,037, filed on Nov. 19, 2013, provisional application No. 61/963,603, filed on Dec. 9, 2013, provisional application No. 61/963,725, filed on Dec. 13, 2013, provisional application No. 61/964,060, filed on Dec. 23, 2013, provisional application No. 61/964,422, filed on Jan. 6, 2014, provisional application No. 61/965,710, filed on Feb. 6, 2014, provisional application No. 61/959,641, filed on Aug. 27, 2013.

(51) Int. Cl.

| | |
|---|---|
| ***F21V 5/00*** | (2018.01) |
| ***F21V 7/00*** | (2006.01) |
| ***F21V 7/16*** | (2006.01) |
| ***F21V 13/02*** | (2006.01) |
| ***F21V 15/01*** | (2006.01) |
| ***F21V 17/10*** | (2006.01) |
| ***F21V 21/04*** | (2006.01) |
| ***F21V 29/505*** | (2015.01) |
| ***F21K 9/20*** | (2016.01) |
| ***F21K 9/27*** | (2016.01) |
| ***F21K 9/60*** | (2016.01) |
| *F21Y 103/00* | (2016.01) |
| *F21Y 103/10* | (2016.01) |
| *F21Y 115/10* | (2016.01) |

(52) U.S. Cl.

CPC ..... *F21V 3/0625* (2018.02); *F21V 5/004* (2013.01); *F21V 5/005* (2013.01); *F21V 7/0008* (2013.01); *F21V 7/16* (2013.01); *F21V 13/02* (2013.01); *F21V 15/01* (2013.01); *F21V 17/101* (2013.01); *F21V 17/107* (2013.01); *F21V 17/108* (2013.01); *F21V 21/048* (2013.01); *F21V 29/505* (2015.01); *F21Y 2103/00* (2013.01); *F21Y 2103/10* (2016.08); *F21Y 2115/10* (2016.08)

(58) Field of Classification Search

USPC ..... 362/317, 362, 364–366, 445

See application file for complete search history.

(56) References Cited

U.S. PATENT DOCUMENTS

| | | | | |
|---|---|---|---|---|
| 5,908,234 | A | 6/1999 | Kreeft | |
| 6,467,209 | B1 | 10/2002 | Vickers | |
| 7,396,150 | B2 | 7/2008 | Ogawa | |
| 7,719,628 | B2 | 5/2010 | Suh | |
| 8,021,029 | B2 | 9/2011 | Best | |
| 8,284,346 | B2 | 10/2012 | Park et al. | |
| 8,506,104 | B1 | 8/2013 | Murphy | |
| 8,596,809 | B2 | 12/2013 | Johnston | |
| 8,662,693 | B2 | 3/2014 | Huang | |
| 8,858,032 | B2 | 10/2014 | Van De Ven et al. | |
| 9,039,251 | B2 * | 5/2015 | Howe | F21V 29/505 362/329 |
| 2007/0126004 | A1 | 6/2007 | Cok | |
| 2007/0183148 | A1 | 8/2007 | Mayfield, III et al. | |
| 2008/0266851 | A1 | 10/2008 | Engel | |
| 2012/0113628 | A1 | 5/2012 | Burrow | |
| 2012/0236560 | A1 | 9/2012 | Bosch et al. | |
| 2013/0148340 | A1 | 6/2013 | Shen | |

OTHER PUBLICATIONS

International Search Report and Written Opinion PCT/US2013/059919 dated Feb. 14, 2014.

* cited by examiner

FIG 13A
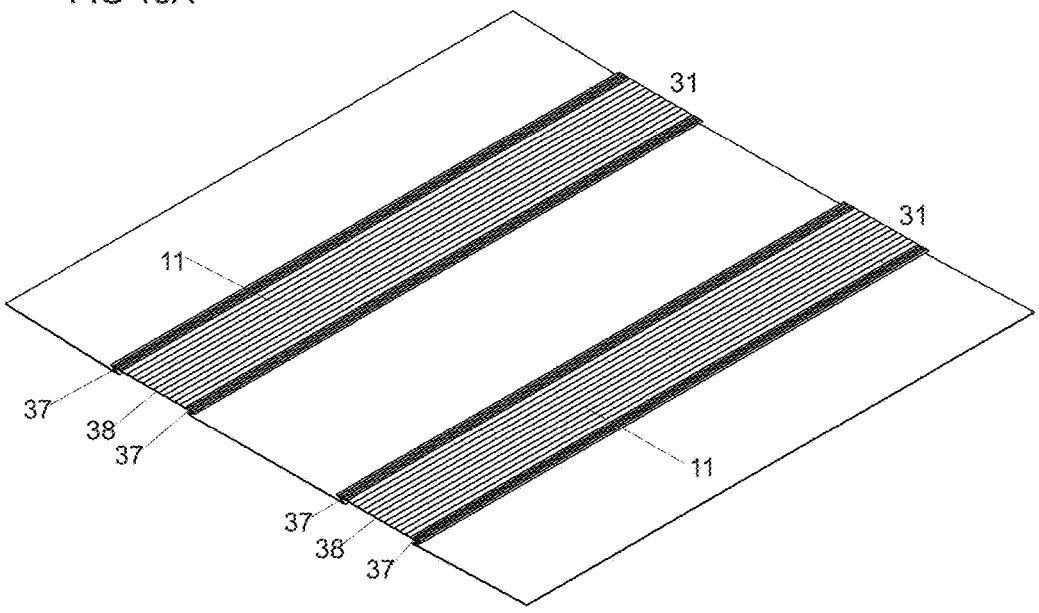
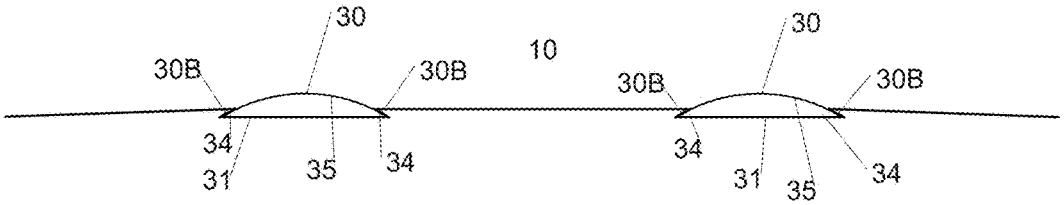
FIG 13B

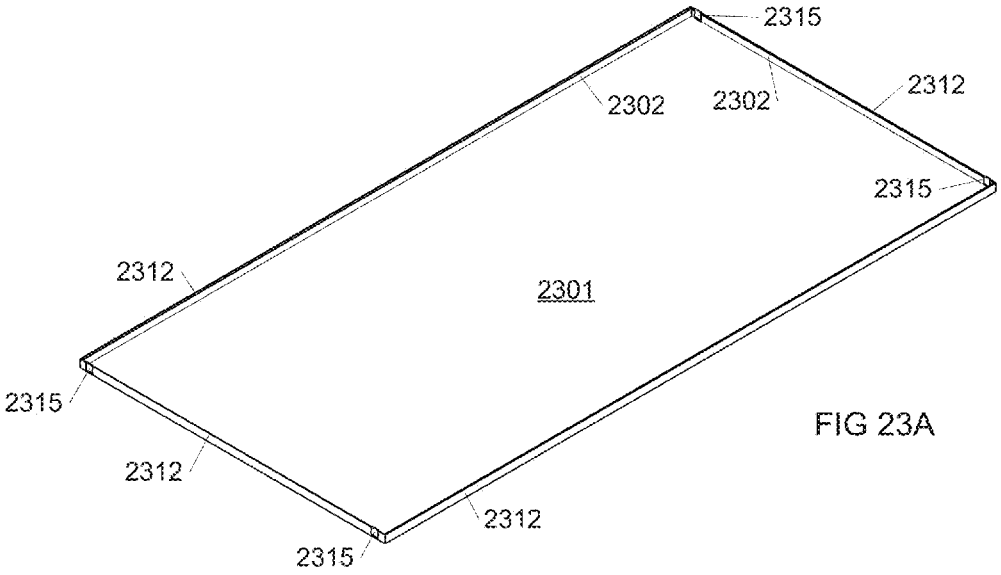
FIG 23A
FIG 23B
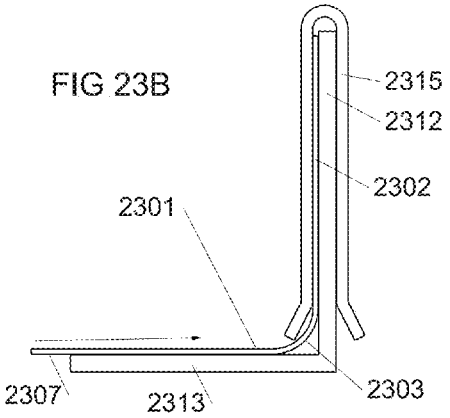
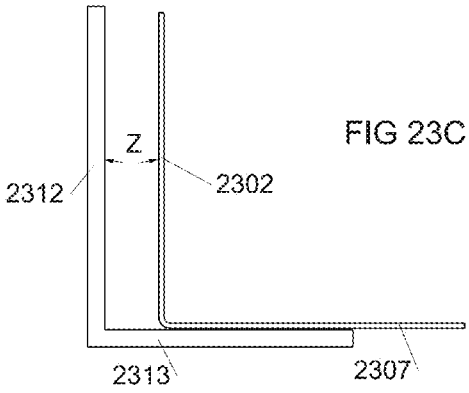
FIG 23C

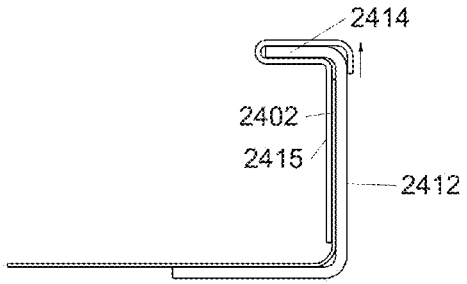
FIG 24A
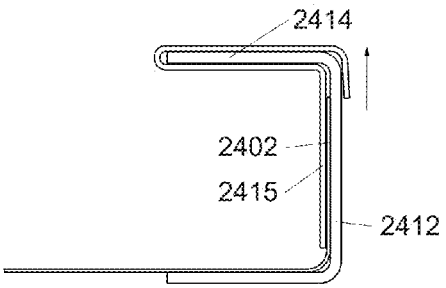
FIG 24B
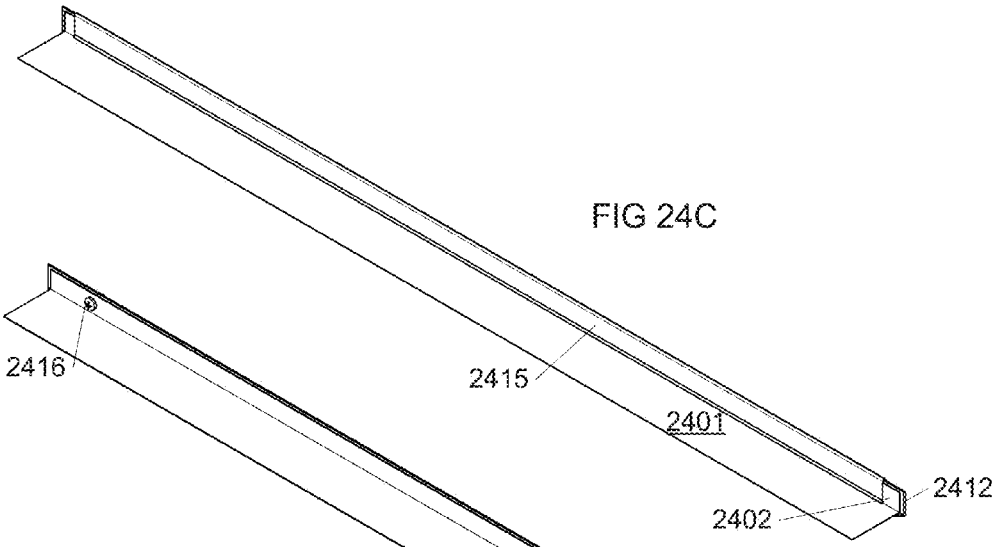
FIG 24C
FIG 24D

FIG 25A
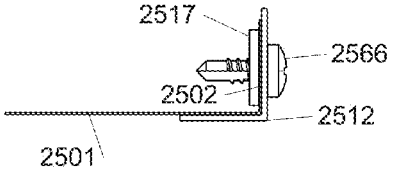
FIG 25B-1
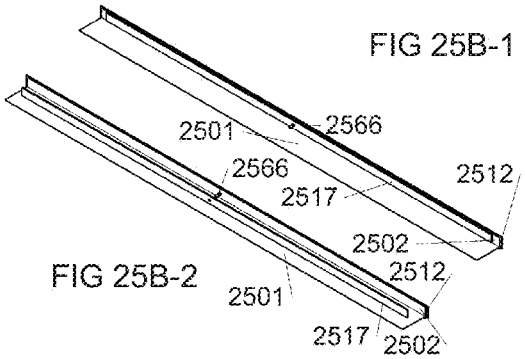
FIG 25B-2
FIG 26A
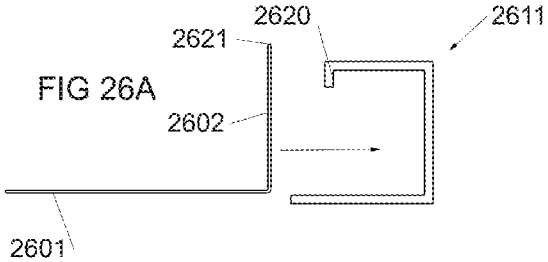
FIG 26B
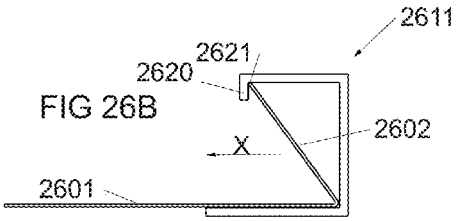
FIG 26C
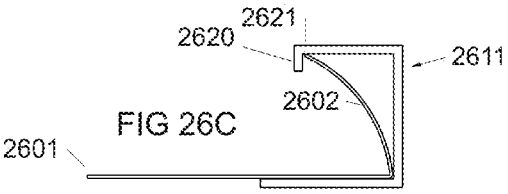
FIG 26D
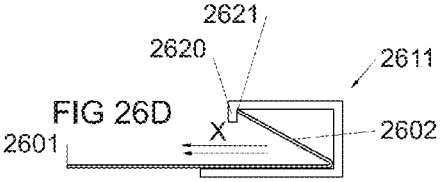
FIG 26E
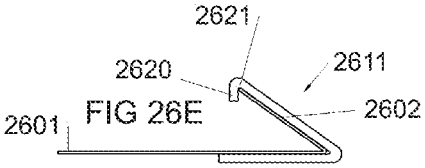

FIG 27A
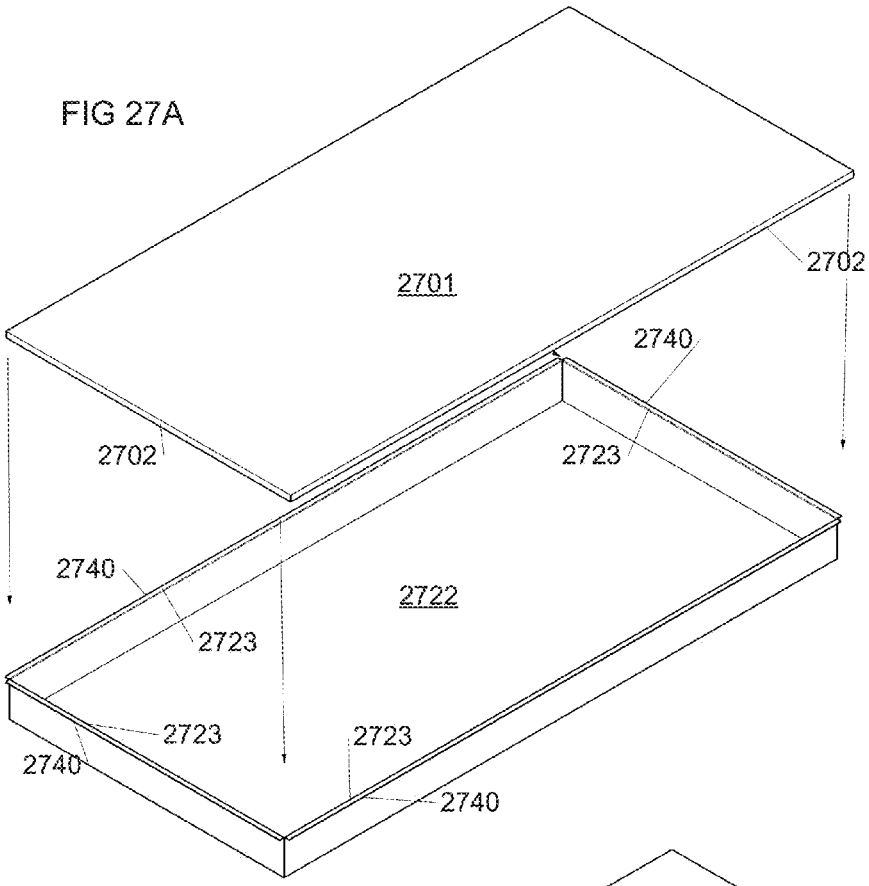
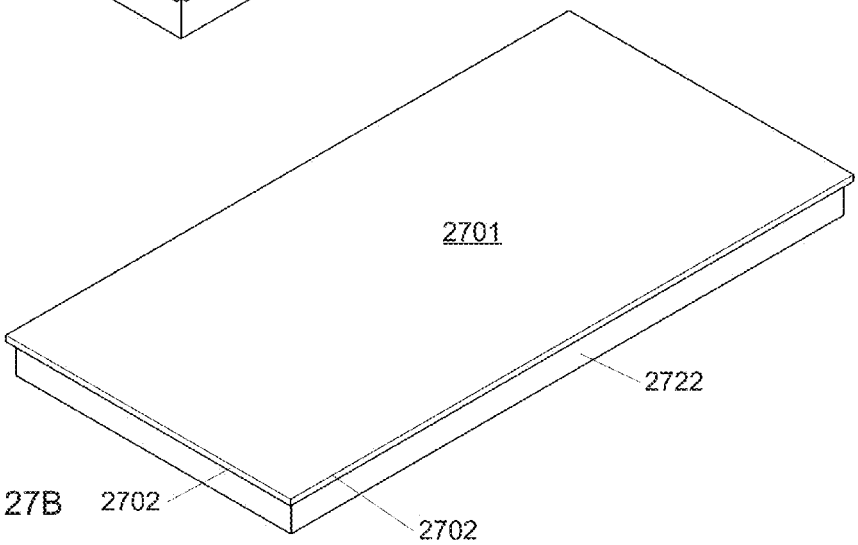
FIG 27B

FIG 28A
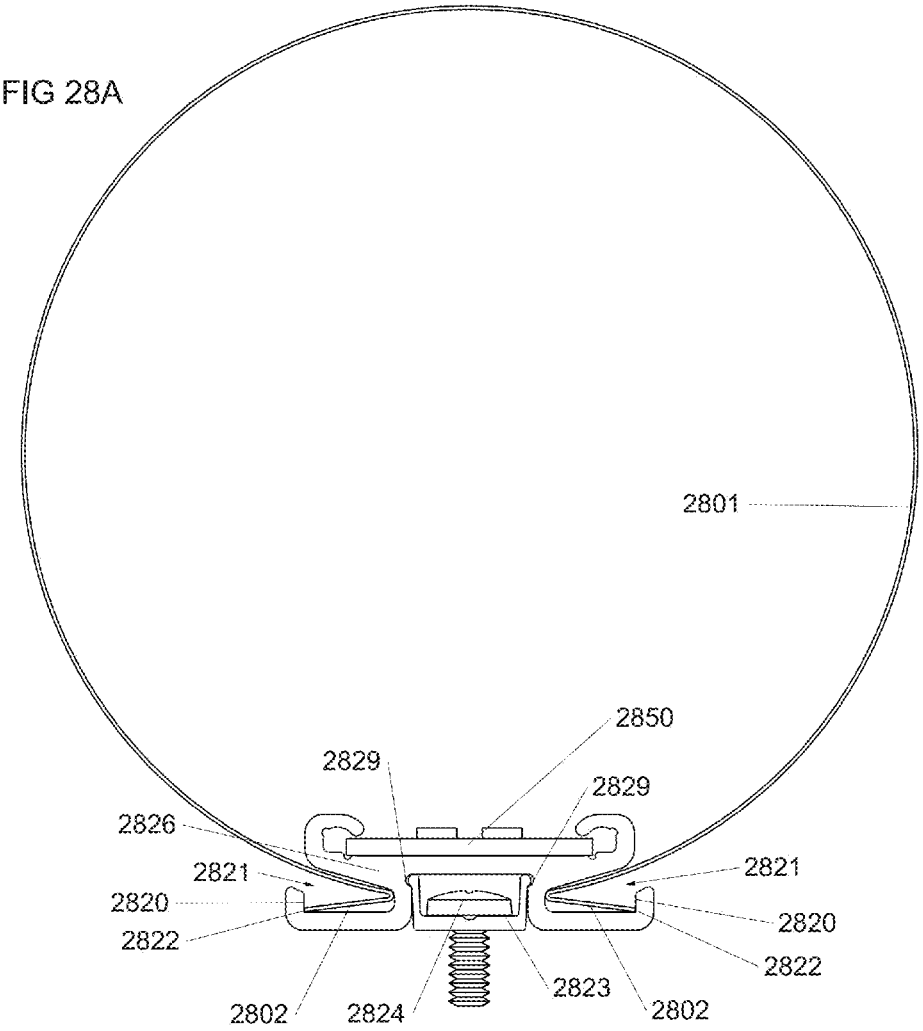
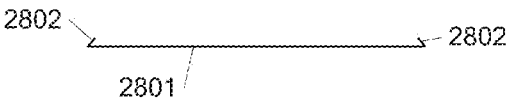
FIG 28B
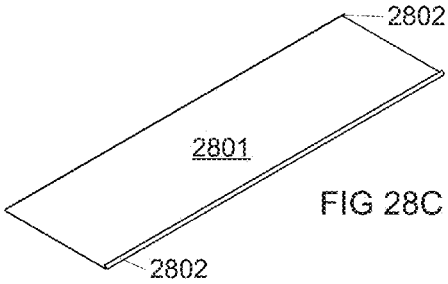
FIG 28C

FIG 28F
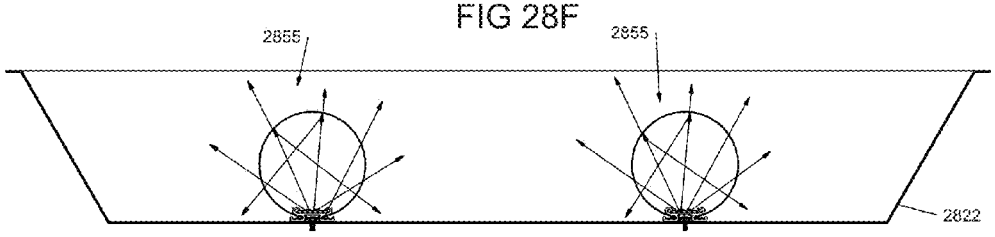
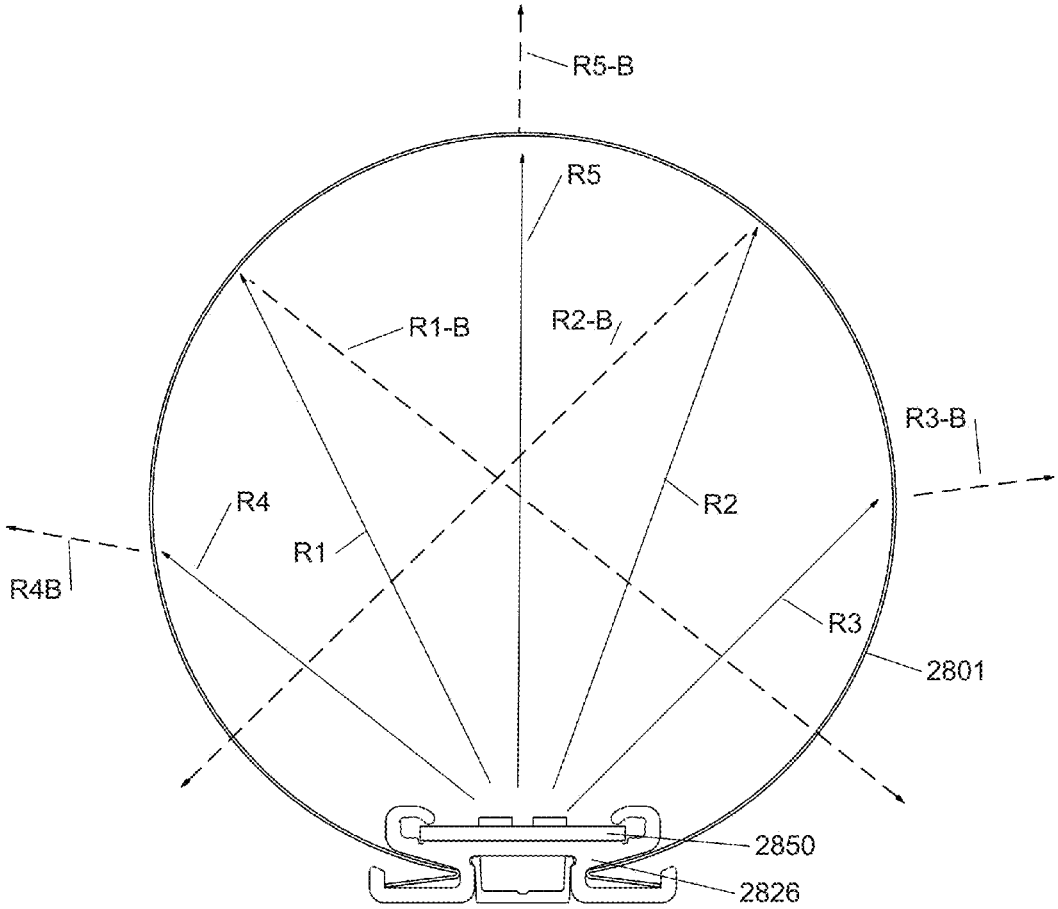
FIG 28G

FIG 36

Providing a structure that comprises a channel, wherein the channel comprises at least a top and a bottom surface. The channel top or bottom may be configured with a protruding edge truss retention feature. The dimensions of the channel and edge truss retention feature may be configured to accommodate the edge of the optical film piece configured in block 281. 360

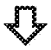

Providing at least one film piece characterized by at least one edge truss disposed on one edge of at least one the at least one film piece. The at least one edge truss may be characterized by a fold of at least a portion of the optical film piece and includes an outer edge. The edge truss may be configured to the appropriate dimensions wherein the outer edge of the edge truss may contact the edge truss retention feature in the channel when fully inserted into the channel. 361

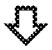

Fully insert the edge of the at least one film piece with the configured edge truss into the channel of the structure, wherein the edge truss outer edge is oriented towards the edge truss retention feature in the channel, and wherein the outer edge of the edge truss contacts, and is retained by the edge truss retention feature in the channel. 362

FIG 42A
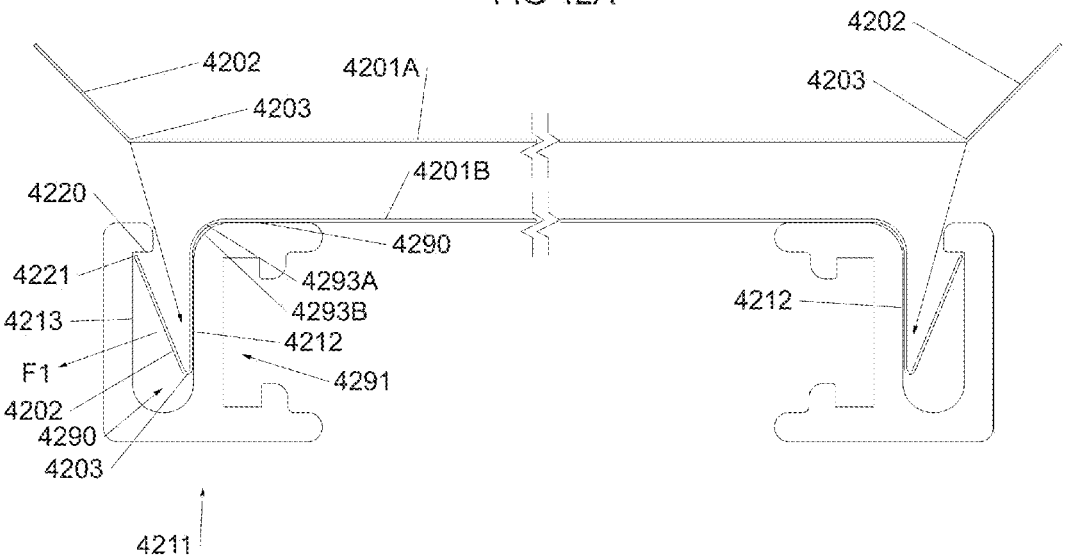
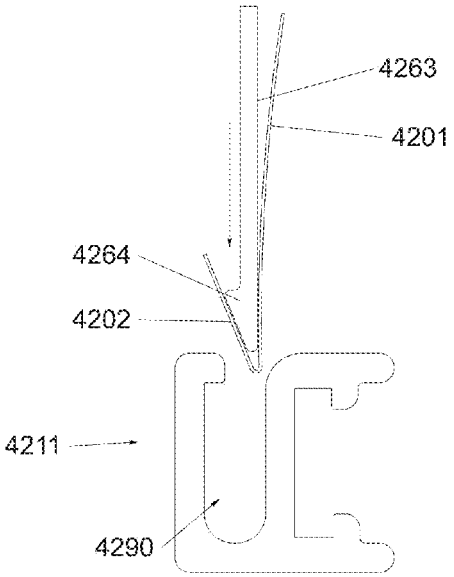
FIG 42B

FIG 42E1
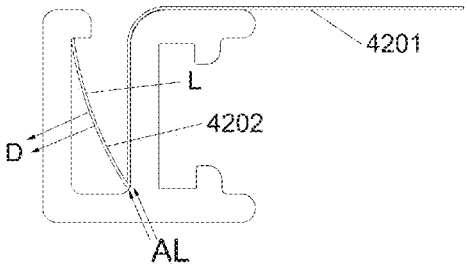
FIG 42E2
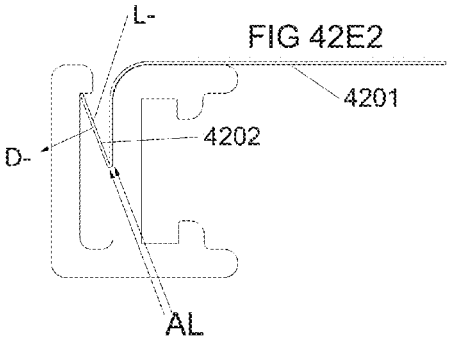
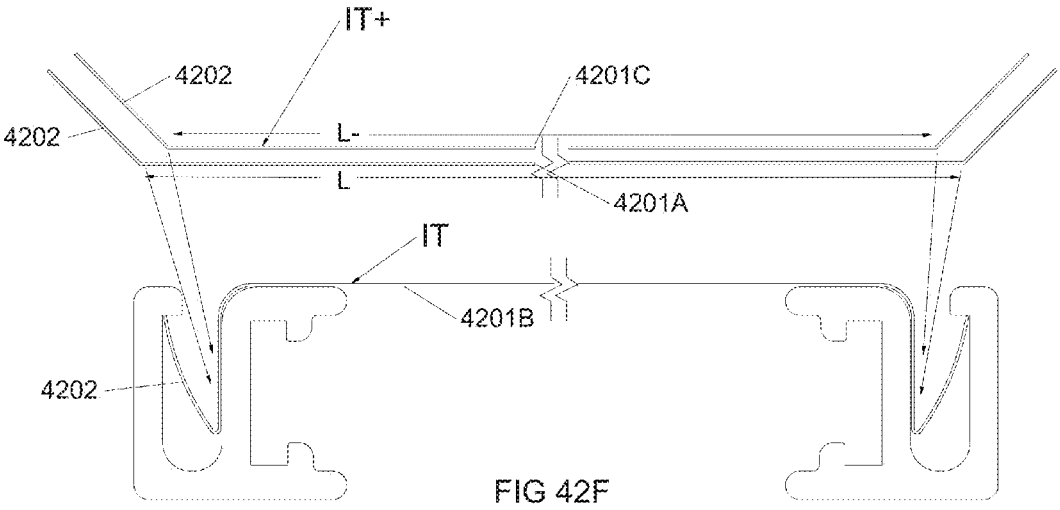
FIG 42F

FIG 45A
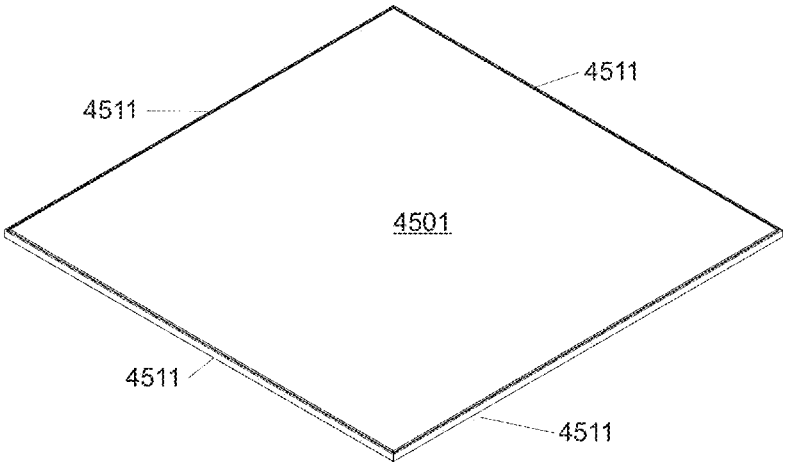
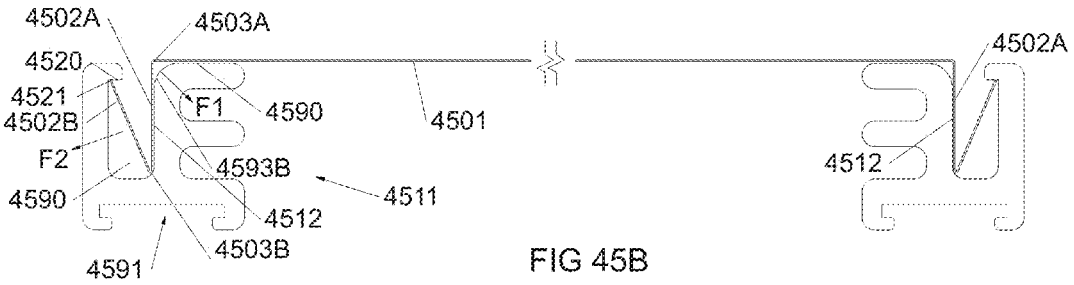
FIG 45B

FIG 47A
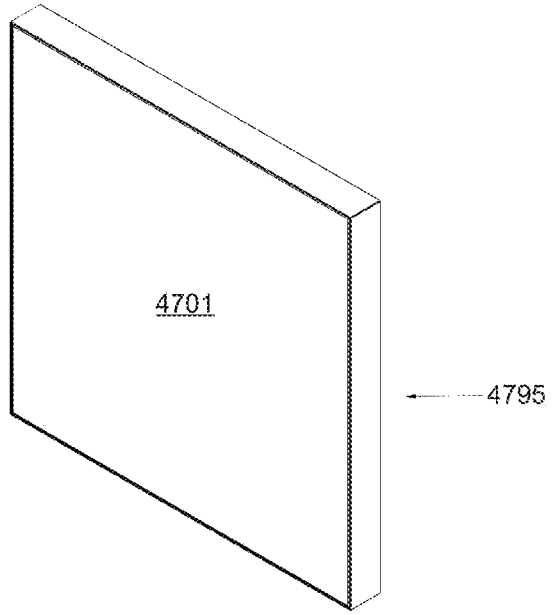
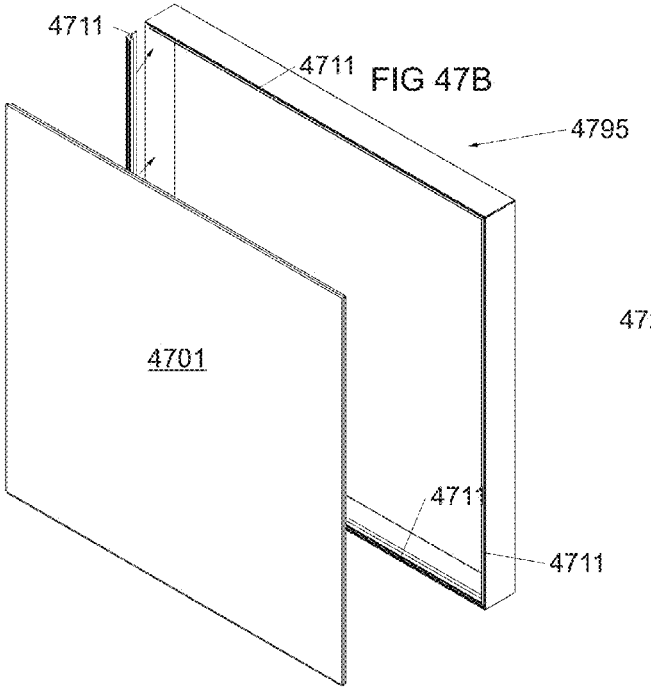
FIG 47B
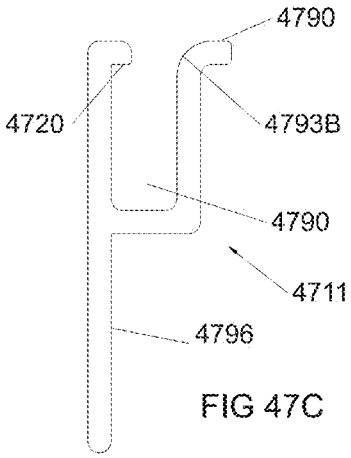
FIG 47C

FIG 50

Providing a frame comprising four sides, wherein each frame side comprises a channel, and each channel comprises a first surface, a second surface that opposes the first surface. 501

Providing at least one piece of substrate comprising four major edges and a first surface, wherein the at least one piece of substrate is dimensionally configured so that after attachment to the frame, tension is imparted into the at least one piece of substrate. 502

Configuring one or more edge trusses on each major edge of the at least one piece of substrate, wherein each edge truss is configured from a corresponding fold in the at least one piece of substrate, and each edge truss extends along all, or a portion of a corresponding major edge, such that each of the one or more edge trusses is configured at an angle relative to the first surface of the at least one piece of substrate, and wherein the outermost edge trusses on each of the four major edges of the at least one piece of substrate comprises an outer perimeter edge. 503

Inserting each of the one or more edge trusses on each of the four major edges of the at least one piece of substrate into a corresponding frame channel, wherein the perimeter edge of each outermost edge truss is engaged by the corresponding channel's edge truss retention feature, such that each of the outermost edge trusses becomes lodged and secured within each corresponding frame channel and resists the tension imparted in the at least one piece of substrate. 504

SUBSTRATE TENSIONING SYSTEMS

CROSS-REFERENCE TO RELATED APPLICATIONS

This application is a Continuation-In-Part of U.S. patent application Ser. No. 14/490,188, entitled "Light Fixtures and Multi-Plane Light Modifying Elements," filed Sep. 18, 2014 and published as US2015/0016108 Jan. 15, 2015. This application also claims the benefit of the following U.S. Provisional Patent Applications: U.S. Provisional Patent Application No. 61/999,519 entitled "Optical Film Tensioning, Mounting and Attachment Systems," filed Jul. 30, 2014; U.S. Provisional Patent Application No. 62/122,158, entitled "Frameless Light Modifying Element," filed on Oct. 14, 2014, and U.S. Provisional Patent Application No. 62/125,347 entitled "Light Fixture and Multi-Plane Light Modifying Elements," filed Jan. 20, 2015, the contents of which are also incorporated by reference in their entirety as if set forth in full.

U.S. patent application Ser. No. 14/490,188, is a Continuation-In-Part of U.S. patent application Ser. No. 14/254,960 entitled "Light Fixtures and Multi-Plane Light Modifying Elements," filed Apr. 17, 2014 now U.S. Pat. No. 8,876,337, issued Nov. 4, 2014. U.S. patent application Ser. No. 14/490,188 also claims priority to U.S. Provisional Patent Application No. 61/958,559, entitled "Hollow Truncated-Pyramid Shaped Light Modifying Element," filed Jul. 30, 2013, the contents of which are incorporated by reference in their entirety as if set forth in full.

U.S. patent application Ser. No. 14/254,960 is a continuation in part of U.S. patent application Ser. No. 14/225,546, entitled "Frameless Light Modifying Element," filed Mar. 26, 2014, and published as US2014/0204590 Jul. 24, 2014, the contents of which are incorporated herein by reference in their entirety, as if set forth in full. U.S. patent application Ser. No. 14/254,960 is also a Continuation-in-Part under 35 U.S.C. 365 of PCT Application No. PCT/US2013/059919, entitled "Light Modifying Elements," filed Sep. 16, 2013, the contents of which are incorporated herein by reference in their entirety, as if set forth in full.

U.S. patent application Ser. No. 14/225,546 is a continuation under 35 U.S.C. 365 of PCT Application No. PCT/US2013/039895, entitled "Frameless Light Modifying Element," filed May 7, 2013, the contents of which are incorporated herein by reference in their entirety, as if set forth in full. PCT Application No. PCT/US2013/039895 claims the benefit of the following U.S. Provisional Patent Applications, the contents of which are incorporated herein by reference in their entirety, as if set forth in full: U.S. Provisional Patent Application No. 61/741,669, entitled "Frameless Optical Film Lens," filed Jul. 26, 2012; U.S. Provisional Patent Application No. 61/742,251, entitled "Frameless Optical Film Lens," filed Aug. 6, 2012; U.S. Provisional Patent Application No. 61/795,420, entitled "Frameless Optical Film Lens," filed Oct. 17, 2012; and U.S. Provisional Patent Application No. 61/848,526, entitled "Frameless Optical Film Lens" filed Jan. 7, 2013.

U.S. patent application Ser. No. 14/254,960 claims the benefit of the following U.S. Provisional Patent Applications, the contents of which are incorporated by reference in their entirety as if set forth in full: U.S. Provisional Patent Application No. 61/959,641, entitled "Light Modifying Elements," filed Aug. 27, 2013; U.S. Provisional Patent Application No. 61/963,037, entitled "Light Fixtures and Multi-Plane Light Modifying Elements," filed Nov. 19, 2013; U.S. Provisional Patent Application No. 61/963,603, entitled "LED Module," filed Dec. 9, 2013; U.S. Provisional Patent Application No. 61/963,725, entitled "LED Module and Inner Lens System," filed Dec. 13, 2013; U.S. Provisional Patent Application No. 61/964,060, entitled "LED Luminaire, LED Mounting Method, and Lens Overlay," filed Dec. 23, 2013; U.S. Provisional Patent Application No. 61/964,422, entitled "LED Light Emitting Device, Lens, and Lens-Partitioning Device," filed Jan. 6, 2014; and U.S. Provisional Patent Application No. 61/965,710, entitled "Compression Lenses, Compression Reflectors and LED Luminaires Incorporating the Same," filed Feb. 6, 2014; the contents of which are incorporated by reference in their entirety as if set forth in full.

This application is also a continuation in part of U.S. patent application Ser. No. 14/534,431 entitled "Frameless Light Modifying Element," filed Nov. 6, 2014, the contents of which are incorporated herein by reference in their entirety, as if set forth in full. U.S. patent application Ser. No. 14/534,431 is a continuation-in-part of U.S. patent application Ser. No. 14/267,940, filed May 2, 2014, and issued as U.S. Pat. No. 8,950,905 Feb. 10, 2015, and entitled "Optical Film Compression Lenses, Overlays and Assemblies," the contents of which are incorporated by reference in their entirety as if set forth in full. U.S. patent application Ser. No. 14/534,431 is also continuation in part of U.S. patent application Ser. No. 14/225,546, entitled "Frameless Light Modifying Element," filed Mar. 26, 2014, and issued as U.S. Pat. No. 8,905,594 on Dec. 9, 2014, the contents of which are incorporated herein by reference in their entirety, as if set forth in full.

This application is also a continuation-in-part of U.S. patent application Ser. No. 13/531,515, now Publication No. US2012/0300471, entitled "Light Diffusion and Condensing Fixture," filed Jul. 23, 2012. U.S. patent application Ser. No. 13/531,515 is a continuation-in-part of U.S. patent application Ser. No. 12/952,765, now U.S. Pat. No. 8,568,002, entitled "Light Diffusion and Condensing Fixture," filed Nov. 23, 2010 and issued Oct. 29, 2013, the contents of which are incorporated by reference in their entirety as if set forth in full.

This application is also a continuation-in-part of U.S. patent application Ser. No. 14/231,819, published as U.S. Patent Application Publication US2014/0211484, entitled "Light Modifying Elements," filed Apr. 1, 2014, the contents of which are incorporated by reference in their entirety as if set forth in full.

TECHNICAL FIELD

This disclosure generally relates to lighting, light fixtures and lenses, and substrate tension systems that may be utilized in various applications, such as for example, light fixtures, displays and panels for building or decorative applications etc.

BACKGROUND

There is a continuing need for low cost systems that can improve the light quality of light fixtures, and also a continuing need for substrate tensioning systems that are low cost, easy to manufacture and assemble, that may enable thin substrates to be suspended in substantially planar configurations.

BRIEF DESCRIPTION OF THE FIGURES

FIG. 13A shows a top perspective view of the example embodiment of multi-plane light modifying element with optical film inserts as shown in FIG. 12B.

FIG. 13B shows a side view of the example embodiment of multi-plane light modifying element and optical film inserts as shown in FIG. 13A.

FIG. 23A depicts a perspective view of the backside of a light fixture doorframe and an example embodiment of optical film lens with four lens tensioning devices attached.

FIG. 23B depicts a side cut-away view of a frame member, example embodiment of optical film lens with edge truss, and a lens tensioning device.

FIG. 23C depicts a side cut-away view of a frame member and example embodiment of optical film lens with edge truss, indicating the distance between the edge truss and frame member.

FIG. 24A depicts a side cut-away view of a frame member, example embodiment of optical film lens with edge truss, and a lens tensioning device.

FIG. 24B depicts a side cut-away view of another frame member, example embodiment of optical film lens with edge truss, and a lens tensioning device.

FIG. 24C depicts a side perspective view of a frame member, example embodiment of optical film lens with edge truss, and an elongated lens-tensioning device.

FIG. 24D depicts a side perspective view of a frame member, example embodiment of optical film lens with edge truss, and an elongated lens-tensioning device attached with screws.

FIG. 25A depicts a side cut-away view of a frame member, example embodiment of optical film lens with edge truss, and an elongated lens tensioning device attached with a screw.

FIG. 25B-1 depicts a perspective view of the frame member, example embodiment of optical film lens with edge truss, and an elongated lens tensioning device attached with a screw as shown in FIG. 25A.

FIG. 25B-2 depicts an exploded perspective view of the frame member, example embodiment of optical film lens with edge truss, and an elongated lens tensioning device attached with a screw as shown in FIG. 25A.

FIG. 26A depicts a side cut-away view of a three-segment frame member comprising an edge truss retention feature, and an example embodiment of optical film lens with edge truss.

FIG. 26B depicts a side cut-away view of a three-segment frame member comprising an edge truss retention feature, and an example embodiment of optical film lens with edge truss inserted into the frame member.

FIG. 26C depicts a side cut-away view of a three-segment frame member comprising an edge truss retention feature, and an example embodiment of optical film lens with edge truss inserted into the frame member, wherein the edge truss is flexed.

FIG. 26D depicts a side cut-away view of a shallower three-segment frame member comprising an edge truss retention feature, and an example embodiment of optical film lens with edge truss inserted into the frame member.

FIG. 26E depicts a side cut-away view of a two-segment frame member comprising an edge truss retention feature, and an example embodiment of optical film lens with edge truss inserted into the frame member.

FIG. 27A depicts a top exploded perspective view of an example embodiment of light fixture with lens over-mounting, attachment and tensioning system.

FIG. 27B depicts a top perspective view of the example embodiment of light fixture with lens over-mounting, attachment and tensioning system as shown in FIG. 27A.

FIG. 28A depicts an example embodiment lens assembly or LED retrofit assembly that includes an example embodiment of optical film lens attached to a base.

FIG. 28B depicts a side profile view of the lens from the example embodiment of optical film lens configured for attachment to the example embodiment lens assembly or LED retrofit assembly shown in FIG. 28A.

FIG. 28C depicts a perspective view of the example embodiment of lens shown in FIG. 28B.

FIG. 28F depicts a side cut-away view diagram of a light fixture with two example embodiments of LED retrofit assemblies mounted inside, and may indicate example light ray dispersion directions.

FIG. 28G depicts a side cut-away view diagram of an example embodiment of LED retrofit assembly, and indicates example light ray dispersion patterns.

FIG. 36 depicts a block diagram of the method steps involved in an example embodiment of a method for attaching optical film lenses onto a structure.

FIG. 42A shows a side cut-away view of two opposing sides of the example embodiment of substrate tensioning system comprising a frame and a substrate as shown in FIG. 41A.

FIG. 42B shows a side cutaway view of one side of an example embodiment of substrate with an edge truss, configured for insertion into a frame member channel with an installation tool.

FIG. 42E1 shows a cutaway side view diagram of a frame member and attached substrate from an example embodiment of substrate tensioning system, wherein the edge truss deflection due to axial loading is indicated.

FIG. 42E2 shows a cutaway side view diagram of a frame member and attached substrate from an example embodiment of substrate tensioning system, wherein less edge truss deflection due to axial loading compared to FIG. 42E1 is indicated.

FIG. 42F shows a cutaway side view diagram of two opposing sides of an example embodiment of substrate tensioning system, wherein two substrates configured with different dimensions create different tensions within the system.

FIG. 45A shows a perspective view of an example embodiment of substrate tensioning system comprising a frame and a substrate.

FIG. 45B shows a side cut-away view of two opposing sides of the example embodiment of substrate tensioning system comprising a frame and a substrate as shown in FIG. 45A.

FIG. 47A shows a perspective view of an example embodiment of substrate tensioning system comprising an enclosure with frame attached thereto, and a substrate attached to the frame.

FIG. 47B shows a perspective exploded view of the example embodiment of substrate tensioning system as shown in FIG. 47A.

FIG. 47C shows a side view of the frame members shown in the example embodiment of substrate tensioning system shown in FIG. 47A and FIG. 47B.

FIG. 48A-2 shows a cutaway side profile view of an alternate example embodiment of a tensioning frame that is integrally configured into an enclosure structure.

FIG. 48B shows a perspective view of an example embodiment of enclosure with a tensioning frame that is integrally configured into an enclosure structure, wherein the profile of each enclosure side is configured similarly to the enclosure structure profile shown in FIG. 48A.

FIG. 48C shows a side view of the example embodiment of enclosure with a tensioning frame shown in FIG. 48B.

FIG. 48D shows an example embodiment showing a side cut-away view of a frame member and attached substrate, wherein the substrate tensioning system is attached to an enclosure.

FIG. 49 shows an example embodiment of substrate tensioning system with two attached substrates and three layers of substrates nested in between.

FIG. 50 shows a block diagram of the steps involved in an example embodiment of a method for providing a substrate tensioning system.

FIG. 51A depicts an example embodiment of lens assembly or LED retrofit assembly that includes an example embodiment of optical film lens attached to a base.

FIG. 51B depicts a side profile view of the lens from the example embodiment of lens assembly or LED retrofit assembly shown in FIG. 51A, wherein the lens is shown in its unattached, non-compressed state.

BRIEF SUMMARY

Figure 1A:
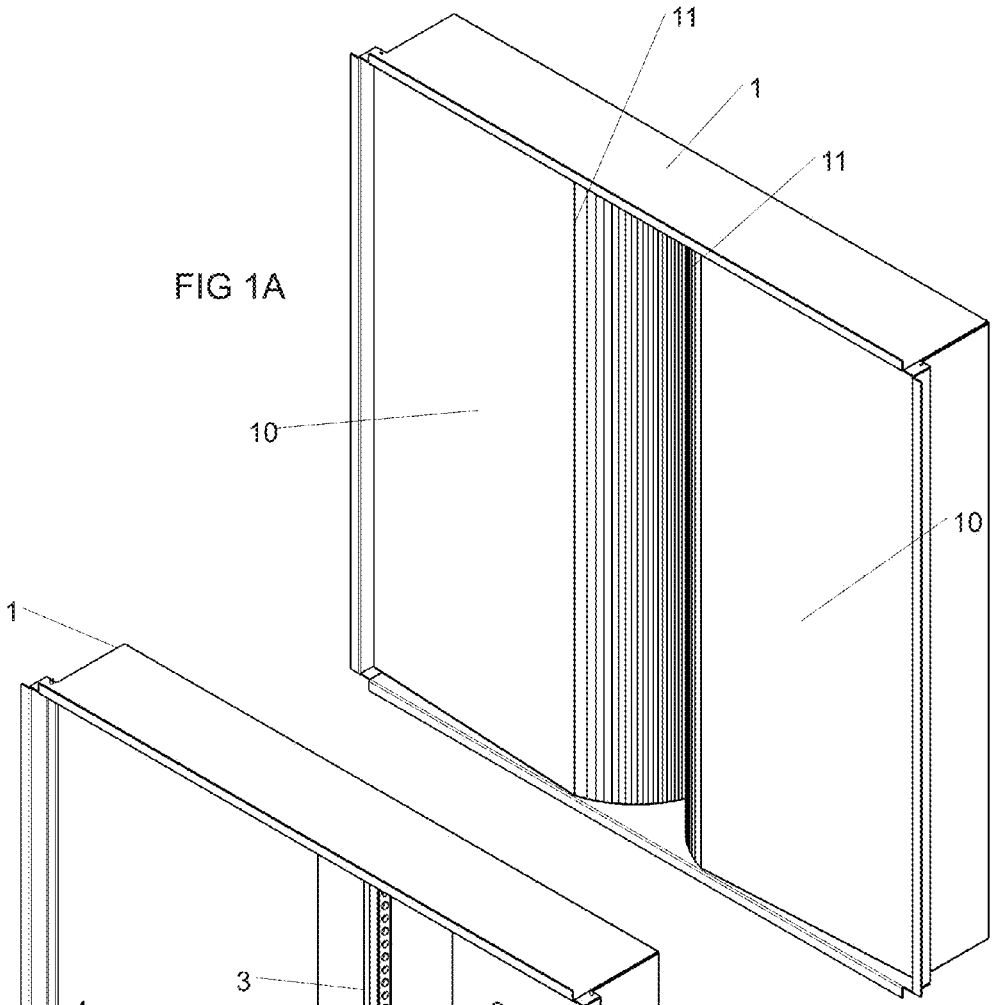
FIG. 1A depicts a perspective view of an example embodiment of light fixture and multi-plane light modifying element "LME".

In an example embodiment of the disclosed technology, a substrate tensioning system may be configured to suspend a substrate in a substantially planar configuration, wherein the substrate tensioning system may comprise a frame comprising four sides. Each frame side may comprise a channel comprising a first surface, a second surface that opposes the first surface, and an edge truss retention feature. The example embodiment may further comprise at least one substrate comprising four major edges and a first surface, wherein each major edge may be configured with one or more edge trusses. Each edge truss may be configured from a corresponding fold in the at least one substrate, and each edge truss may extend along all, or a portion of a corresponding major edge of the at least one substrate. Each of the one or more edge trusses may be configured at an angle relative to the first surface of the at least one substrate, and the outermost edge trusses on each of the four major edges of the at least one substrate may comprise an outer perimeter edge. The at least one substrate may be configured for attachment to the frame such that each of the at least one edge trusses on each of the four major edges of the at least one substrate may nest inside a corresponding frame channel, and the perimeter edge of each outermost edge truss may be engaged by the corresponding frame channel's edge truss retention feature such that each of the outermost edge trusses may become lodged and secured within each corresponding frame channel.

In an example embodiment of the disclosed technology, a substrate structure may comprise at least one piece of substrate with a first surface and four corner regions, each corner region having one or more associated minor edges defining one or more corner cuts that define a corner cutout. The substrate structure may also comprise four major edges, wherein each major edge may be configured with one or more edge trusses, wherein each edge truss may be configured from a corresponding fold in the at least one piece of substrate. Each edge truss may extend along all, or a portion of a corresponding major edge of the at least one piece of substrate, wherein each of the one or more edge trusses may be configured at an angle relative to the first surface of the at least one piece of substrate, and wherein the outermost edge trusses on each of the four major edges of the at least one piece of substrate comprises an outer perimeter edge. The substrate structure may be configured for attachment to a substrate tensioning frame.

In an example embodiment of the disclosed technology, a light emitting device may comprise an enclosure configured for mounting on a grid frame of a suspended ceiling. The enclosure may comprise four sides, an opening defined by the four sides, and a top edge surface associated with each of the four sides, wherein the top edge surfaces may be disposed adjacent to the opening, and wherein the top edge surfaces may be configured to contact the grid frame of a suspended ceiling. Each of the top edge surfaces may each further be characterized by a channel comprising a first surface, a second surface that opposes the first surface, and an edge truss retention feature. The light emitting device may further comprise at least one substrate comprising four major edges and a first surface, wherein each major edge may be configured with one or more edge trusses, wherein each edge truss may be configured from a corresponding fold in the at least one substrate. Each edge truss may extend along all, or a portion of a corresponding major edge of the at least one substrate, wherein each of the one or more edge trusses may be configured at an angle relative to the first surface of the at least one substrate, and wherein the outermost edge trusses on each of the four major edges of the at least one substrate may comprise an outer perimeter edge. The at least one substrate may be configured for attachment to the enclosure such that each of the at least one edge trusses on each of the four major edges of the substrate may nest inside a corresponding channel of a top edge surface, and the perimeter edge of each outermost edge truss may be engaged by the corresponding channel's edge truss retention feature such that each of the outermost edge trusses may become lodged and secured within each corresponding channel.

DETAILED DESCRIPTION

As LED light fixtures become more commonplace in the market and prices decline, manufacturers may seek to cut manufacturing costs to increase profits etc. The largest single cost in a light fixture may be the LED light source. LED strips may be a lower cost alternative to that of LED panel arrays, and therefore more economical. LED strips may typically be commercially available in approximate 11' or 22' lengths, and may typically have one or two rows of LEDs on each strip. There term "LED array" will herein be referred to as one or more elongated LED strips, wherein each LED strip comprises one or more rows of LEDs. When LED arrays are used as the light source, the pinpoint high intensity light from the LEDs may create a significant problem with respect to having the individual LEDs visible through a light fixture lens, often referred to as "pixelization". In addition, excessively bright areas in the vicinity of the LED arrays, and uneven or visually unpleasing light distribution within the light fixture and across the lens may be evident. If LED arrays are mounted flat on the back surface of the light fixture and facing the lens, there may be only a 3" to 3½" light source to lens distance in a typical "troffer" light fixture. Accordingly, there may be little that can be done within that distance in order to distribute the light evenly or acceptably within the fixture or across the lens, while retaining reasonable fixture efficiency.

Figure 4A:
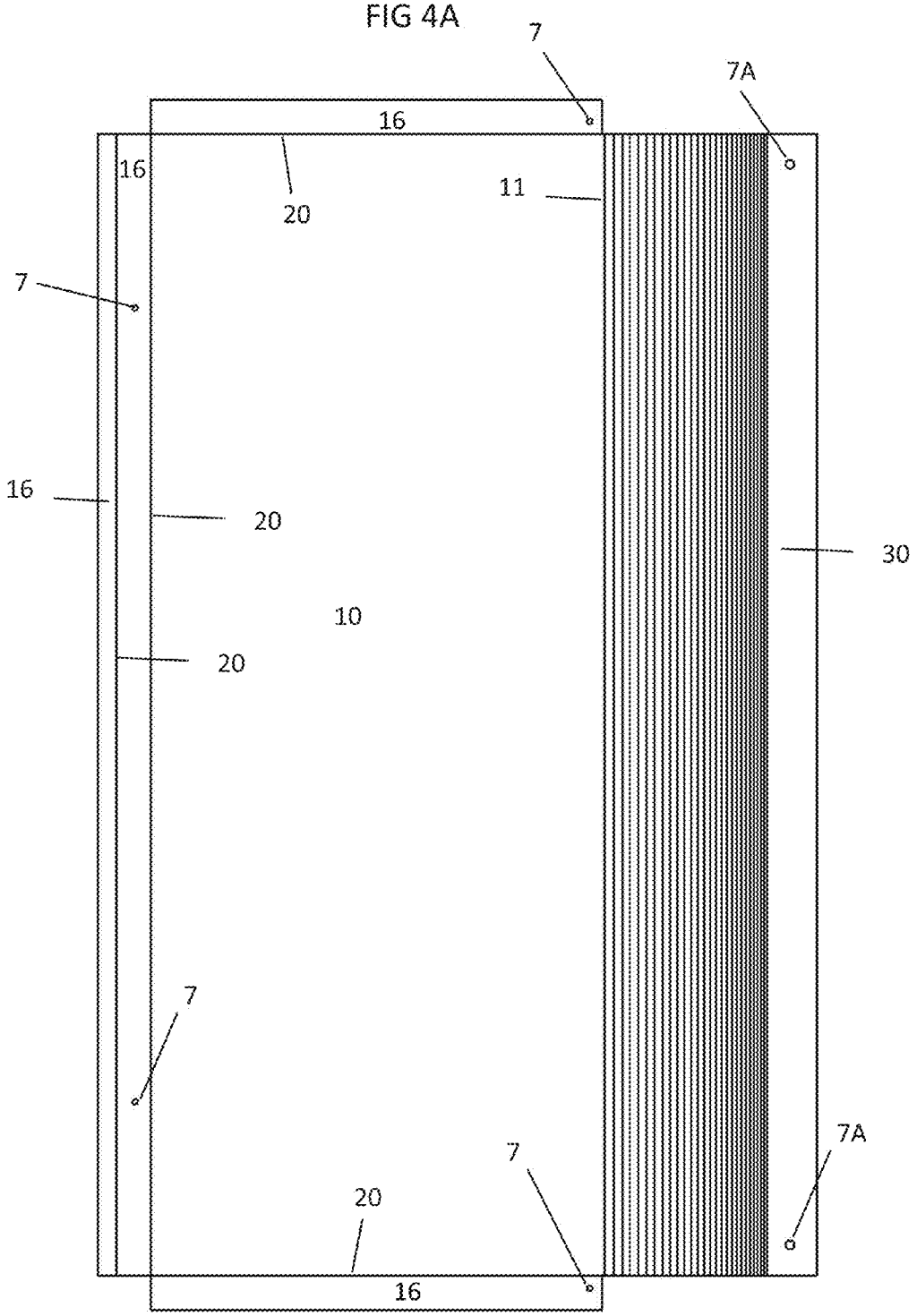
FIG. 4A depicts an optical film cutting and scoring template for one of the example embodiment light modifying element sections depicted in FIG. 3A
Figure 4B:
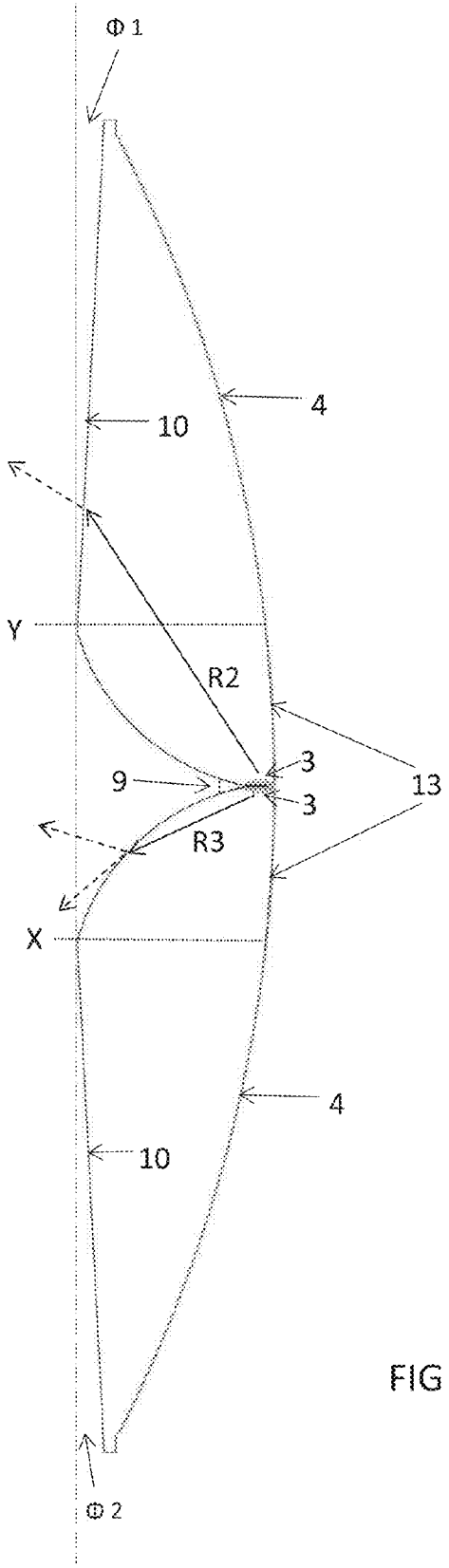
FIG. 4B depicts a light propagation diagram within an example embodiment of light fixture and light modifying element.

If two LED arrays were center mounted in a fixture as indicated by numeral 3 in FIG. 4B, and facing outwards towards curved reflector panels 4, and the back surfaces of the LED arrays were facing each other and in close proximity to each other as shown, then light may be distributed within the light fixture to a much greater extent than if the LED arrays were facing towards the aperture. While light distribution in the fixture may be significantly improved, there may remain a degree of illumination non-uniformity. The zone between line X and line Y may present a "problem area" wherein light directly from LED arrays 3, or light reflected from the reflector surface may create a "hotspot" area of brightness and or pixelization if a flat or relatively flat diffusion lens was utilized. Another problem may be that due to the space between the light emitting surfaces of opposing back-to-back LED arrays, there may be a strip of lower intensity light level above the two LED arrays, a "dead zone", which may create an objectionable shadow, dark area or color banding artifacts on a typical flat lens. Example embodiments herein may utilize the advantages of light fixtures with side facing LED arrays within a light fixture, while minimizing the effects of the problem area and dead zone.

Figure 1B:
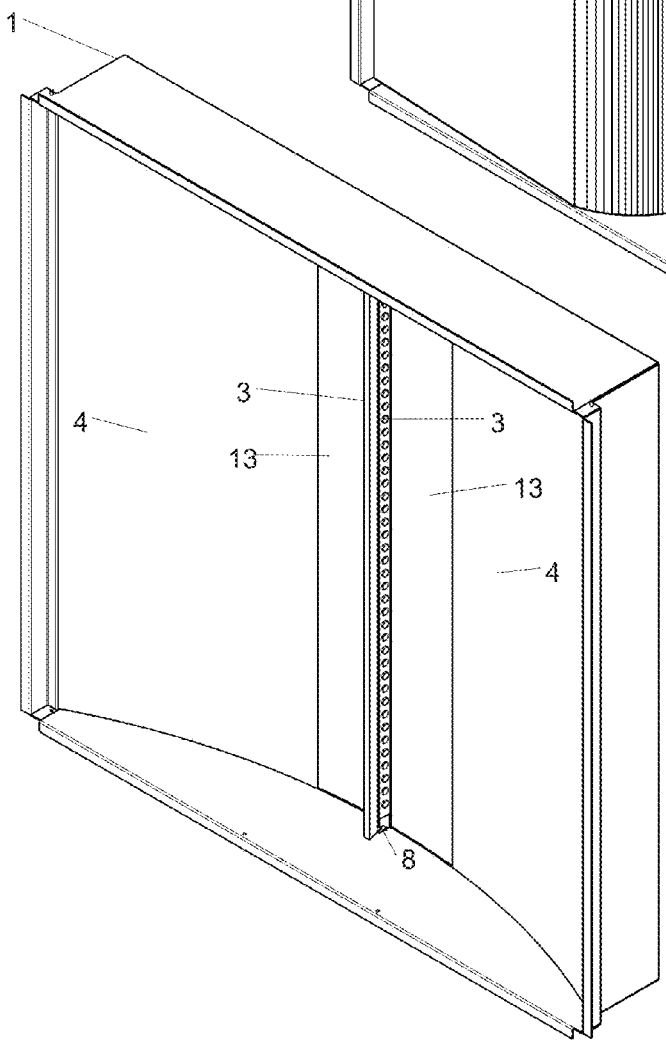
FIG. 1B depicts an exploded perspective view of the example embodiment of light fixture and LME depicted in FIG. 1A.
Figure 1C:
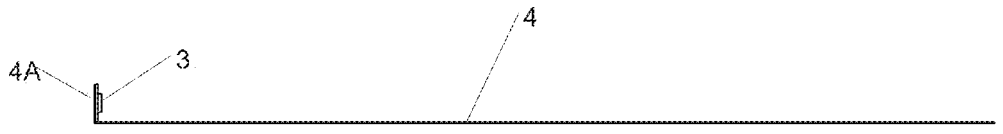
FIG. 1C depicts a side view of an example embodiment of reflector with integral heat sink before installation in a light fixture.
Figure 1D:
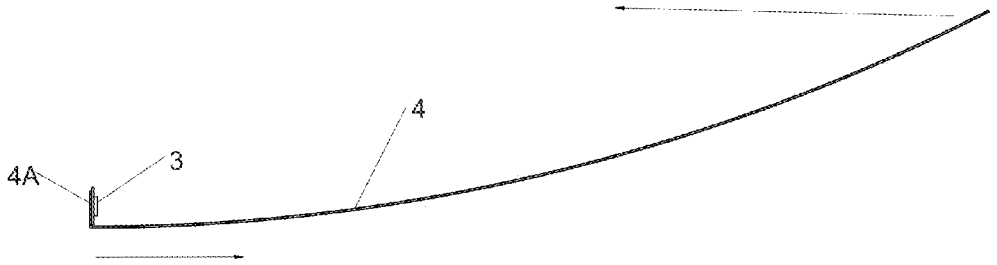
FIG. 1D depicts the reflector panel for the example embodiment of light fixture depicted in FIG. 1C after installation in a light fixture.

FIG. 1A depicts a perspective view of an example implementation of light fixture and light modifying element (LME), and FIG. 1B depicts a perspective view of the same, but with the LME 10 removed. In an example implementation, the advantages of even illumination of the LME 10, very good relative luminaire efficiency, and excellent visual aesthetic appeal may be realized utilizing only two LED arrays 3 as a light source. LED arrays 3 may be mounted vertically, wherein the light emitting face of each LED strip faces opposing sides of the light fixture enclosure 1, and may be mounted back-to-back in close proximity to each other, and in a central region of the inner back surface of the enclosure 1 as shown in FIG. 1B. Curved reflectors 4 are shown, however example embodiments of light fixtures with LED arrays mounted as described may also have flat reflecting surfaces, as shown in FIG. 1G for example. Although the uniformity of light distribution on the reflecting surfaces may be lower, it may nevertheless still be advantageous.

Example embodiments may utilize LED array mounting features configured from metal extrusions to retain linear LED arrays in their required orientations. Metal extrusions may be advantageous due to their low cost. FIG. 1H depicts two back-to-back right angle extrusions 40 with LED arrays 3 mounted on opposing surfaces of the extrusions 40. The bases of the extrusions may attach to the inner back surface of the enclosure 1C as shown in FIG. 1G, utilizing any suitable fastener or fastening method. Right-angled extrusions may also be advantageous from a thermal perspective, wherein heat from the LED arrays may transfer through the horizontal bases of the extrusions through to the inner back surface of the enclosure 1C. FIG. 1I depicts LED arrays 3 mounted on a single extrusion 41, wherein the single extrusion may mount and attach to the inner back surface of enclosure 1 in a similar manner as the right-angled extrusions. In an example embodiment, reflector panel retaining tabs 41B are configured on the extrusion base wherein a reflector panel may insert into each tab 41B, thus creating an attachment point with a relatively smooth transition between the extrusion and reflector panel. Single extrusions may have the advantage of a lower cost than two right-angled extrusions. Example embodiments of metal extrusions may comprise any other shape that may function to adequately dissipate heat from LED arrays, and to orient LED arrays in a light fixture as described.

Example embodiments of LED array mounting features may also comprise profiles similar to those described that utilize extrusions, but utilize folded sheet metal as an alternative. The functionality of example embodiments utilizing folded sheet metal may be very similar to that of extruded example embodiments; the choice of which fabrication method may primarily be based on cost and convenience considerations.

Example embodiments of LED array mounting features have been described as comprising metal. However, example embodiments may also comprise other materials that may have suitable mechanical and thermally conductive properties, just as plastics, composites, or polymers.

In an example embodiment, LED arrays may mount directly on a reflector panel that also functions as a heat sink to dissipate the heat generated by the LED arrays, that may have a lower manufacturing and assembly cost compared to utilizing extrusions as described. Referring to FIG. 1C, the reflector panel 4 may comprise a flat panel of a suitable substrate such as metal for example, with an approximate 90-degree fold on one side that may create an LED array-mounting flange 4A, whereon the LED strip 3 may mount. A light fixture enclosure may include four or more mounting features such as slots, catches, folds etc. (not shown) wherein each flat reflector panel 4 may be held in a curved compressed disposition by the four or more mounting features. Referring to FIG. 1D, when the reflector panels 4 are compressed in the direction of the arrows and inserted in a light fixture, they may form a curved shape as shown. The reflector panel 4 may comprise LED array mounting flange 4A, and may have the advantage of low manufacturing and assembly costs. In an example embodiment, the reflector panels 4 may have reflective white paint on their reflection surfaces, or may be coated with any suitable diffuse reflective coating or surface. High efficiency diffuse reflection surfaces such as White 97 manufactured by White Optics may offer superior optical efficiency.

In an example embodiment, a reflector panel with integral LED array mounting flange may be utilized wherein the panel may have a curved shape already formed into the panel during a manufacturing process such as stamping or extruding.

Example embodiments of light fixtures described may comprise alternate LED mounting angles between vertical and horizontal which may function suitably with a given lens configuration. FIG. 1J depicts a side view of reflector panels 4 (not to scale for illustrative purposes) that are similar to an example embodiment shown in FIGS. 1C and 1D, except that the LED array mounting flanges 4A are angled at an example alternate angle of approximately 45 degrees. LED arrays 3 may be mounted on LED array mounting flanges 4A. When an example embodiment of lens similar to that shown in FIG. 1A is utilized with the described example alternate LED-mounting angle of 45 degrees, luminaire efficiency may increase due to lower light losses due to reflections within the light fixture. Although brightness in the central area of the lens (which may be subsequently described) will increase, it may nevertheless be suitable for many applications. By altering the LED array mounting angle relative to the plane of the inner back surface of an enclosure back, for example between 80 degrees as shown by a in FIG. 1J, and 135 degrees as shown by angle β in FIG. 1J, the desired tradeoff between brightness in the central lens area and luminaire efficiency may be configured for a given application.

In an example implementation of light fixture similar to that as previously described and shown in FIG. 1B, two or more LED arrays may be mounted back-to-back in close proximity to each other, and in a central region of the inner back surface of an enclosure, wherein the plane of the light emitting face of each LED strip may be oriented at alternate angle. In an example implementation of light fixture, two or more LED arrays may be mounted back-to-back in close proximity to each other, and in a central region of the inner back surface of an enclosure, wherein the plane of the light emitting face of each LED strip may be oriented within a range of 80 degrees and 90 degrees relative to the plane defined by the inner back surface of the enclosure. In an example implementation of light fixture, two or more LED arrays may be mounted back-to-back in close proximity to each other, and in a central region of the inner back surface of an enclosure, wherein the plane of the light emitting face of each LED strip may be oriented within a range of 100 degrees and 90 degrees relative to the plane defined by the inner back surface of the enclosure. In an example implementation of light fixture, two or more LED arrays may be mounted back-to-back in close proximity to each other, and in a central region of the inner back surface of an enclosure, wherein the plane of the light emitting face of each LED strip may be oriented within a range of 110 degrees and 100 degrees relative to the plane defined by the inner back surface of the enclosure. In an example implementation of light fixture, two or more LED arrays may be mounted back-to-back in close proximity to each other, and in a central region of the inner back surface of an enclosure, wherein the plane of the light emitting face of each LED strip may be oriented within a range of 120 degrees and 110 degrees relative to the plane defined by the inner back surface of the enclosure. In an example implementation of light fixture, two or more LED arrays may be mounted back-to-back in close proximity to each other, and in a central region of the inner back surface of an enclosure, wherein the plane of the light emitting face of each LED strip may be oriented within a range of 135 degrees and 120 degrees relative to the plane defined by the inner back surface of the enclosure.

Example embodiments of light fixtures with alternate LED mounting angles as described may be utilized with any mounting features as described. For example, extrusions may be created with LED mounting surfaces configured with the desired alternate LED mounting angles.

In an example embodiment as shown in FIG. 1B, the driver for the LED arrays 3 and line voltage wires may be mounted underneath either of the reflector panels 4. If the reflector panels comprise a substrate (such as metal) that is properly UL (or similar) rated, the reflector panels 4 may also function as the "wire tray" which houses the line voltage wires and LED driver. This may have cost saving advantages of the enclosure not having to have a separate wire tray.

Example embodiments with back-to-back LED array configurations as described may also be configured in light fixtures without curved reflectors therein, as previously described. For example, FIG. 1G depicts an example embodiment with no separate reflectors. The light fixture enclosure 1 may comprise two back-to-back LED arrays 3 mounted on right-angled extrusions 40 that are mounted on the inner back surface of the enclosure 1C as previously described. Although the light distribution within the light fixture and on an LME surface may not be as even, it may nevertheless still produce exemplary results.

Referring to FIG. 1A, LME 10 may comprise two separate pieces, or may comprise only one piece; the determination may be based on which configuration may achieve the lowest manufacturing cost, ease of manufacture, ease of installation etc. The LME 10 may comprise a clear or translucent substrate configured to modify light from LED arrays 3. The substrate may include any type of substrate that may provide suitable structure and optical properties for the intended application. Examples of suitable substrates may include polycarbonates or acrylics. The substrate may have associated with it any type of light modifying features that may be suitable for an intended application. In one example implementation, the substrate may have a light modifying layer deposited on either or both surfaces. In one embodiment, the light modifying layer(s) may include diffusion particles such as glass beads. In other example implementations, the substrate may have light modifying elements incorporated within the substrate itself, such as diffusion particles for example. In certain example implementations, the substrate may have features formed onto its outer surface, such as prismatic or Fresnel features. In accordance with various example implementations of the disclosed technology, the substrate may have various combinations of light modifying features, for example, particles incorporated into the substrate itself and a light modifying layer deposited on one or more surfaces. In certain example implementations, the substrate may include an optical film overlay.

In an example embodiment, the single LME or two LME sections may be fabricated by any suitable method, such as injection molding, vacuum forming or extrusion methods for example. An example embodiment of LME may be fabricated with its final shape as shown by the LME 10 in FIG. 1A. FIG. 1K depicts a partial side view of an example embodiment of LME configured from a single piece of a rigid or semi rigid clear or translucent substrate as described. The lens mounting area 30 may nest between LED array mounting features without any fasteners provided the LME may be otherwise securely attached to the light fixture.

In example embodiments wherein an LME has enough flexibility such that sufficient access to the inside of the light fixture can be obtained, the LME may be fastened to the LED array mounting features. In an example embodiment as shown in FIG. 1L, (LME 10 has been truncated for illustrative purposes) lens mounting area 30 of each LME 10 may be configured with a hole on each corner wherein the holes may correspond to the locations of slots on the LED array mounting features 40. A trim strip 9 (that may be subsequently described) may be configured with holes in locations corresponding to the holes in the LMEs 10. The two LMEs 10 and the trim strip 9 may be placed together and in between the LED array mounting features 40 wherein all the holes are aligned, and a fastener such as a pin, rivet, screw or any suitable fastener arrangement (for example screw 31 and nut 32) may be inserted through the holes, thus securing the LME assembly to the light fixture.

Figure 1E:
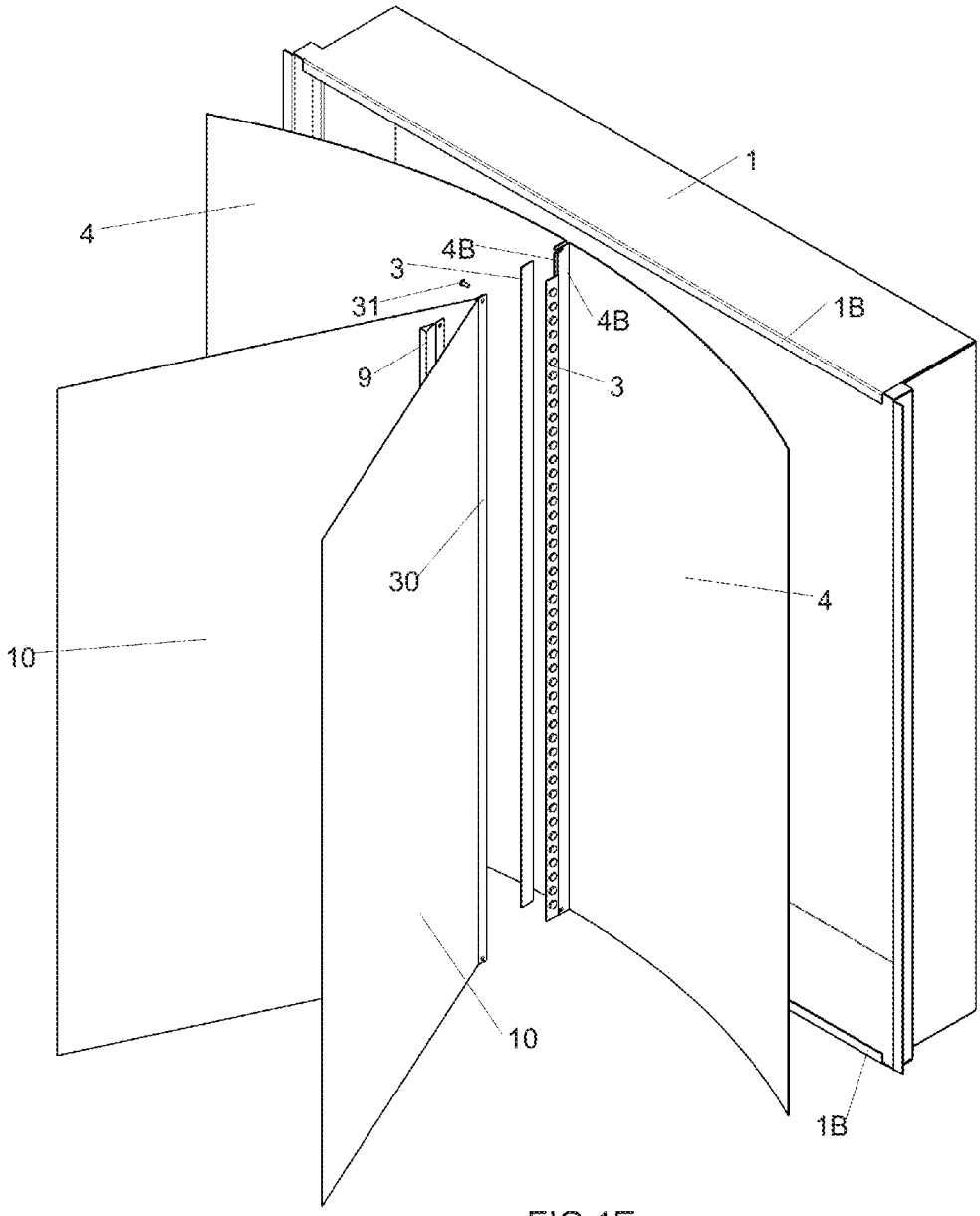
FIG. 1E shows an exploded perspective view of an example embodiment of light fixture and light modifying element in an uncompressed state.
Figure 1F:
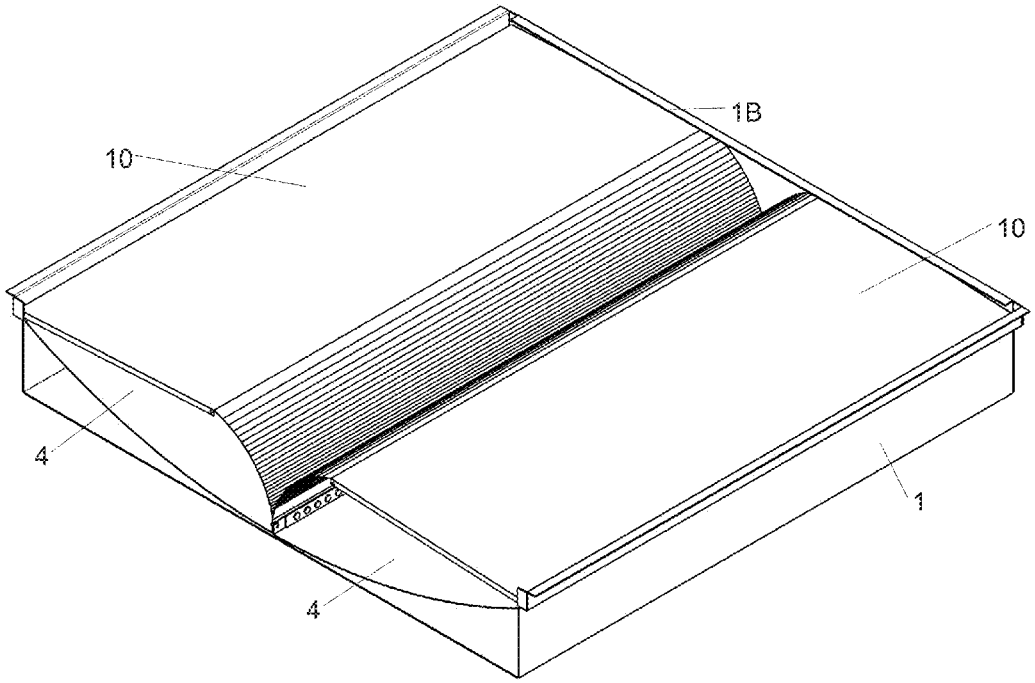
FIG. 1F shows a cut-away perspective view of an example embodiment of light fixture and light modifying element.
Figure 1G:
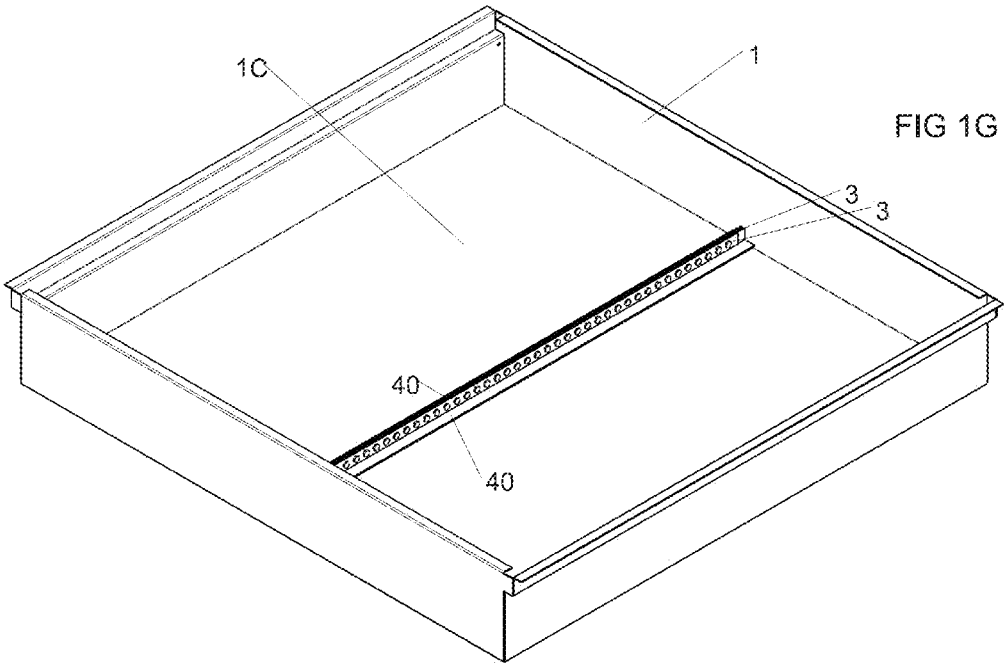
FIG. 1G shows an example embodiment of light fixture with an example embodiment of an LED array-mounting feature.
Figure 1H:
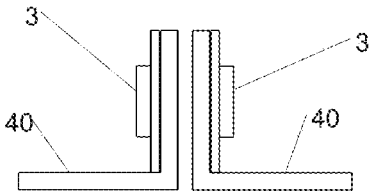
FIG. 1H shows a profile view of an example embodiment of an LED array-mounting feature.
Figure 1I:
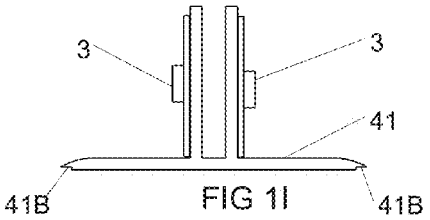
FIG. 1I shows a profile view an example embodiment of an LED array-mounting feature.
Figure 1J:
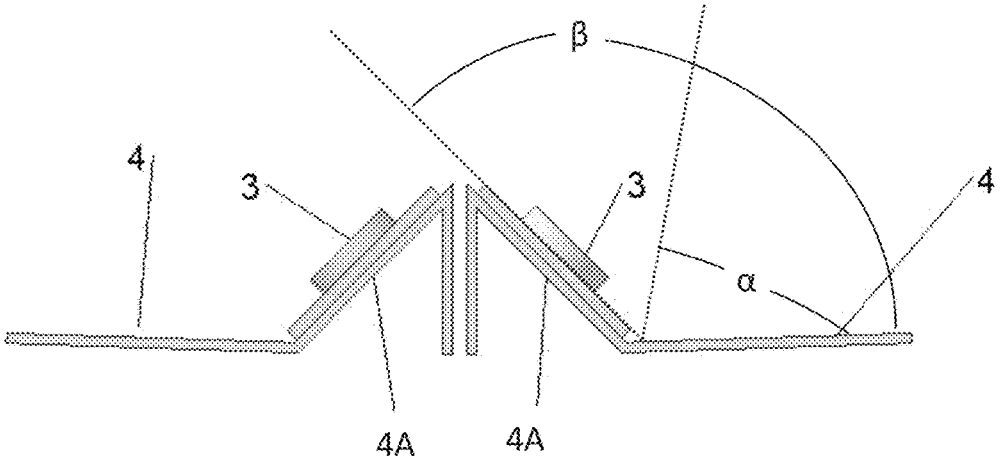
FIG. 1J shows a profile view an example embodiment of LED array mounting feature.
Figure 1K:
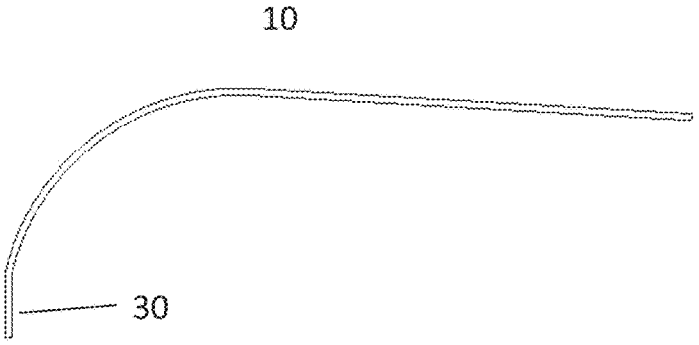
FIG. 1K shows a profile view of an example embodiment of light modifying element configured from a single piece of a rigid or semi rigid clear or translucent substrate.
Figure 1L:
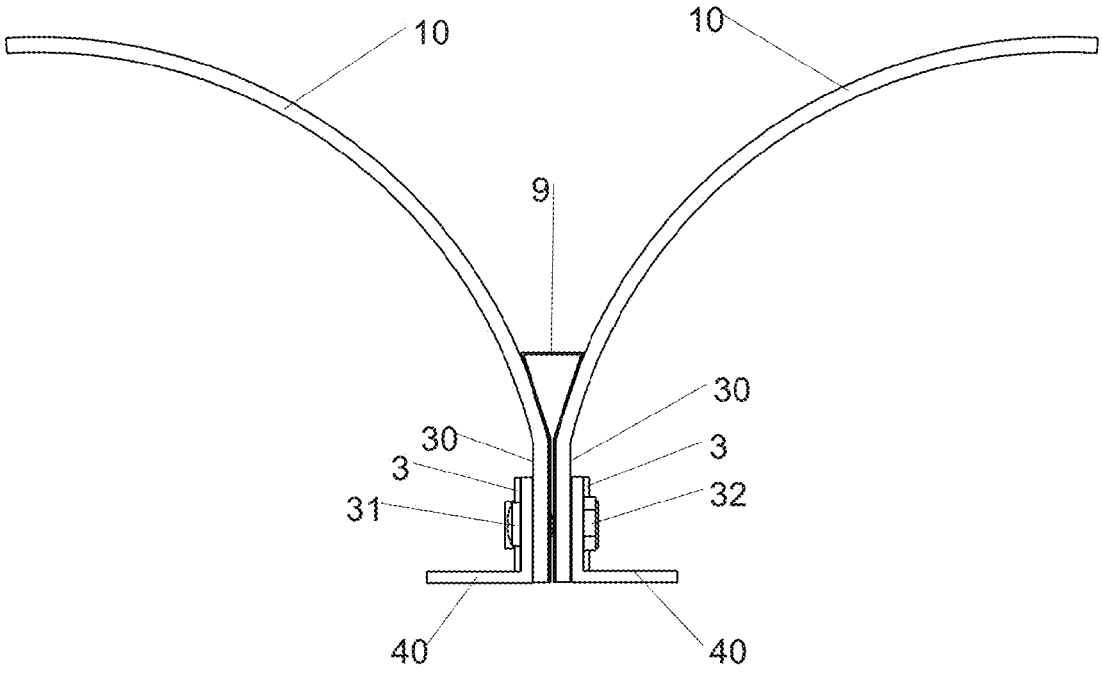
FIG. 1L shows a close-up side view of an example embodiment of light modifying element disposed between two LED array-mounting features.

Example embodiments of LME may be fabricated with a flat flexible substrate as shown in FIG. 1E, which depicts an exploded perspective view of an example embodiment of LME. The flat flexible substrate may include any material that may possess the optical and mechanical properties required for an intended application, and may comprise any types previously described, and may also include certain optical films. The reflector panels 4 may be shown in their compressed curved state rather than their normal flat state. The LMEs 10 which may comprise a flat flexible substrate, may have mounting edges 30, which insert between LED array mounting flanges 4B on the reflector panels 4, and fasten with pins, rivets, screws or any suitable fastener 31 to the LED mounting flanges 4B through slots 8, similar to a previously described example embodiment. Trim strip 9 may also be indicated. Once attached to the LED mounting flanges 4B, the LMEs 10 may subsequently be laterally compressed, and the top and bottom LME 10 edges may be inserted under the two enclosure lip flanges 1B, wherein the LMEs attachment to the LED mounting flanges 4B, the enclosure lip flanges 1B, and the side edges of the enclosure 1 may function to retain the LMEs 10 in a compressed state as shown in FIG. 1F. FIG. 1F depicts a cutaway perspective view of an example embodiment as shown in FIG. 1E, showing the compressed LME sections 10 and the top edges of the LME sections 10 disposed beneath enclosure lip flange 1B of enclosure 1. Reflector panels 4 may also indicated.

The example embodiment just described depicts the LME sections 10 being retained in their compressed curved state by enclosure lip flanges 1B. However, any mechanical means may be utilized to retain the shape of the LME sections that may be cost effective and visually acceptable. For example, fasteners, clips, detachable extrusions, folds in the enclosure sheet metal etc. may be utilized. For example, the requirement to have the LME removable once the fixture is installed may dictate the preferred mechanical means of retention of the LME sections 10.

FIG. 4B depicts a simplified side cross section view of an example embodiment, with reflector panels 4 and LME 10 similar to that shown in FIGS. 1A and 1B. As disclosed in a related application, there may be a cumulative effect of the interaction of light with a diffusion lens surface, wherein light striking the surface at lower angles of incidence, such as light ray R3 on the curved section of the LME 10, may undergo additional increased scattering and subsequent reflection, refraction and absorption than the light rays striking the LME 10 at angles closer to the surface normals of LME 10, such as light ray R2. As shown in FIG. 4B, the curved LME 10 surfaces near the dead zone are generally at steep angles relative to the normals of the LED arrays 3. Due to the optical properties of diffusion lenses as previously described with respect to smaller angles of incident light, the scattering and/or total internal reflection of the light from the light source may be highest in the curved sections of the LME 10 than on the planar sections. Accordingly, the curved sections of the LME 10 in the problem area between lines X and Y may have the effect of decreasing transmitted relative light levels that exit the LME 10 lens in the problem area.

Trim strip 9 may be utilized as an important visual aesthetic feature in the center between each LME 10 as a decorative trim and to hide the joint between each LME 10 section. Perhaps most importantly, the trim strip 9 may be configured with the appropriate size to hide or eliminate the dead zone.

Still referring to FIG. 4B, each reflector panel 4 may include a strip of prismatic film 13 in the problem area that may be parallel and adjacent to each LED strip 3. The prismatic film 13 may be oriented with the structured surface facing away from the reflectors 4, and the prism rows aligned parallel to the LED arrays 3. The prismatic film strips 13 may have the effect of diverting a significant portion of the light incident on its surface towards other areas between the LME's 10 and the reflector panels, and away from the problem area. The prismatic filmstrips 13 may also be shown in FIG. 1B.

Another feature of an example embodiment as shown in FIG. 4B may be that the planar sections of each LME 10 may be angled away from the aperture plane of the light fixture (indicated by the dotted line), as shown by angles Φ1 and Φ2. The effect may be that direct light from the LED arrays incident on those planar LME surfaces (light ray R2 for example) may have greater angles of incidence (closer to the surface normals) than would have otherwise occurred with horizontal LME planar sections. The cumulative result may be greater light output in those areas, increased fixture efficiency, and a widened light dispersion pattern.

An example embodiment of lenses with one or more refraction features may now be described. An example embodiment of lens may comprise a substrate defining a plane of incidence and having a first surface. The substrate may comprise a uniform transmittance region and at least one refraction feature pattern or shape region adjacent to the uniform transmittance region and defining a refraction feature pattern or shape region. A refraction feature pattern or shape region may comprise at least one refraction element, and the at least one refraction element may comprise, one or more of:

a height variation of the first surface;
a thickness variation of the substrate;
a refractive index variation of the first surface;
a refractive index variation of the substrate; and
a coating in contact with the first surface.

The at least one refraction element of the at least one refraction feature pattern or shape region may be configured to alter a transmittance angle of at least a portion of light input to the lens at an incidence angle with respect to the plane of incidence.

A refraction feature pattern or shape region may comprise any shape or pattern, for example, a square, a circle, a grouping of parallel linear elements, a rectangle, a shape comprising a gradient, etc. The shape or pattern on a lens, and may be configured to modify light from a light fixture in a more efficient manner than with just the lens, or to create a more visually pleasing light output. For example, the shape or pattern may function to lower pixelization and increase lamp hiding on an LED light fixture. For example, the pattern or shape may function to create a region of higher density diffusion particles disposed over top of an LED light source. The shape or pattern may be also be configured to add a visual aesthetic or an ornamental design feature to an example embodiment of lens. Refraction elements may be formed onto any type of lens, including lenses comprising a clear or translucent substrate that may be either rigid or semi-rigid, or lenses comprising optical film.

Refraction elements may be formed on an example embodiment of lens on either the front or back lens surface, or on both surfaces. They may comprise protuberances or grooves on a lens surface with any type of cross-sectional profile that may enable a desired light refraction characteristic, for example, prismatic, Fresnel, curves etc., that may be formed or molded into the substrate. Refraction elements may comprise variations in a surface configuration of the lens. For example, a lens with a surface coating, for example a diffusion coating, may not have the coating applied to the surface areas of the refraction features. Alternatively the refraction features may have an additional coating applied to those areas. Surface variations as described may be created by etching, printing, or any other method that may achieve suitable characteristics. For example, a lens formed utilizing an injection molding process may have refraction elements formed by different textures created in corresponding areas of the mold cavities. Refraction elements may comprise areas of a lens surface that may have ink or diffusion elements applied utilizing printing techniques or methods such as an inkjet or laser printer for example. Refraction features may be created by a computer-controlled laser that may etch lines, patterns, textures or shapes onto a lens surface, whereby creating a surface texture or depth in those areas that may be different from the rest of the lens surface. Lenses may have one or more optical film overlays wherein the refraction features may be formed on the one or more optical film overlays. Lenses may have one or more optical film overlays wherein the refraction features may comprise only the optical film overlays. On optical film lenses, refraction elements may be laser etched, scored, printed, heated, stamped, embossed etc. on an optical film surface. For example, a stamping die may create score lines or a textured pattern area on a film surface.

Any refraction elements described herein may also be configured to be opaque or semi-opaque.

Figure 20:
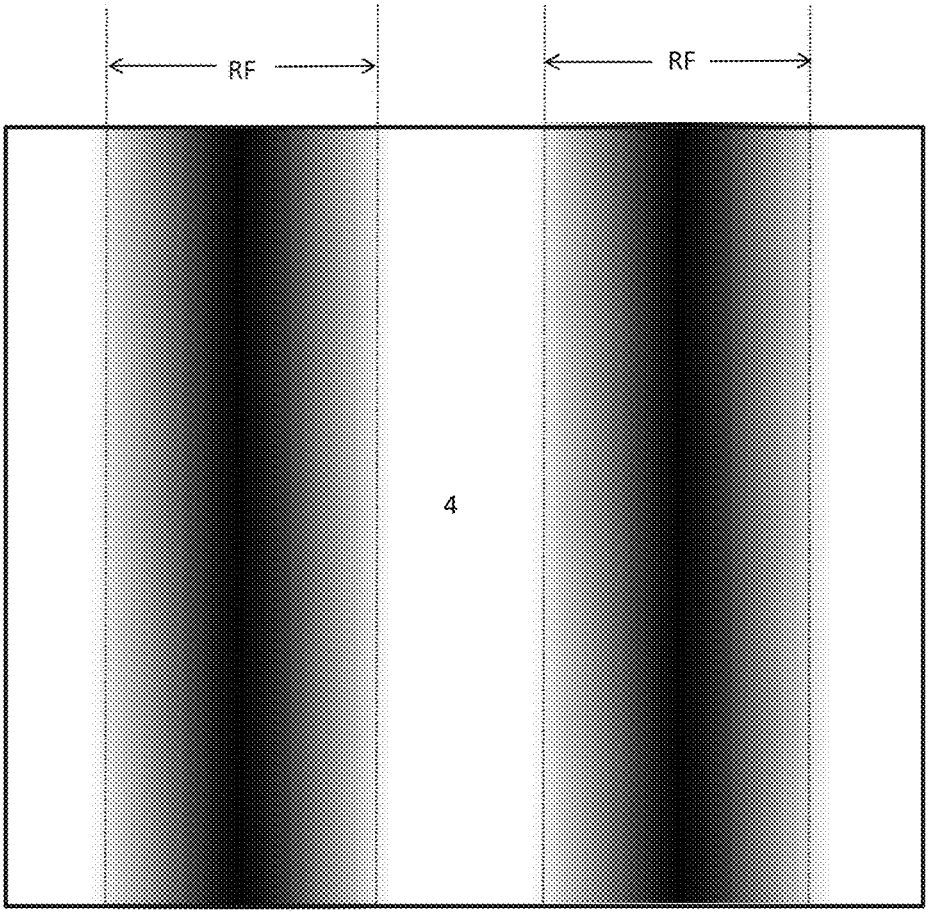
FIG. 20 shows a perspective view of an example embodiment of lens comprising printed refraction features.

An example embodiment of lens with refraction features that may be applied by one or more methods as described may be shown in FIG. 20. Lens 4 may comprise an optical film lens, or a lens comprising a clear or translucent substrate, wherein refraction features RF (the areas between each set of dotted lines) comprise a layer of particles that have been printed on a surface of the lens by a printing process, technique or method, or surface textures created by other methods as previously described. In an example embodiment, each refraction feature RF may have a gradient pattern wherein the particles (or texture etc.) may be more dense and or more closely spaced in the center region of each refraction feature RF and the particles (or texture etc.) may become less dense and or spaced further apart towards the outer edges of each refraction feature RF. In an example embodiment, each refraction feature RF may have a gradient pattern wherein a layer of particles (or texture etc.) may be thicker in the center region of each refraction feature RF and the layer of particles (or texture etc.) may become thinner towards the outer edges of each refraction feature RF. Each refraction feature may be printed utilizing any suitable material, for example, diffusion particles such as glass beads, or white ink with reflective particles such as titanium dioxide.

In an example embodiment, metallic or white particles may be printed on any surface of a lens with an inkjet printer. For example, a large format printer such as the VersaCAMM VSI series by the Roland Corp. may be configured to print highly reflective silver metallic ink as well as white ink. Solid or gradient refraction features as previously described may be able to be printed in any combination of white and silver. The density of printed refraction features may be varied to obtain the required lamp hiding, diffusion, and luminaire efficiency. Additionally, silver or opalescent colors may function to add a unique aesthetic quality to an example embodiment of lens.

The pattern may be etched onto the lens surface with a laser beam or created in an injection molding process as described.

Figure 10:
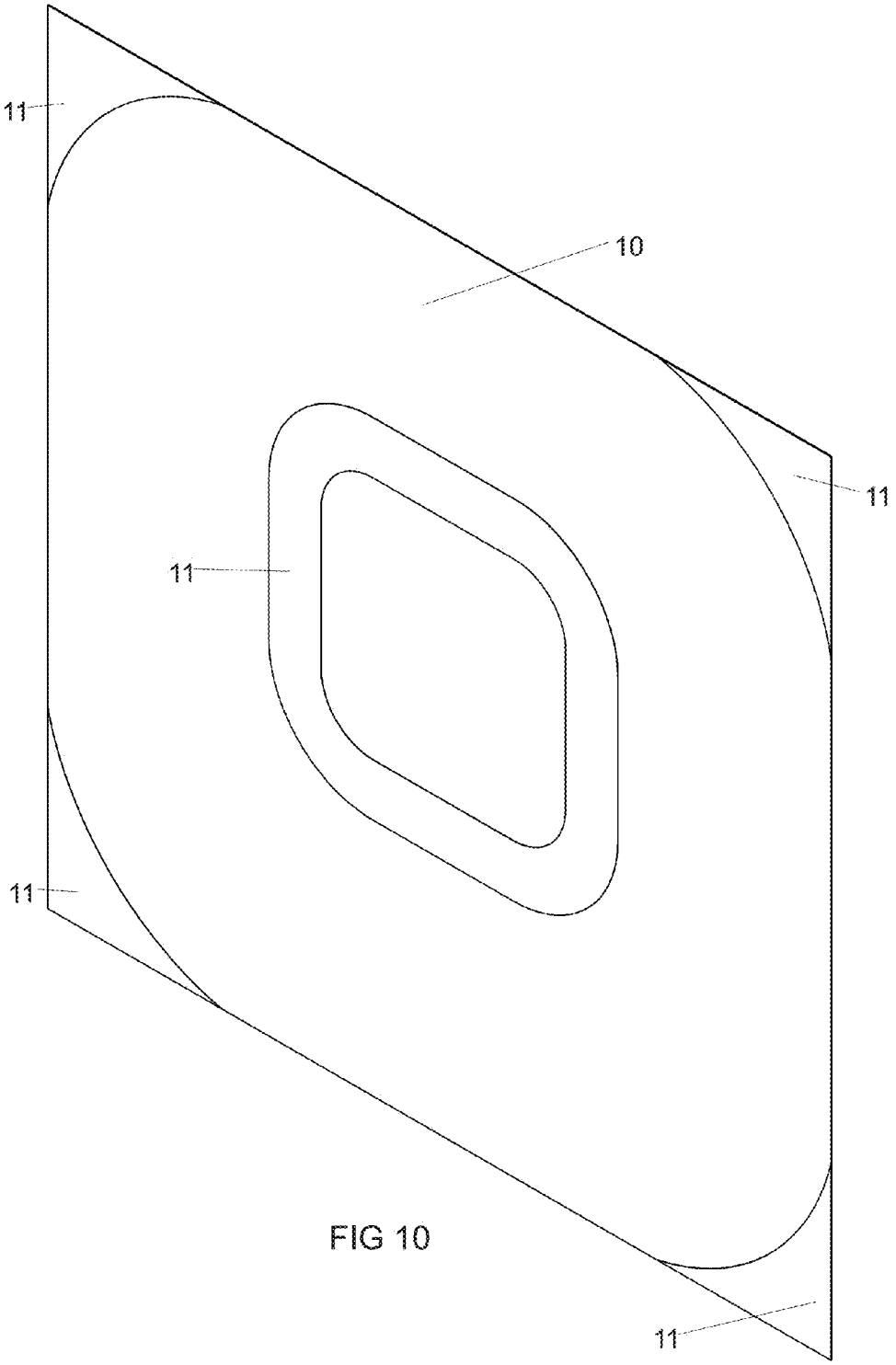
FIG. 10 shows a lens with example embodiments of light refraction features disposed thereon.

An example embodiment of lens with refraction features that may be applied by one or more methods as described may be shown in FIG. 10. Lens 4 may comprise an optical film lens, or a lens comprising a clear or translucent substrate. The lens may attach to light fixture wherein LED arrays may be mounted in a square pattern inside the fixture. Refraction features 11 may comprise a layer of particles that have been printed on a surface of the lens by a printing process, technique or method, or surface textures created by other methods as previously described. Each refraction feature may be printed utilizing any suitable material, for example, diffusion particles such as glass beads, or white ink with reflective particles such as titanium dioxide. The pattern may be etched onto the lens surface with a laser beam or created in an injection molding process as described. The center refraction feature 11 may be configured wherein it may be disposed over top, or adjacent to the square mounted LED arrays.

Figure 11:
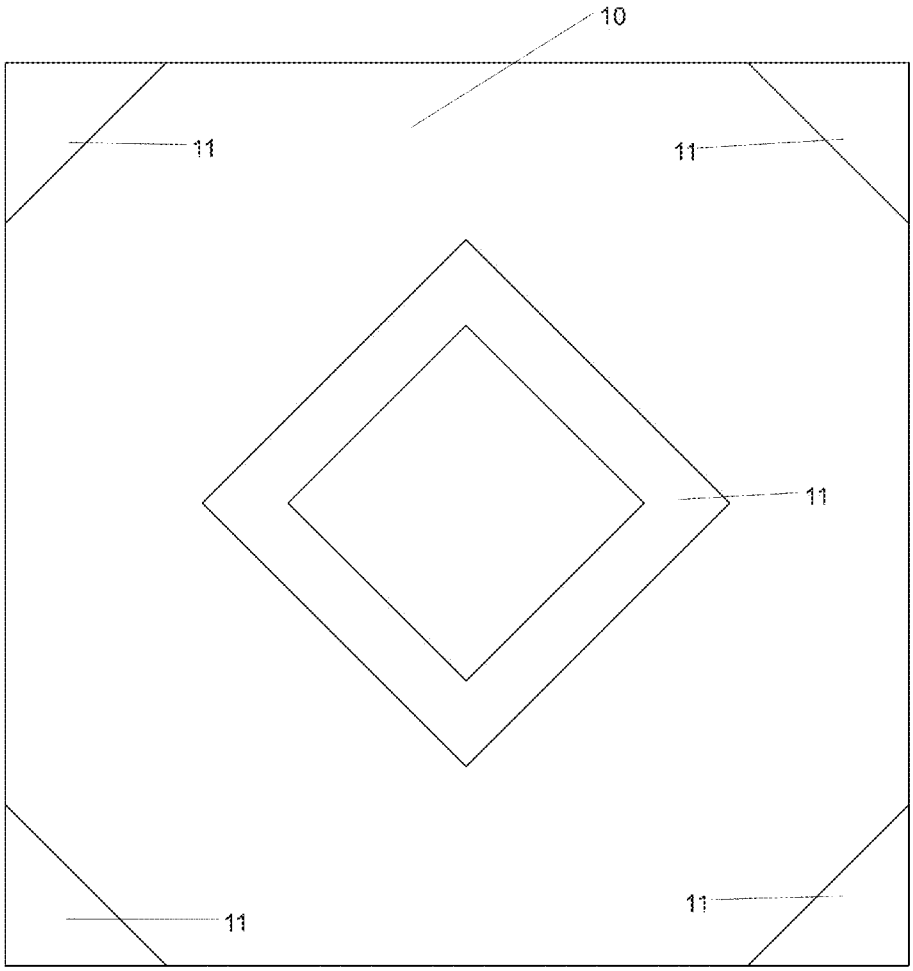
FIG. 11 shows a lens with example embodiments of light refraction features disposed thereon.

An example embodiment of lens with refraction features that may be applied by one or more methods as described may be shown in FIG. 11. Lens 4 may comprise an optical film lens, or a lens comprising a clear or translucent substrate. The lens may attach to light fixture wherein LED arrays may be mounted in a diamond pattern inside the fixture. Refraction features 11 may comprise a layer of particles that have been printed on a surface of the lens by a printing process, technique or method, or surface textures created by other methods as previously described. Each refraction feature may be printed utilizing any suitable material, for example, diffusion particles such as glass beads, or white ink with reflective particles such as titanium dioxide. The pattern may be etched onto the lens surface with a laser beam or created in an injection molding process as described. The center refraction feature 11 may be configured wherein it may be disposed over top, or adjacent to the diamond mounted LED arrays.

In the example embodiment shown in FIG. 20, each refracting feature RF may be configured on a lens wherein once the lens may be installed on a light fixture, each refracting features may be disposed and centered over top of two linear light sources. In a commercially available light fixture, a typical lens may have a constant homogenous diffusion level throughout the surface area of the lens. The level of diffusion may have been selected to provide adequate diffusion and lamp hiding in the areas of the lens disposed nearest the light source. However as a result, there are areas on the lens that are further away from the light source that may not require as high a diffusion level. Accordingly, these areas may be unnecessarily restricting the light output, and therefore unnecessarily lowering the overall luminaire efficiency. In the example embodiment as shown and described from FIG. 20, the level of diffusion within the refracting feature RF may be scaled inversely to the light intensity incident on the lens surface, which may provide an overall optimal diffusion level, which may significantly increase luminaire efficiency. Refracting features as described may also function to add aesthetic visual appeal and uniqueness to a lens that may be an important element in the commercial success of a lens or light fixture.

In example embodiments wherein the refraction elements may comprise grooves or protuberances, thin elongated linear shapes may be utilized that may function to increase lamp hiding and to add an appealing visual aesthetic. The refraction features may be oriented parallel to an LED arrays or linear light source, wherein direct light from the linear light source may strike the sides of the refraction elements, which may create more pronounced refraction of the light source. Any other groupings or orientations of linear refraction lines may be utilized that may add the desired visual aesthetics and photometric properties.

In an example embodiment as shown in FIG. 1A, a lens may contain refraction features comprising groupings of refraction elements that may comprise thin elongated linear shapes. The curved sections of the LME 10 sections may include a grouping of linear refraction elements 11. The refraction elements 11 may function to help blend and obscure the presence of the light source 3 in the problem area, increase the perceived depth of the LME, and may create a more visually appealing look. The space between individual refraction elements 11 may be increased as the distance from the lenses axis of symmetry increases. Since the brightness on the LME 10 surface may be higher nearest the LED arrays 3, and decrease as the distance from the LED arrays increases, the progressively increasing space between the refraction elements 11 may function to aid in visually masking this higher brightness in a visually appealing way.

As recited in the "Related Applications" section, this application is a continuation-in-part of PCT Patent Application PCT/US2013/039895 entitled "Frameless Light Modifying Element" filed May 7, 2013, and is also a continuation-in-part of PCT Patent Application PCT/US2013/059919 entitled "Frameless Light Modifying Element" filed Sep. 16, 2013. As described, various example embodiments of self-supporting optical film lenses were included which incorporate "edge trusses" on two or more edges of an optical film piece. Each edge truss may include one or more sides configured from a corresponding fold in the optical film, wherein at least one of the one or more sides is configured at an angle relative to the lens plane to impart support to the lens and to resist deflection of each edge truss. In example embodiments, edge trusses may impart sufficient structural rigidity to pieces of optical film to support portions of the optical film in a substantially planar configuration.

Figure 2:
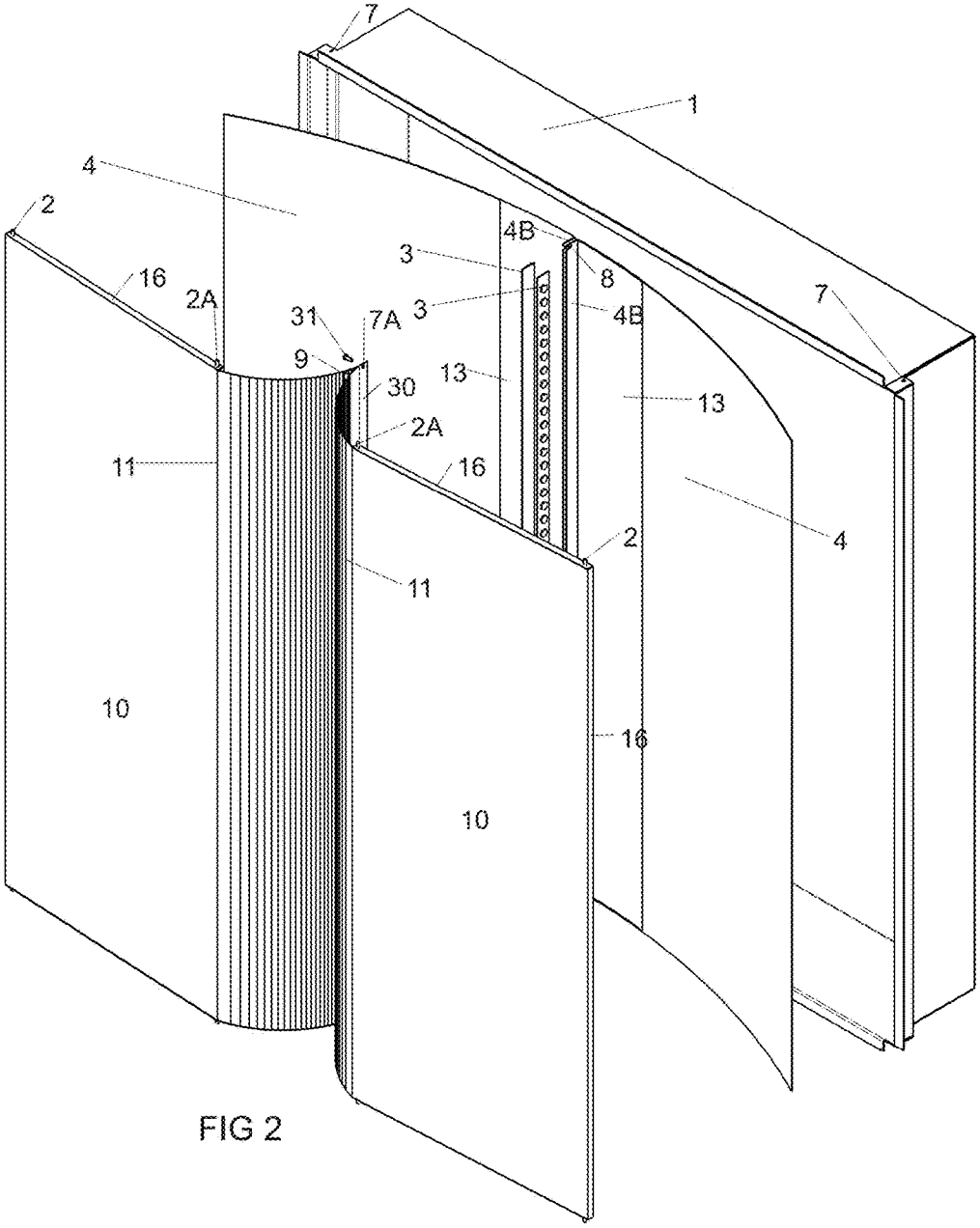
FIG. 2 depicts a perspective exploded view of an example embodiment of light fixture with an example embodiment of an optical film light modifying element.
Figure 3A:
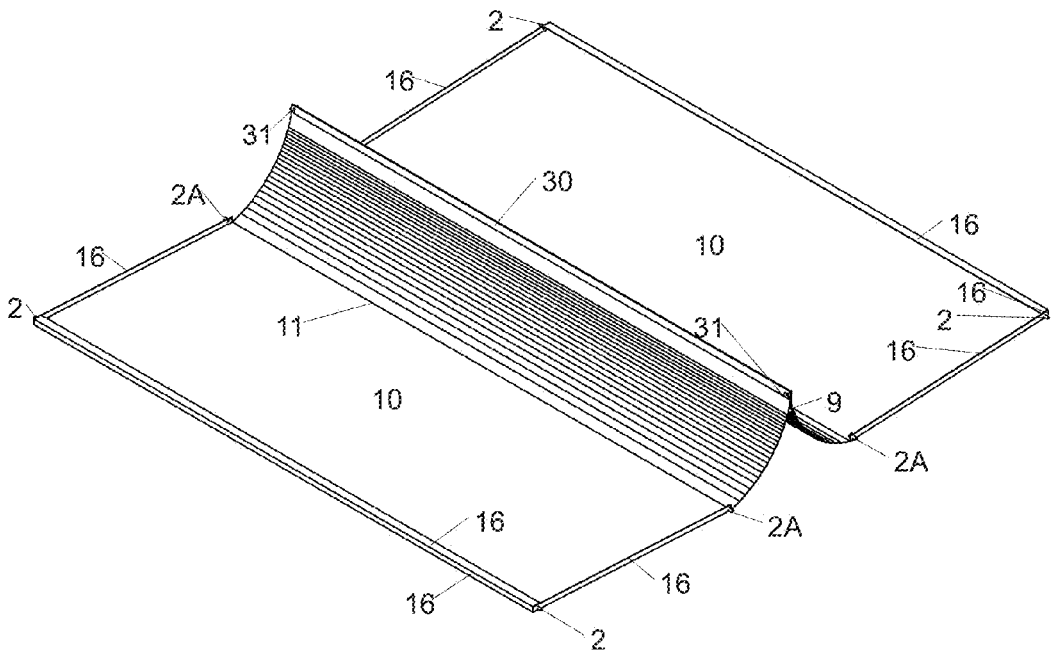
FIG. 3A depicts a bottom perspective view of an example embodiment of optical film light modifying element.
Figure 3B:
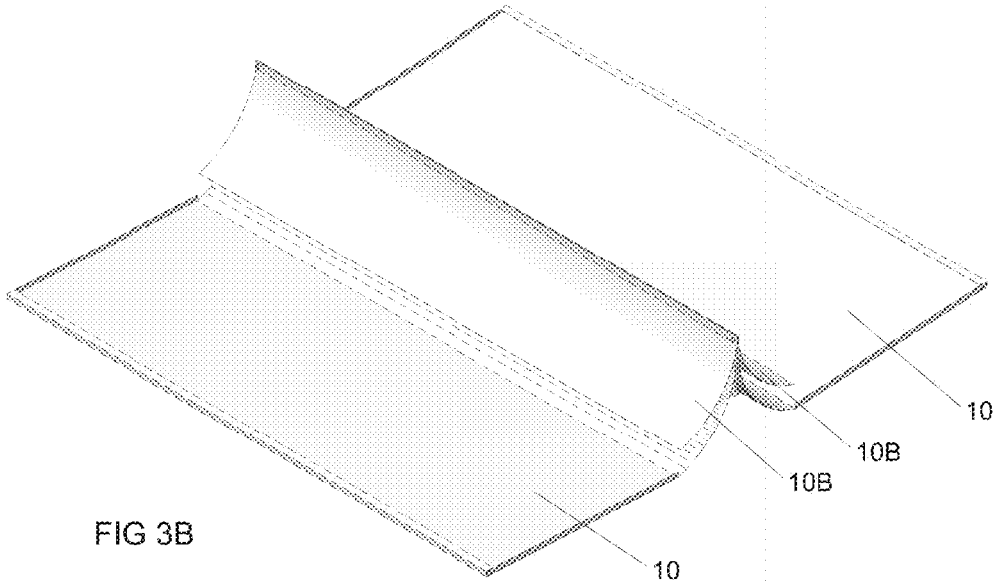
FIG. 3B depicts an exploded bottom perspective view of an example embodiment of optical film light modifying element with optical film overlays.

FIGS. 2 and 3B depicts an example implementation of the technology characterized by an optical film LME.

Referring to FIG. 3A, in certain example implementations, the LME 10 may comprise two separate pieces of optical film, or may comprise only one piece. The determination of that configuration may be based on which configuration may achieve the lowest manufacturing cost, ease of manufacture, ease of installation etc. The optical film may comprise any type of optical film that may be suitable for an intended application, and may include any types of optical film as described in the related applications, which may include diffusion films, diffusion films with light condensing properties, prismatic films, holographic films, films with micro-structured surfaces etc. According to an example implementation of the disclosed technology, the LME 10 may be configured with score lines wherein the film may be folded along score lines, creating edge trusses 16. In certain example embodiments, folds may be created along the same lines without scoring provided the means of folding can produce acceptably suitable folds. FIG. 4A depicts an example optical film cutting and scoring template for an example embodiment shown FIG. 2 and FIG. 3A. This example cutting template for the LME 10 includes fold or score lines 20, along which the optical film may be subsequently folded, refraction element score lines 11, and mounting holes 7. In accordance with an example implementation of the disclosed technology, a piece of optical film may be cut utilizing this template by methods previously described, and then folded in such a manner wherein edge trusses 16 are configured. Section 30 indicates the LME mounting section with holes 7A which may subsequently receive a fastener.

In an example embodiment as shown in FIG. 3A, an LME 10 may be configured from two pieces of optical film as described. Each LME section 10 may comprise a planar section with edge trusses 16 on each edge, and a curved section without edge trusses. The sections with edge trusses may be disposed in a substantially planar configuration after installation, while the sections without edge trusses may form a curve when compressed and mounted in an example embodiment of light fixture.

When the example embodiment of LME is folded and configured similarly to that shown in FIG. 3A, plastic push in rivets or any other suitable fastener may be installed in the mounting holes, as shown by rivets 2 and 2A. Fasteners 2A may not be required, depending on the light fixture configuration. The position and configuration of mounting features can be altered to suit the application. Alternatively, tabs may be configured in the edge trusses 16 as described in a previous related application, which may nest in slots, holes or fold etc. in the light fixture enclosure. No fasteners except for the those on the LME mounting section 30 may be required on certain example embodiments of light fixture, for example, the fixture shown in FIG. 1E that may comprise enclosure flanges 1B.

Each mounting section 30 of each LME 10 may be placed together along with an optional center trim piece 9 as previously described, and a suitable fastener such as nut and bolt set 31 may be installed through holes 7A configured in the LME mounting sections (also shown by holes 7A on FIG. 4). Referring to FIG. 2, the attached LME mounting sections 30 may be inserted in the space between the reflector panel flanges 4B, and each nut and bolt set may be inserted into mounting slots 8 (only one mounting slot 8 is visible in FIG. 8). When tightened, the nut and bolt sets 31 may function to attach the LME sections 10 to the reflector panels 4, and to squeeze the reflector panels together, securely sandwiching the length of the LME sections between the reflector panels 4.

Alternatively, a pin arrangement may be utilized as a fastener, wherein the pins may snap into reciprocal female mounting slots on the LED array mounting features, thereby allowing the LME assembly to be easily attached and removed from the light fixture. Example embodiments of optical film LMEs may also attach to example embodiments of light fixture by any other method previous described, such as those described for LMEs comprising clear or translucent, rigid or semi-rigid substrates.

Referring to FIG. 2, once the LME mounting section 30 are installed as described, rivets 2A in edge trusses 16 may be inserted into corresponding holes in the light fixture enclosure 1. With the LME sections 10 now fastened at two attachment points, the LME sections without edge trusses may now be disposed in a curved configuration as shown. The remaining two rivets 2 on each LME section 10 (or tabs as described) may be inserted into mounting holes 7 on the fixture enclosure 1. The installed LME assembly 10 may look similar to that shown in FIG. 1A.

Refraction elements 11 may be configured onto the optical film, as shown in FIG. 2, FIG. 3A, and FIG. 4A. The refraction elements may be scored, pressed, stamped, etched or created by any suitable means which enable an acceptable visual appearance. The refraction elements may be configured on either surface of the optical film piece(s), although it may be visually preferable to configure them onto the back unstructured side of an optical film. Referring to FIG. 2, the refraction elements 11 may function to help blend and obscure the presence of the LED arrays 3, increase the perceived depth of the LME, and may create a more visually appealing look. The space between individual refraction elements 11 may be increased as the distance from the axis of symmetry of each LME section 10 increases. Since the brightness on the LMEs 10 surfaces may be higher nearest the LED arrays 3, and decrease as the distance from the LED arrays increases, the progressively increasing space between the refraction elements 11 may function to aid in visually masking this higher brightness in a visually appealing way. The refraction features may be oriented parallel to the LED arrays 3, wherein direct light from the LED arrays may strike the sides of the refraction features, which may create a more pronounced effect.

Referring to FIG. 2, optional prismatic film strips 13 may be installed as previously described.

In an example embodiment as disclosed, no doorframe may be required to support the LME, which may offer significant manufacturing cost savings. There may be many possible methods of attachment of example embodiments of the disclosed technology to any given light fixture, as well as LME dimensions and configurations that may vary depending on the light fixture configuration, the intended application etc. Although a particular method of attachment and general LME size and edge truss configuration has been described with respect to a particular light fixture, this should not in any way limit the general scope of example embodiments.

Example embodiments of optical film LMEs may be attached to light fixtures with magnets, hook and loop fasteners, adhesives, clips, extrusions, springs, or any other method which may be suitable for the application. Protuberances such as rivets, clips etc. may be installed on edge trusses of example embodiments wherein the protuberances may attach to corresponding areas of a light fixture, securing an example embodiment to a light fixture. Example embodiments of LMEs may also mount in a light fixture doorframe without any fasteners. Example embodiments of optical film LMEs may nest in channels formed into a light fixture enclosure. In example embodiments of optical film LMEs, once the LMEs are attached to the LED mounting flanges, the LMEs may subsequently be laterally compressed, and the LME edges may be inserted under two enclosure lip flanges 1B as shown in FIG. 1E, wherein the LMEs attachment to the LED mounting flanges 4B, the enclosure lip flanges 1B, and the side edges of the enclosure 1 may function to retain the LMEs 10 in a compressed state.

In example implementations, the LME(s) may be comprised of diffusion film with light condensing properties as previously described in related applications, or comprised of any kind of light condensing film. Generally, light condensing optical film may direct a portion of light refracting through it more towards the direction of the normal of its surface. Because of this, a greater portion of refracted light may be directed outwards towards the direction of the surface normals than would have otherwise if the LME were comprised of non-light condensing optical film. Accordingly, in the example embodiment of LME as shown in FIG. 1A for example, on the curved sections of LME 10, less light may be directed in a forward direction (perpendicular to the plane of the light fixture aperture) than would be if the example embodiment of LME did not have light condensing properties, which may function to lower the overall brightness of the problem area. The flat sections of the LME 10 may also direct a portion of light refracting through it more towards the direction of the normal of its surface, which may function to narrow the width of the light distribution of the light fixture.

Figure 3C:
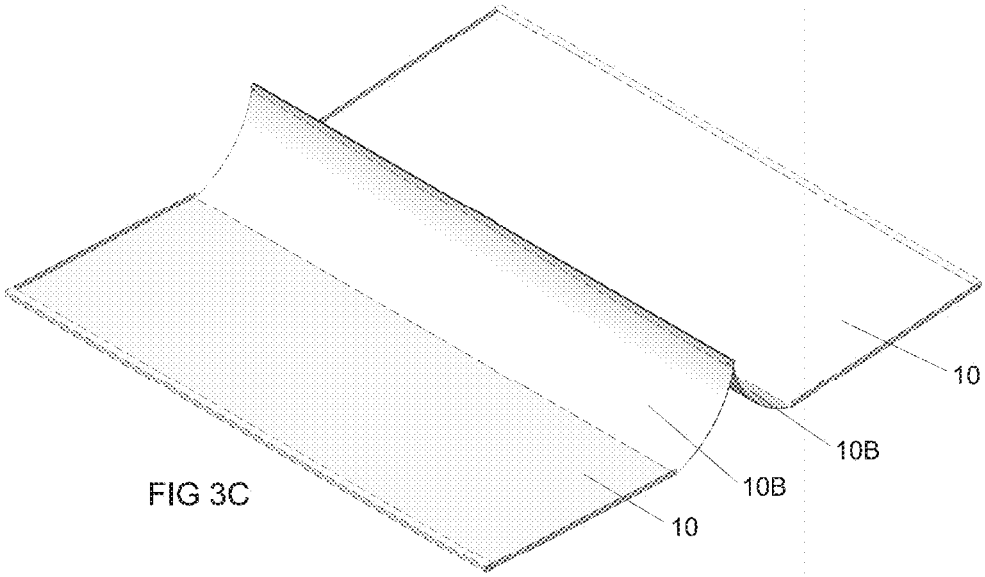
FIG. 3C depicts a bottom perspective view of an example embodiment of optical film light modifying element with optical film overlays.

Referring to FIGS. 3B and 3C, in an example embodiment of LME, an additional layer of optical film 10B may nest beneath the LMEs 10. FIG. 3B depicts an upside down exploded perspective view, and FIG. 3C depicts a non-exploded view. Additional optical film layer 10B may nest beneath the curved sections of the LMEs 10, and the additional optical film layers 10B may be configured and fastened in a similar way as the LMEs 10. The addition film layers may function to add greater diffusion and lamp hiding in the problem area, and may also function to create greater visual definition and appeal to the curved sections of the LME.

The example implementation as shown in FIG. 1A depicts the planar surfaces of the LME 10 sloping away from the fixture's aperture plane as the distance towards the left and right edges of the light fixture enclosure 1 increases. However, whether comprised of optical film or a clear or a substrate as described, example implementations may also be configured with horizontal, non-sloping planar sections as shown in FIG. 1F.

Figure 4C:
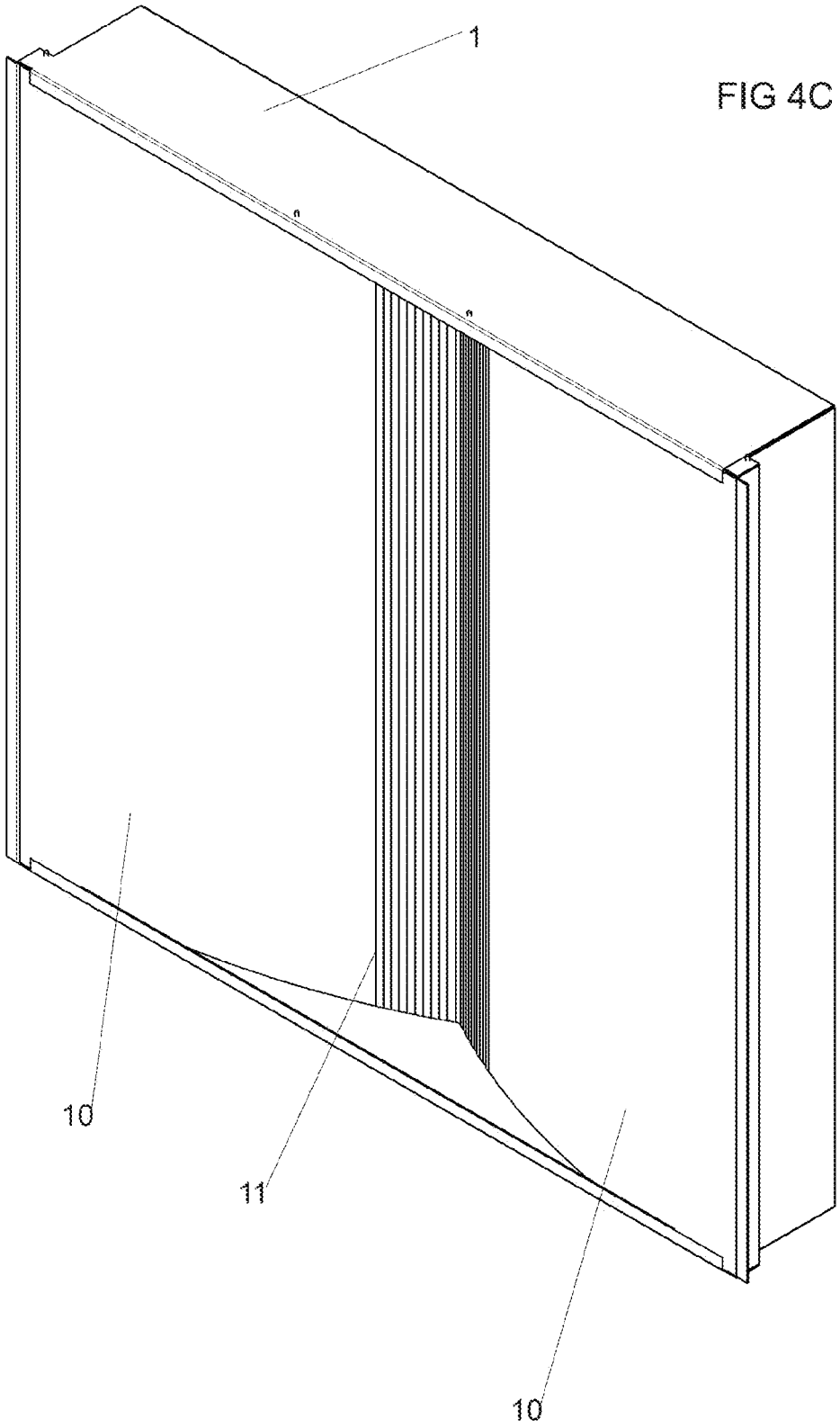
FIG. 4C depicts a perspective view of an example embodiment of light fixture with a curved light modifying element.

Example embodiments of LME and example embodiments of light fixtures with LMEs that comprise a curved section and a planar section as described may also comprise LMEs that have much larger curved section and smaller or non-existent planar sections as shown in FIG. 4C. LME sections 10 with linear refraction features 11 form a long arcing profile with a minimal planar section where the LME sections contact the flange on light fixture enclosure 1.

Figure 5A:
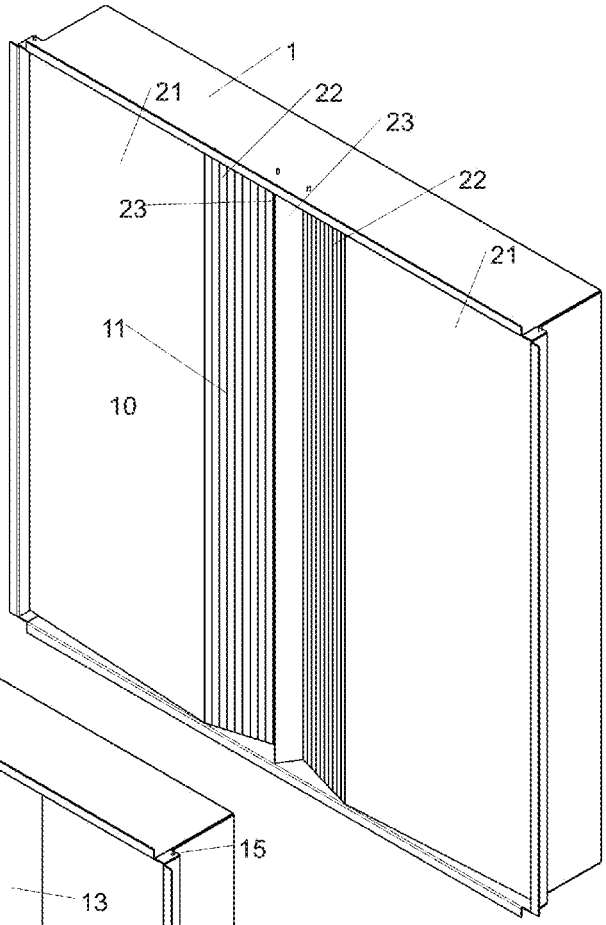
FIG. 5A depicts a perspective view of an example embodiment of light fixture and multi-plane light modifying element.
Figure 5B:
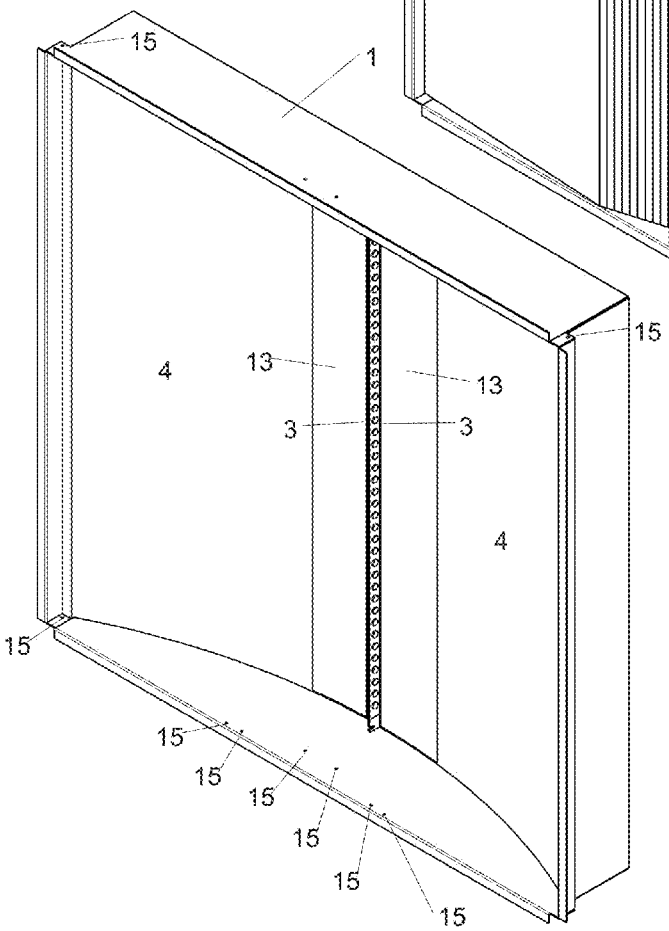
FIG. 5B depicts a perspective view of the example embodiment of light fixture and light modifying element depicted in FIG. 5A but with the light modifying element removed.

FIG. 5A depicts a perspective view of an example implementation of the disclosed technology of light fixture and multi-plane light modifying element, and FIG. 5B depicts the same view, but with the LME 10 removed. In an example implementation, the advantages of good lamp hiding, wide and even light distribution, along with excellent luminaire efficiency may be realized utilizing only two LED arrays 3 as an illumination source. Although higher diffusion material may be utilized with good results, for illustrative purposes in the following descriptions of example embodiments, it will be assumed that a major design goal will be to maximize luminaire efficiency. Accordingly, it may be preferable to utilize a diffusion material with lower diffusion properties and higher light transmission levels, combined with light condensing properties. The following descriptions of example embodiments may be assumed to be utilizing diffusion material with low diffusion properties and high light transmission levels combined with some light condensing properties.

In an example implementation, the light fixture without the LME attached as shown in FIG. 5B may be similar or identical to the light fixture as shown and described in FIG. 1B, and may include the light fixture enclosure 1, reflector panels 4, LED arrays 3, optional prism film strips 13, and lens mounting holes 15, and will not be described again for brevity. Any example embodiments of reflectors or LED array mounting features previously described may be utilized.

Referring to FIG. 5A, LME 10 may comprise a single structure. The LME 10 may comprise a clear or translucent substrate configured to modify light from a linear LED array. The LME 10 may include lens planes 21, 22 and 23 as indicated. The substrate may include any type of substrate that may provide suitable structure and optical properties for the intended application. Examples of suitable substrates may include polycarbonates, acrylics, optical film etc. The substrate may have associated with it any type of light modifying features that may be suitable for an intended application. In one example implementation, the substrate may have a light modifying layer deposited on either or both surfaces. For example, in one embodiment, the light modifying layer(s) may include diffusion particles such as glass beads. In other example implementations, the substrate may have light modifying elements incorporated within the substrate itself, such as diffusion particles for example. In certain example implementations, the substrate may have features formed onto its outer surface, such as prismatic features. In accordance with various example implementations of the disclosed technology, the substrate may have various combinations of light modifying features, for example, particles incorporated into the substrate itself and a light modifying layer deposited on one or more surfaces. In an example embodiment, the LME may be fabricated by any suitable method, such as injection molding, vacuum forming or extrusion methods for example.

Figure 8:
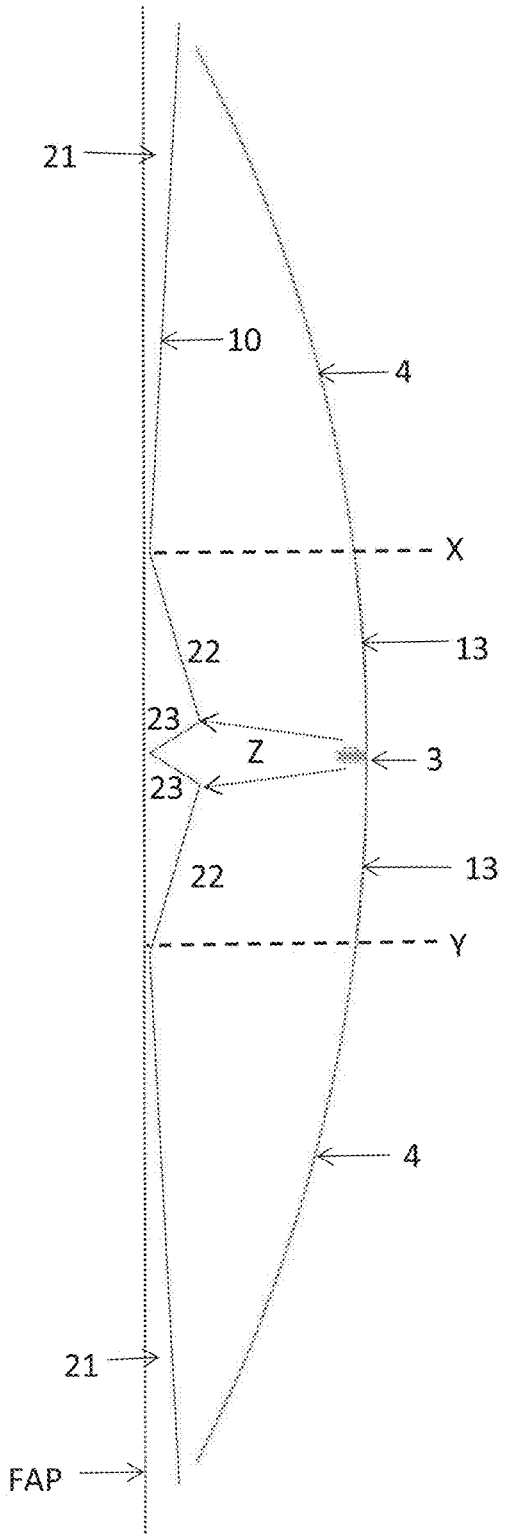
FIG. 8 depicts a diagram of light propagation within the example embodiment of light fixture and light modifying element depicted in FIGS. 5A and 5B.

FIG. 8 depicts a simplified side cross section view of an example embodiment of light fixture and multi-plane LME 10 similar to that shown in FIG. 5A, and may include reflector panels 4, optional prismatic film strips 13, and LED arrays 3. Certain functional aspects of the LME may be similar to that as described in FIG. 4B, and may not be repeated for brevity. The LME may include lens planes 21, 22 and 23.

At lamp to lens depths of 3" to 3½" as may be typical of commercially available troffer light fixtures, if a flat diffusion lens utilizing the same low diffusion material were used, high pixelization may occur in the vicinity of the LEDs from various viewing angles, the problem area between the lines X and Y may be objectionably bright, and the dead zone directly above the two LED arrays may be visibly objectionable.

The light reflection, refraction and TIR principles of diffusion materials previously described, along with the optical properties of bi planar lenses described in a related application may be utilized to help correct the problems as described. Again referring to FIG. 8, zone Z between the two arrows may indicate the area on the lens that may include a shadow caused by the dead zone (the area between the two back to back LED arrays 3), as well as a high brightness area from direct light from the LED arrays 3. Lens planes 23 may form a bi-planar lens across zone Z, which may create a discrete visual partition of a homogenous blend of the dead zone shadow along with the immediately adjacent high brightness. This may function to almost completely mask the appearance of the dead zone and create a pleasing visual aesthetic. The apex of lens planes 23 may preferably be disposed at the greatest distance from LED arrays 3 as the light fixture will allow, as increased distance may increase the effect as described.

Lens planes 22 may form an inverted bi-planar lens. With the appropriate diffusion material with light condensing properties, and the appropriate angles of lens planes 22 relative to the light fixture aperture plane as indicated by the dotted line FAP, pixelization may be eliminated, and the light intensity in the problem area between lines X and Y may be significantly reduced. The chosen angles of lens planes 22 may need consideration however. As their angles relative to the line FAP are increased, forward brightness may be decreased. However, assuming the intersection points between lens planes 21 and 22 remain fixed, the distance of lens planes 22 to the LED arrays 3 may be simultaneously decreased. Pixelization may be evident if the angles of lens planes 22 are increased too much. Accordingly, a harmonious balance may need to be obtained, perhaps through trial and error. Lens planes 22 may function to create a discrete visual partition of homogenous brightness, which may be visually appealing. In summary, lens planes 22 and 23 may function to turn the disadvantages of the problem area and the dead zone as described into visually striking LME features. In other words, turning that frown upside down ☺.

Prism film strips 13 may be optionally utilized to lower brightness in the problem area as previously described. However, due to low diffusion materials utilized in the LME, unwanted specular reflections on the reflector panels 4 may occur. The size and placement of the prism film strips may need to be modified if said reflections occur, or the prism strips may need to be eliminated altogether.

Angled lens planes 21 may function as previously described, and may have sufficient distance from the LED arrays 3 to achieve acceptably even illumination and no pixelization. In alternate example embodiments, the lens planes 21 may be substantially parallel to line FAP. Luminaire efficiency may decrease somewhat compared to angled lens planes 21 as described.

Another feature of an example embodiment is shown in FIG. 5A. The lens planes 22 of LME 10 include linear refraction features 11. The refraction features 11 may function to blend and obscure the presence of the LED arrays 3 in the problem area, which may create a more visually appealing look. The space between individual refraction elements 11 may be increased as the distance from the lens planes 23 increases. Since the brightness on the LME 10 surface may be higher nearest the lens planes 23, and decrease as the distance from the lens planes 23 increases, the progressively increasing space between the refraction features 11 may function to aid in visually masking this higher brightness, and may function to give more visual depth to lens planes 22. The refraction features 11 may be formed utilizing any methods previously described. For example, the refraction elements 11 may be configured into the LME 10 during manufacturing, and may be formed as linear protuberances or groves in either side of the substrate, lines etched into either side of the substrate, or formed by any other method that may achieve acceptable visual results. The refraction features 11 may be oriented parallel to the LED arrays 3, wherein direct light from the LED arrays may strike the sides of the refraction features, which may create a more pronounced effect.

Figure 7A:
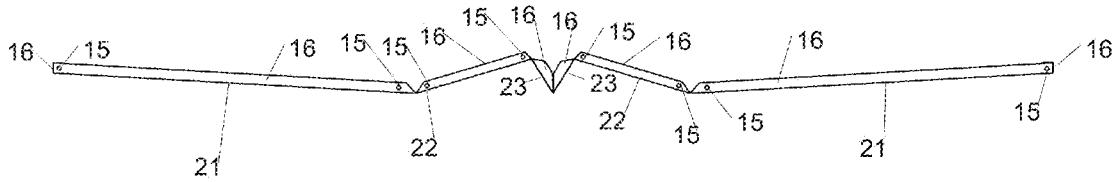
FIG. 7A depicts a side profile view of an example embodiment of optical film light modifying element.
Figure 7B:
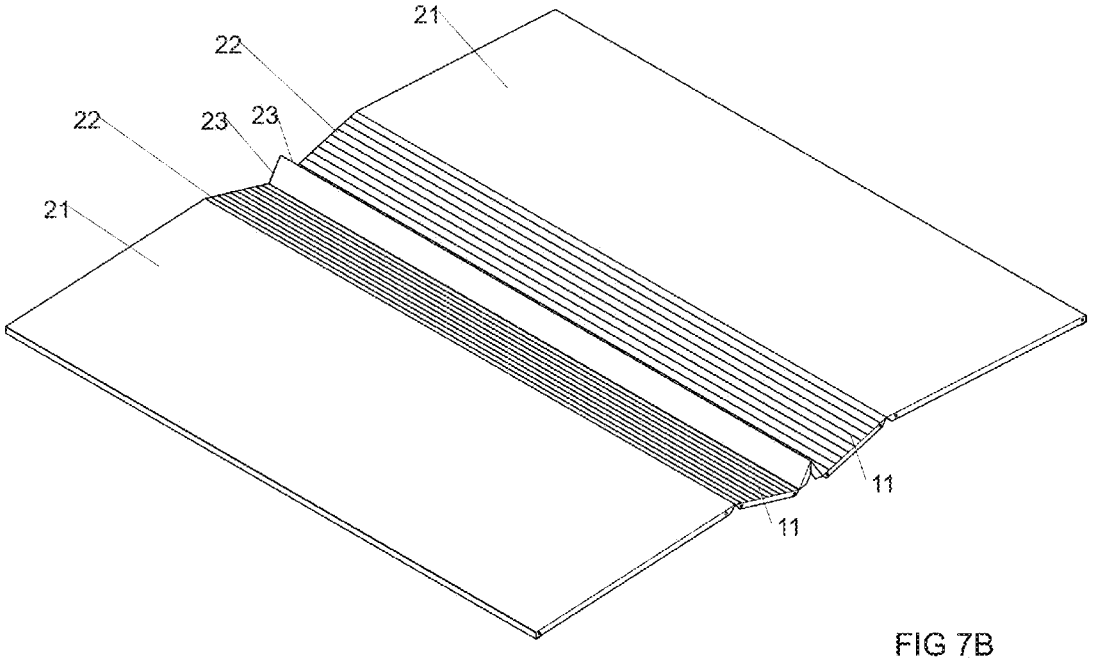
FIG. 7B depicts a top perspective view of the example embodiment of the optical film light modifying element depicted in FIG. 7A.
Figure 9:
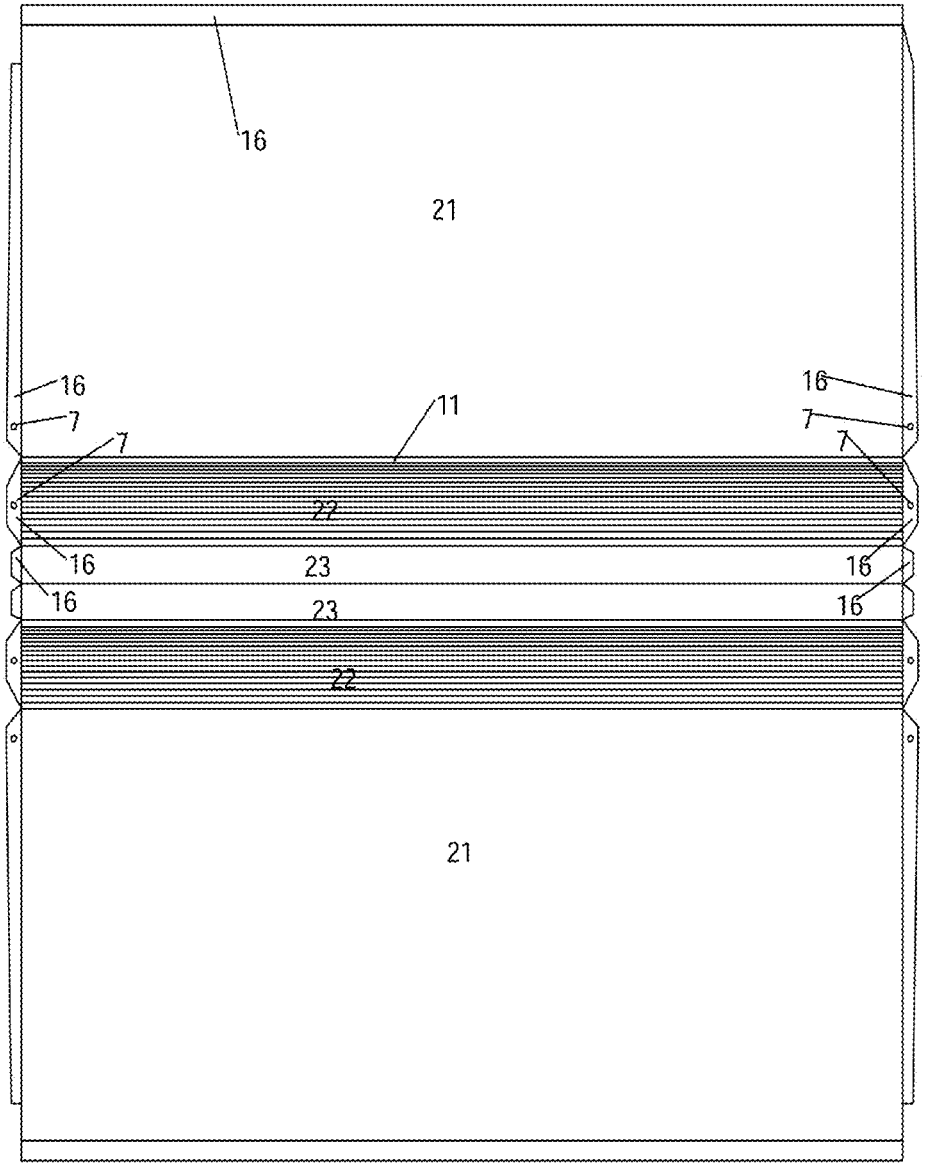
FIG. 9 depicts an optical film cutting and scoring template for the example embodiment of light modifying element depicted in FIG. 7B.

Referring to FIG. 7A and FIG. 7B, in certain example implementations, the LME may comprise a single piece of optical film. The optical film may comprise any type of optical film as previously described. According to an example implementation of the disclosed technology, the LME may be configured as previously described with score lines wherein the film may be folded along score lines, creating edge trusses 16. FIG. 9 may depict an example optical film cutting and scoring template for an example embodiment shown in FIGS. 7A and 7B, and may include lens planes 21, 22 and 23. This example cutting template may include fold or score lines, along which the optical film may be subsequently folded. In accordance with an example implementation of the disclosed technology, a piece of optical film may be cut utilizing this template by methods previously described, and then folded in such a manner wherein the edge trusses 16 are configured. The LME cutting template may be configured with mounting holes 7, edge truss sections 16, and linear refraction elements 11.

Figure 6:
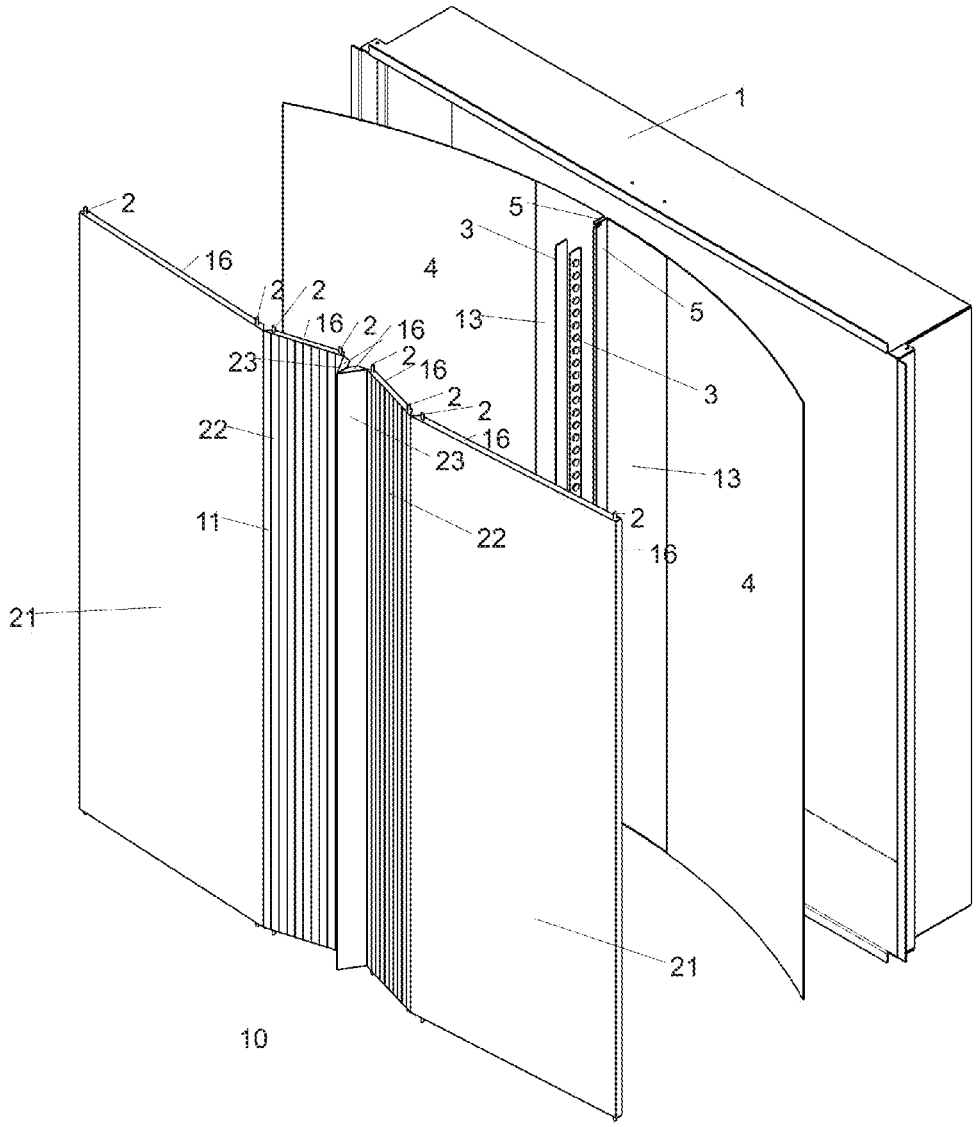
FIG. 6 depicts a perspective exploded view of an example embodiment of the light fixture and optical film light modifying element depicted in FIGS. 5A and 5B.

Similar to previous example embodiments of optical film LMEs, linear refraction features 11 as shown in FIG. 6, FIG. 7B, and FIG. 9 may be configured onto the optical film.

Referring to FIG. 7A that depicts a side profile view, and FIG. 7B that depicts a top perspective view of an example embodiment of optical film multi-plane LME, mounting holes 15 may be configured in the edge trusses 16, wherein plastic push in rivets or any other suitable fastener may be installed therein. Lens planes 21, 22 and 23 are indicated.

In an example implementation, the light fixture without the LME attached as shown in FIG. 6 may be similar or identical to the light fixture as shown and described in FIG. 1B and FIG. 5B, and may include the light fixture enclosure 1, reflector panels 4, LED arrays 3, and optional prism film strips 13, and will not be described again for brevity. Any example embodiments of reflectors or LED array mounting features previously described may be utilized.

Referring to FIG. 6, and once the plastic rivets 2 or other fasteners as described have been installed in the LME 10, rivets 2 may be inserted into corresponding holes in the light fixture as shown by holes 15 in FIG. 5B. The installed LME assembly 10 may look similar to that shown in FIG. 5A.

In an example embodiment as disclosed, no doorframe may be required to support the LME, which may offer significant manufacturing cost savings. There may be many possible methods of attachment of example embodiments of the disclosed technology to any given light fixture, as well as LME dimensions and configurations which may vary depending on the light fixture configuration, the intended application etc. Although a particular method of attachment and general LME size and edge truss configuration has been described with respect to a particular light fixture, this should not in any way limit the general scope of example embodiments. For example, example embodiments of LME may be attached to doorframes. Example embodiments of LME may nest in a doorframe. Example embodiments of LME may nest in a channels formed into a light fixture enclosure.

Example embodiments of the disclosed technology may be attached to light fixtures or light fixture doorframes with magnets, hook and loop fasteners, adhesives, clips, extrusions, springs, or any other method that may be suitable for the application. Protuberances such as rivets, clips etc. may be installed on edge trusses of example embodiments wherein the protuberances may attach to corresponding areas of a light fixture, securing an example embodiment to a light fixture. Example embodiments of lenses may also mount in a light fixture doorframe without any fasteners.

Referring to FIG. 7A, in an example embodiment of LME, edge trusses 16 may be eliminated on lens planes 22. Lens planes 22 may subsequently form a curve when the LME is installed, which may also be visually pleasing.

Certain example embodiments of lenses described in this patent application may have been described being associated with, or utilized in conjunction with certain example embodiments of light fixture. This should not however, limit the scope of possible applications that example embodiments of lenses may be used in. Example embodiments of lenses described herein may be utilized with any suitable configuration of light fixture or light emitting device.

When linear LED arrays are used as a light source for a light fixture such as a troffer as previously described, and the LED arrays are mounted on the back surface of the fixture facing the lens, the pinpoint high intensity light from the LEDs may create a significant problem with respect to having excessively bright strips in the vicinity of the LED arrays, and uneven or visually unpleasing light distribution within the light fixture and across the lens. Typically in such a configuration that may utilize a high diffusion flat lens, although pixilation may be eliminated, the lens may still exhibit a bright, relatively thin strip above where the LED arrays are located, and relatively uneven light distribution within the fixture and across the lens. This may create visually unpleasing shadows, especially when viewed from off-axis. This may create an unimpressive and cheap visual impression to viewers. Some or all of these problems may be addressed by example embodiments that may herein be described.

Figures 12A, 12B:
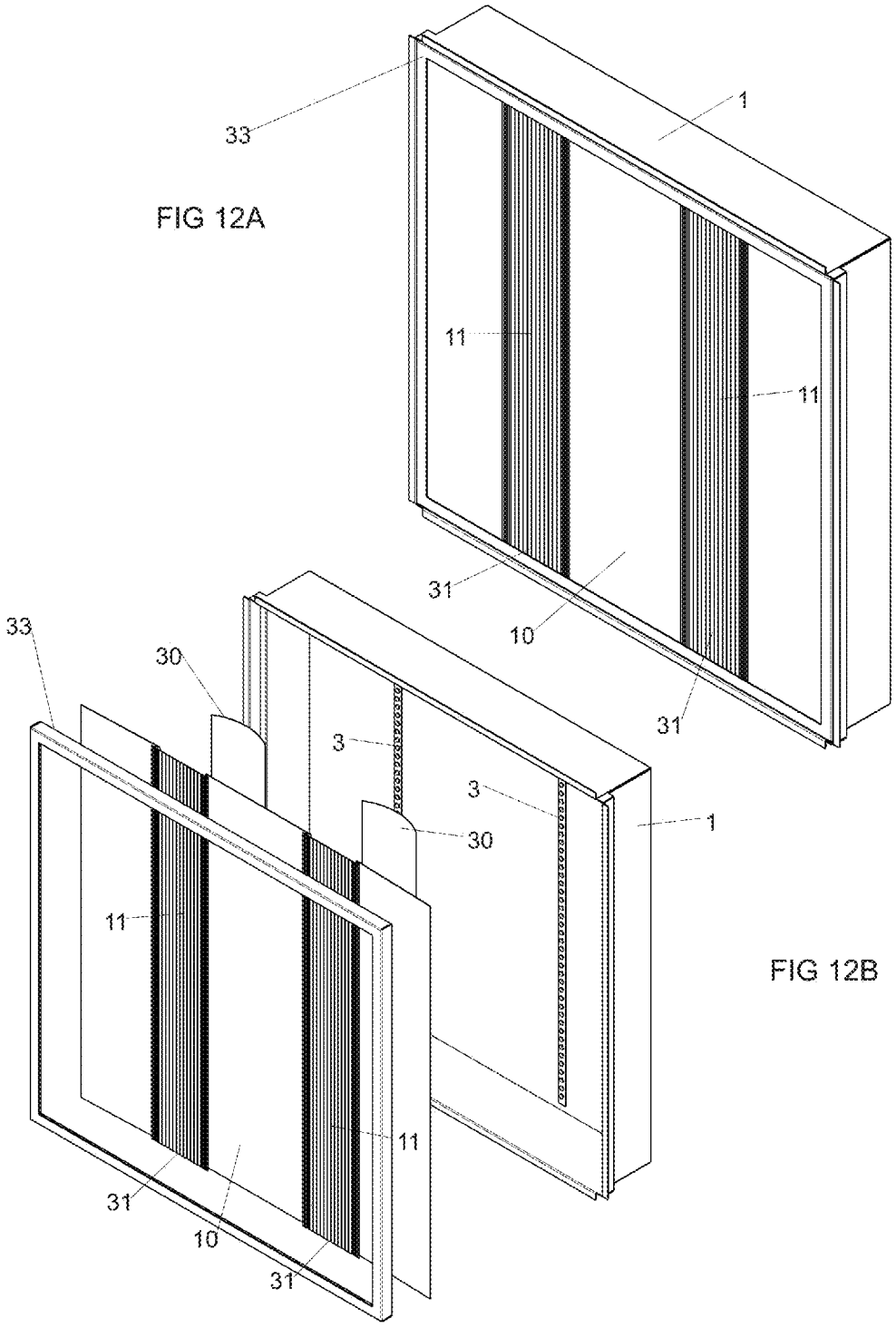
FIG. 12A shows a perspective view of an example embodiment of light fixture with multi-plane light modifying element and optical film inserts.
FIG. 12B shows an exploded perspective view of the example embodiment of light fixture with multi-plane light modifying element and optical film inserts as shown in FIG. 12A.

An example embodiment of multi-plane LME with optical film inserts may be shown in FIGS. 12A and 12B. The LME 10 may be mounted inside a doorframe 33, wherein the doorframe may be mounted on a light fixture enclosure 1, with two linear LED arrays 3 mounted on the inside back surface of the enclosure 1. The LME 10 may comprise a clear or translucent substrate configured to modify light from the LED arrays 3. The substrate may include any type of substrate as described in previous example embodiments, and may be fabricated by methods previously described.

In an example embodiment, the LME 10 may include two raised sections 31, wherein the raised sections 31 may each be substantially centered over LED arrays 3. Referring to FIG. 13B that depicts a side profile view of an example embodiment, the LME 10 may have two raised sections 31 with sides 30B which may form an acute angle relative to the plane defined by the surface of the raised section 31, which may create slots 34. Flat strips of optical film 30 may be configured of an appropriate dimension greater than the width of the raised sections 31 such that when the two opposing major edges are squeezed together and inserted into opposing slots 34, the optical film strips 30 may form a curved shape as shown. The structured surface of the optical film insert 35 is shown facing the LME raised sections 31. The optical film strips 30 may comprise any optical film which may have suitable optical characteristics for an intended application. Two examples may now be described.

The optical filmstrips 30 may comprise prismatic optical film. The structured surface of the prismatic film may preferably be oriented with its structured surface 35 (FIG. 13B) facing the LME raised sections 31. Light reflecting and refracting properties of prismatic film are well understood to those skilled in the art, and will not be further discussed herein. When light from a light source such as LED arrays 3 in FIG. 12B is incident on the back surface of prismatic strips 30, up to 50% or more light may be reflected backwards "recycled". Due to the curved shape of the prismatic strips 30, light may be recycled in a direction backwards, and laterally outwards relative to the surface plane of the raised section. The degree of lateral spread may be increased by configuring the prismatic strips 30 with the prism row features oriented perpendicular to the major axis of the LED arrays 3. The prism row features may be oriented parallel to the major axis of the LED arrays 3 as well; however, the degree of lateral light spreading may be decreased.

When an example embodiment is configured as shown in FIG. 12A and FIG. 12B with prismatic strips 30, light from the LED arrays may be more evenly distributed within the fixture and across the lens as described. Additionally, light refracting through the prismatic strips 30, may be create a relatively even illumination on the LME raised sections 31, and may create a "picture box" effect. The zone of higher brightness from the LED arrays 3 may be relatively confined to the discrete area of the LME raised sections 31, and the rest of the LME 10 surface may comprise a discrete area of relatively even but lower brightness. In an example embodiment as shown, the raised LME sections may be approximately 3"-4" wide for example, which may give the appearance of 3"-4" wide light sources. Due to the light condensing properties of the prismatic strips 30, the viewing angle of light refracting through the prismatic strips 30 and raised sections 31 may be condensed. When viewed steeply off axis, the raised sections 31 may appear darker than the rest of the lens surface, which may create an "inverse" picture box effect. The overall appearance of the LME may be quite visually soft and pleasing.

The degree of curvature of an optical film strip may be adjusted to optimize light reflection and refraction distribution to suit a given light fixture configuration. Generally, a relatively shallow curve as shown in FIG. 13B may be advantageous. In an example embodiment, the optical film strips may be configured to the same approximate dimensions as the distance between two opposing slots 34 (FIG. 13B), wherein the optical film strip 30 may be disposed in a planar configuration. Although there may be less light distribution within the light fixture, it may nevertheless have a pleasing visual appeal.

In example embodiment as shown in FIG. 12A, FIGS. 12B, 13A, and 13B another example of optical film inserts may be diffusion film. Diffusion film of any kind may be utilized with the structured surface 35 facing the raised sections 31 as shown in FIG. 13B. Diffusion film with light condensing properties may achieve very good optical results, but due to the lesser degree of light recycling than prismatic film, the light may be distributed within the fixture and across the LME 10 to a lesser degree. However, luminaire efficiency may also increase as a result if relatively low diffusion film is utilized. The picture box effect may still be very good.

In an example embodiment, an important visual element may be refraction elements 11 as shown in FIGS. 12A, 12B and 13A. They may be created in a similar manner to those previously described. Referring to FIG. 13A, refraction features may be arranged in three sections on each LME raised section 31: more densely configured refraction features in sections 37, and wider spaced refraction features in section 38. Slots 34 (FIG. 13B) may create distinct shadows on the raised sections 31 caused by light from an opposing LED array striking the slot 34. As the diffusion level of an example embodiment of LME is lowered, the darker and more pronounced the shadow may become. Referring to FIG. 13A, the more densely configured refraction feature sections 37 on each side of the raised sections 31 may effectively mask any shadows as described. Refraction features in the section 38 may function to increase apparent illumination uniformity of those sections.

Figure 14A:
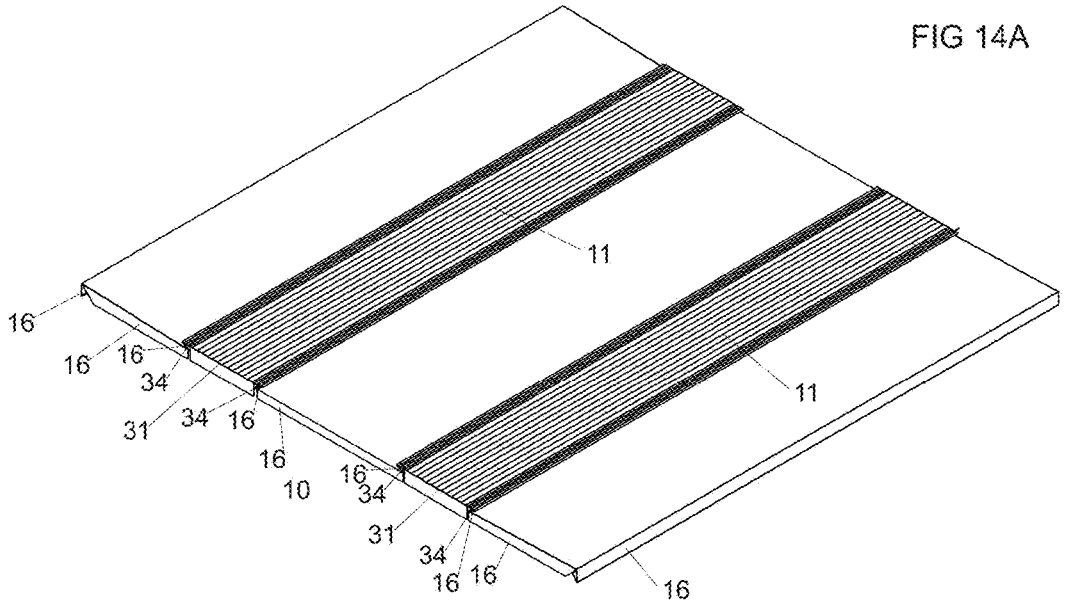
FIG. 14A shows a top perspective view of an example embodiment of optical film multi-plane light modifying element and optical film inserts.
Figure 14B:
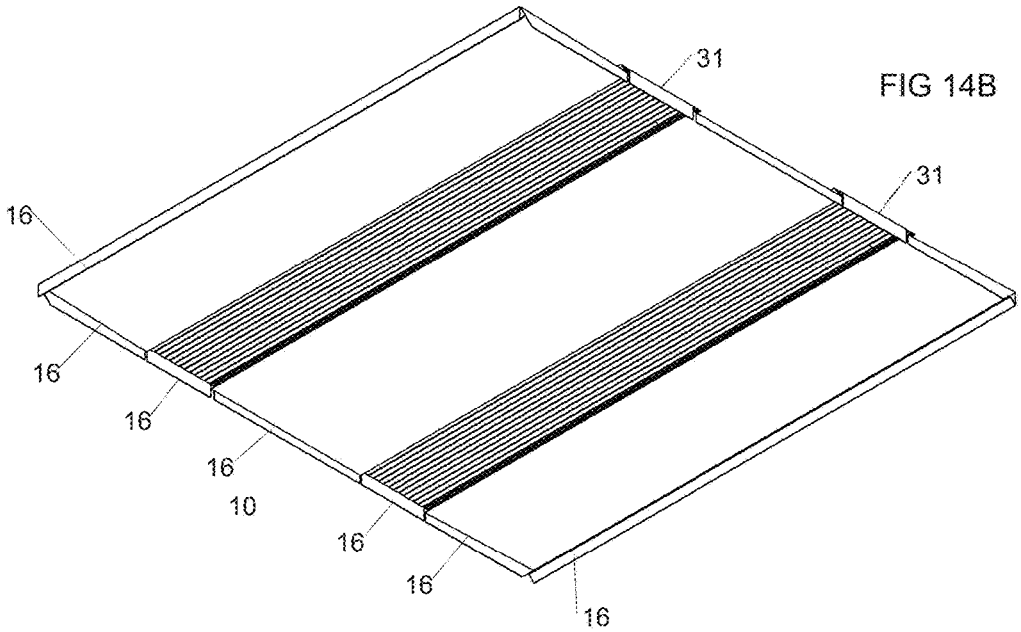
FIG. 14B shows a bottom perspective view of the example embodiment of optical film multi-plane light modifying element and optical film inserts as shown in FIG. 14A, but without the optical film inserts installed.
Figure 15:
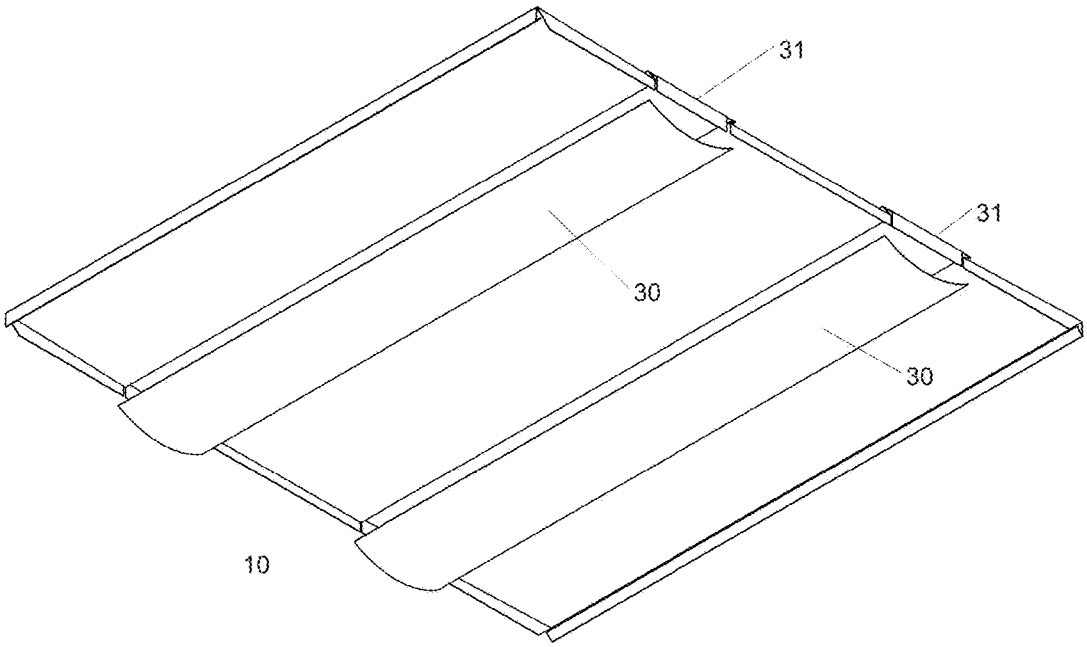
FIG. 15 shows a bottom exploded perspective view of the example embodiment of optical film multi-plane light modifying element and optical film inserts as shown in FIG. 14A.

FIG. 14A show a top perspective view, and FIG. 14B show an underneath perspective view of an example embodiment of optical film multi-plane LME with optical films inserts, similar to that as shown in FIGS. 12A and 12B. The LME 10 may utilize a single piece of optical film (any type of optical film described in previous example embodiments), and may be configured in a similar manner to previously described example embodiments of optical film LMEs, the details of which may not be repeated here. Edge trusses 16, raised sections 31, refraction elements 11, and slots 34 are all indicated. FIG. 15 depicts an underneath perspective view of the same example embodiment, indicating optical film inserts 30 and raised sections 31. The LME 10 may be mounted in a doorframe of a light fixture, or may be attached to a light fixture in any other fashion as previously described. The optical film inserts 30 may be configured, installed, and function as previously described. Refraction elements 11 may be configured in a manner similar as described in the previous example embodiment shown in FIG. 13A.

Figure 16:
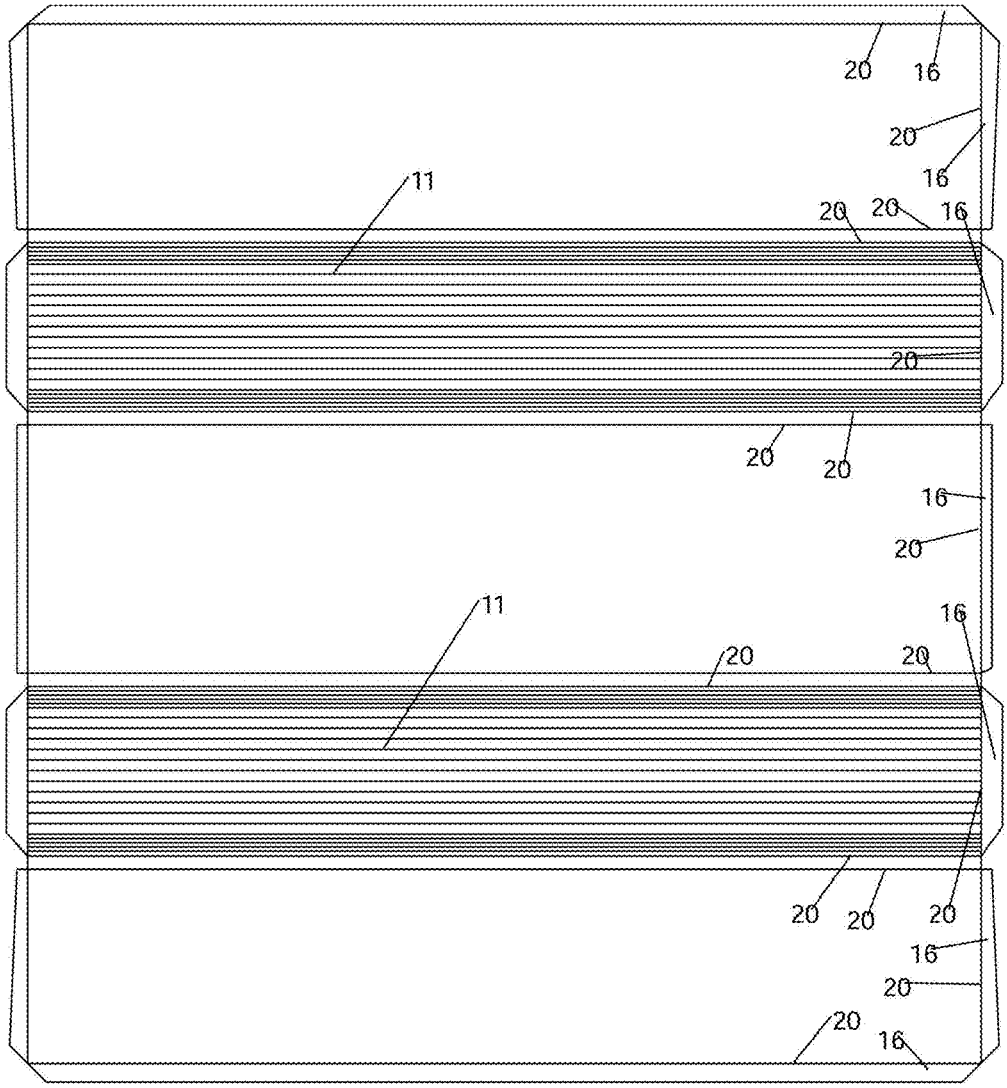
FIG. 16 shows an optical film cutting and scoring template for the example embodiment of optical film multi-plane light modifying element and optical film inserts as shown in FIG. 14A.

An optical film scoring and cutting template for the example embodiment shown in FIGS. 14A and 14B may be shown in FIG. 16, which includes linear refraction features 11, score lines 20 and edge truss sections 16.

Example embodiments of LME that include raised sections as described may also be used without an optical film strip. The degree of uniformity of illumination in the LME raised sections as well as inside the light fixture interior may be lower; however, the overall visual results may be acceptable for many applications. Luminaire efficiency may increase as a result, and manufacturing costs may be lower. A degree of the picture box effect as described may still be evident, and if linear refraction features are included, this may increase the apparent illumination uniformity of the raised sections.

Figure 17:
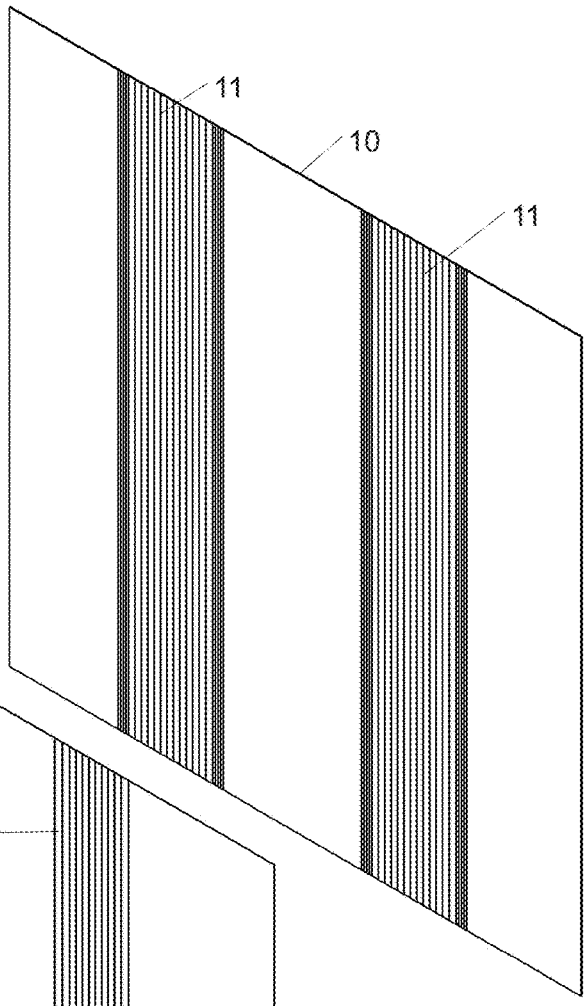
FIG. 17 shows a perspective view of an example embodiment of flat light modifying element with two groupings of linear refraction features.

An example embodiment may also comprise a flat sheet lens with no raised sections as shown in FIG. 17. LME 10 may comprise a flat sheet of optical material and may include linear refraction features 11. Example embodiments may comprise clear or translucent substrates as previously described with refraction feature configurations similar to those shown in FIG. 17, and configured on either surface as previously described. Example embodiments may also comprise flat optical film lenses as described in related PCT Patent Application PCT/US2013/039895 entitled "Frameless Light Modifying Element". An example embodiment of optical film lens may be shown in FIG. 19A. FIG. 19A depicts a perspective view of the front-light emitting side of the LME 10, and may include a refraction features 11 similar to that shown in FIG. 17 or FIG. 18, wherein the linear refraction features may be configured on either surface of the optical film by methods previously described. Four edge trusses 16 may be configured from folds in the optical film, and disposed at an angle relative to the front side of the lens and disposed on the back side of the lens, wherein the edges trusses may support the lens in a substantially planar configuration when the example embodiment of optical film lens is attached to a light fixture. In FIG. 19, only two of the four edge trusses may be visible.

Figure 18:
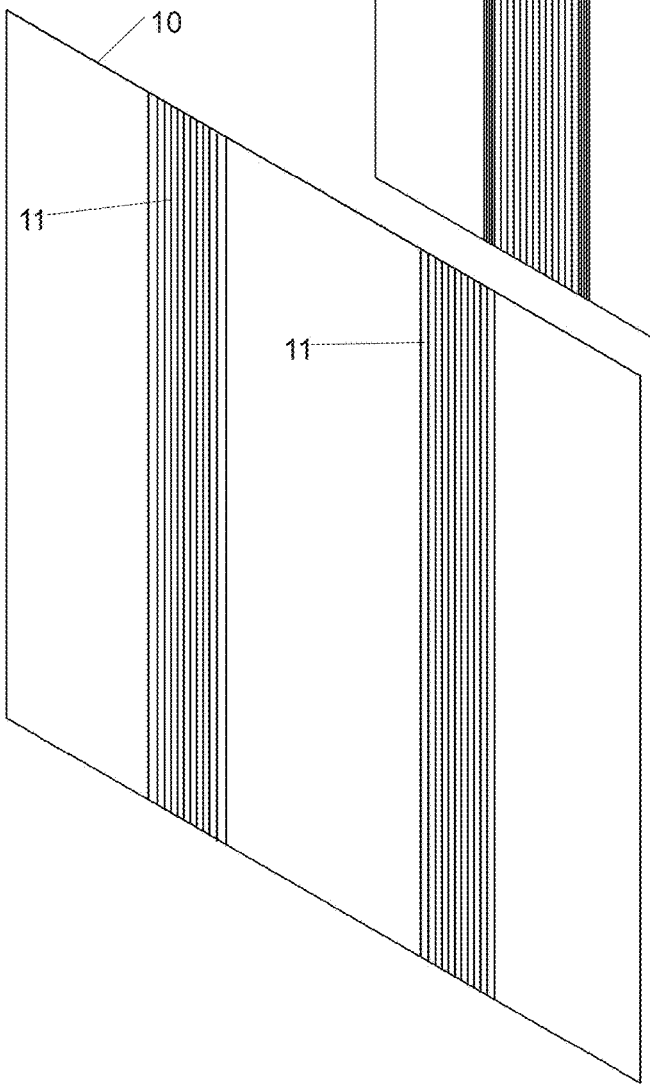
FIG. 18 shows a perspective view of another example embodiment of flat light modifying element with two groupings of linear refraction features.
Figure 19:
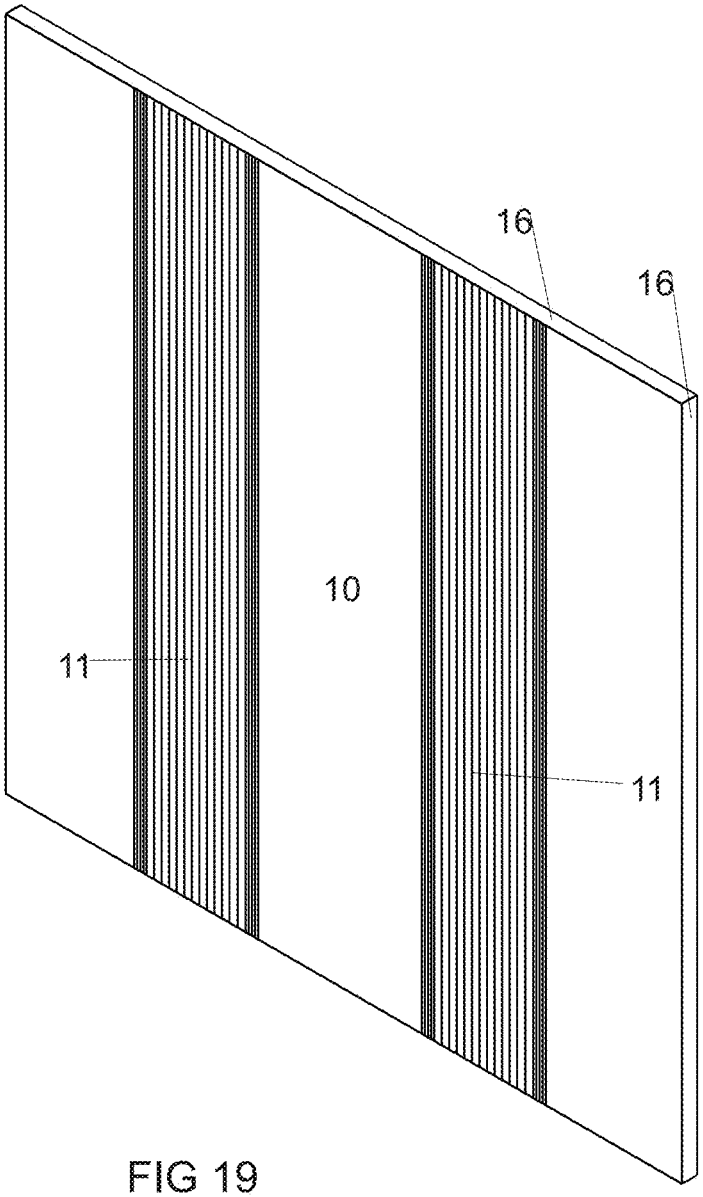
FIG. 19 shows a perspective view of an example embodiment of flat light modifying element comprising optical film that includes two groupings of linear refraction features.

In an example embodiment as shown in FIG. 18, the LME 10 may comprise refraction elements 11 that may comprise two groupings of evenly spaced refraction features 11. This alternate arrangement of refraction features may be utilized on previously described example embodiments of LME.

Refraction features in any of the example embodiments herein described may be included to increase visual and aesthetic appeal as well as create increased lamp hiding as previously described. Accordingly, inclusion or omission of refraction features or elements, or the specific pattern of any refraction features or elements may be optional or may vary, and the scope of example embodiments should not be limited in any way if refraction features or elements are omitted or modified from those described.

Example implementations have been described that may include LED arrays. However, the scope of possible light sources that may be utilized with example embodiments of the disclosed technology should not be limited in any way, and may include any light source which may be practical which includes, but is not limited to, alternate LED array configurations.

In an example embodiment, a light fixture may comprise an enclosure with four or more sides, an enclosure back surface defining a back surface plane of the enclosure, a center axis that is equidistant and parallel to two of the four or more sides, and an aperture plane defined by outermost edges of the four or more sides. Two or more linear light emitting diode (LED) arrays may be configured to mount within the enclosure, wherein each linear LED array may comprise one or more linear LED strips comprising one or more rows of LEDs. Each LED array may comprise a front light emitting side, and a backside opposite of the front light emitting side. In an example implementation, one or more LED array mounting features may be configured to dissipate heat generated from linear LED arrays, wherein each LED array mounting feature may comprising at least two front elongated planar surfaces configured for attaching to two or more linear LED arrays. In an example embodiment, the one or more LED array mounting features may be disposed parallel and in proximity to the center axis of the enclosure back surface, and each of the at least two front elongated planar surfaces of the one or more linear LED array mounting features may face two opposite sides of the enclosure, and may be oriented at an angle between about 80 degrees and about 135 degrees relative to the back surface plane of the enclosure.

In an example embodiment, each LED array mounting feature may comprise an integral curved light reflecting panel that may include a thermally conductive material with a reflecting surface configured to reflect light. The elongated planar surface may comprises a flange formed along one edge of the reflector panel configured to mount at least one linear LED array.

In an example embodiment, an LED array mounting feature may comprise an integral flat, flexible light reflecting panel that may include a thermally conductive material defining a reflecting surface configured to reflect light. The flexible flat light reflecting panel may form a curved reflecting surface when laterally compressed and installed in a light fixture enclosure. Each LED array mounting feature may comprise an elongated planar surface comprising a flange formed along one edge of the reflector panel configured to mount at least one linear LED array.

In an example embodiment, an LED array mounting feature may comprise a thermally conductive extrusion that includes at least two elongated planar coaxial ribs, wherein an angle between the elongated planar coaxial ribs is between about 80 and about 135 degrees. A first one of the at least two elongated planar coaxial ribs may be configured to mount to an enclosure back surface, and wherein at least one linear LED array may be configured to mount to a second one of the at least two elongated planar coaxial ribs.

In an example embodiment, an LED array mounting feature may comprise a single metal extrusion that includes at least two side ribs and a bottom rib, wherein the at least two side ribs comprise a front elongated planar surface that forms an angle of between about 80 degrees and about 135 degrees with respect to the bottom rib. The bottom rib may be configured to mount on the back surface of an enclosure, and wherein at least one linear LED array may be configured to mount on the front elongated planar surface of each of the at least two side ribs.

In an example embodiment, a lens may comprise a clear or translucent substrate. The clear or translucent substrate may comprise any polymer, glass or optical film, and may be configured to modify light from linear LED arrays. The lens may further comprise two lens halves defining opposing, substantially planar outer portions and curved inner portions; the planar outer portions including outer edges that may be disposed in proximity to opposing edges of an aperture plane of an enclosure, and the outer edges of the two lens halves may be substantially parallel to one other. An axis of symmetry may define the two lens halves, wherein the two lens halves may be substantially similar to one another, and wherein the two lens halves may be configured to intersect or join in proximity to the axis of symmetry. The axis of symmetry may be disposed above, or in proximity to one or more LED array mounting features.

In an example embodiment, a lens may comprise one or more pieces of optical film and may be configured to modify light from linear LED arrays. The lens may further comprise two lens halves defining opposing, substantially planar outer portions and curved inner portions; the planar outer portions including outer edges that may be disposed in proximity to opposing edges of an aperture plane of an enclosure, and the outer edges of the two lens halves may be substantially parallel to one other. An axis of symmetry may define the two lens halves, wherein the two lens halves may be substantially similar to one another, and wherein the two lens halves may be configured to intersect or join in proximity to the axis of symmetry. The axis of symmetry may be disposed above, or in proximity to one or more LED array mounting features. The one or more pieces of optical film may comprise one or more edge trusses, wherein each of the one or more edge trusses may include one or more sides configured from a corresponding fold in the one or more pieces of optical film. At least one of the one or more sides of the one or more edge trusses may be configured at an angle relative to a front light-emitting side of the lens to impart support to the lens and to resist deflection of each edge truss.

In an example embodiment, a lens may comprise a clear or translucent substrate. The clear or translucent substrate may comprise any polymer, glass or optical film, and may be configured to modify light from linear LED arrays. The lens may further comprise two lens halves defining opposing, substantially planar outer portions and curved inner portions; the planar outer portions including outer edges that may be disposed in proximity to opposing edges of an aperture plane of an enclosure, and the outer edges of the two lens halves may be substantially parallel to one other. An axis of symmetry may define the two lens halves, wherein the two lens halves may be substantially similar to one another, and wherein the two lens halves may be configured to intersect or join in proximity to the axis of symmetry. The axis of symmetry may be disposed above, or in proximity to one or more LED array mounting features. The lens may further define a plane of incidence and a first surface, and at least one refraction feature pattern or shape region defining a feature pattern or shape region comprising at least one refraction element. The at least one refraction element may comprise, as applicable, one or more of:

A height variation of the first surface;

A thickness variation of the substrate;

A refractive index variation of the first surface;

A refractive index variation of the substrate;

A coating in contact with the first surface.

The at least one refraction element of the at least one refraction feature pattern or shape region may be configured to alter a transmittance angle of at least a portion of light input to the lens at an incidence angle with respect to the plane of incidence.

In an example embodiment, a lens may comprise a clear or translucent substrate. The clear or translucent substrate may comprise any polymer, glass or optical film, and may be configured to modify light from linear LED arrays. The lens may further comprise two lens halves defining opposing, substantially curved portions, including outer edges that may be disposed in proximity to opposing edges of an aperture plane of an enclosure, and the outer edges of the two lens halves may be substantially parallel to one other. An axis of symmetry may define the two lens halves, wherein the two lens halves may be substantially similar to one another, and wherein the two lens halves may be configured to intersect or join in proximity to the axis of symmetry. The axis of symmetry may be disposed above, or in proximity to one or more LED array mounting features.

In an example embodiment, a lens may comprise one or more pieces of optical film and may be configured to modify light from linear LED arrays. The lens may further comprise two lens halves defining opposing, substantially curved inner portions, including outer edges that may be disposed in proximity to opposing edges of an aperture plane of an enclosure, and the outer edges of the two lens halves may be substantially parallel to one other. An axis of symmetry may define the two lens halves, wherein the two lens halves may be substantially similar to one another, and wherein the two lens halves may be configured to intersect or join in proximity to the axis of symmetry. The axis of symmetry may be disposed above, or in proximity to one or more LED array mounting features. The one or more pieces of optical film may comprise one or more edge trusses, wherein each of the one or more edge trusses may include one or more sides configured from a corresponding fold in the one or more pieces of optical film. At least one of the one or more sides of the one or more edge trusses may be configured at an angle relative to a front light-emitting side of the lens to impart support to the lens and to resist deflection of each edge truss.

In an example embodiment, a lens may comprise a clear or translucent substrate. The clear or translucent substrate may comprise any polymer, glass or optical film, and may be configured to modify light from linear LED arrays. The lens may further comprise two opposing outer lens edges that are substantially parallel to each other, wherein each outer lens edge may be disposed in proximity to opposing edges of the aperture plane of an enclosure. A V-shaped bi-planar center lens section may be disposed over one or more LED array mounting features, and may comprise a peak axis and two base axes, wherein the peak axis may be disposed closer to the aperture plane than the two base axes. A substantially planar middle lens section may be disposed on each side of the V-shaped bi-planar center lens section, wherein each substantially planar middle lens section may include one inner axis that is coaxial with a corresponding base axis of the center lens section and one outer axis that is closer to the aperture plane than the inner axis. The lens may also include two substantially planar outer sections, wherein each substantially planar outer section may include an outer edge that includes one of the two opposing lens edges, and an inner axis that is coaxial with the outer axis of the middle lens section.

In an example embodiment, a lens may be configured to modify light from linear LED arrays. The lens may comprise one or more pieces of optical film having a front light-emitting side and a back light-receiving side, and a V-shaped bi-planar center lens section that may be disposed over one or more LED array mounting features. The V-shaped bi-planar center lens section may comprise a peak axis and two base axes, wherein the peak axis may be disposed closer to an aperture plane of a light fixture than the two base axes, and wherein each axis may be configured from a fold in the one or more pieces of optical film. The lens may further comprise a substantially planar middle lens section on each side of the V-shaped bi-planar center lens section, wherein each substantially planar middle lens section may have one inner axis that is coaxial with a corresponding base axis of the center lens section, and one outer axis that may be closer to the aperture plane than the inner axis, and wherein each axis may be configured from a fold in the one or more pieces of optical film. The lens may further comprise two substantially planar outer sections, wherein each substantially planar outer section may include an outer edge that includes one of the two opposing lens edges, and an inner axis that may be coaxial with the outer axis of the middle lens section. The one or more pieces of optical film may comprise one or more edge trusses, wherein each of the one or more edge trusses may include one or more sides configured from a corresponding fold in the one or more optical films, wherein at least one of the one or more sides of the one or more edge trusses may be configured at an angle relative to the front light-emitting side of the one or more optical film pieces to impart support to the lens and to resist deflection of each edge truss.

In an example embodiment, a lens may be configured to modify light from linear LED arrays, the lens comprising a clear or translucent substrate comprising or one or more pieces of optical film, the lens defining a plane of incidence and having a first surface. The substrate or optical film may comprise two opposing outer lens edges that may be substantially parallel to each other, wherein each outer lens edge may be disposed in proximity to opposing edges of a light fixture aperture plane. The lens may further comprise a V-shaped bi-planar center lens section that may be disposed over one or more LED array mounting features, and may comprise a peak axis and two base axes, wherein the peak axis may be disposed closer to the aperture plane than the two base axes. A substantially planar middle lens section may be disposed on each side of the V-shaped bi-planar center lens section, wherein each substantially planar middle lens section may include one inner axis that is coaxial with a corresponding base axis of the center lens section and one outer axis that is closer to the aperture plane than the inner axis. The lens may also include two substantially planar outer sections, wherein each substantially planar outer section may include an outer edge that includes one of the two opposing lens edges, and an inner axis that is coaxial with the outer axis of the middle lens section. The lens may further comprise at least one refraction feature pattern or shape region defining a feature pattern or shape region comprising at least one refraction element The at least one refraction element may comprise, as applicable, one or more of:

a height variation of the first surface;
a thickness variation of the substrate;
a refractive index variation of the first surface;
a refractive index variation of the substrate;
a coating in contact with the first surface.

At least one refraction element of the at least one refraction feature pattern or shape region may be configured to alter a transmittance angle of at least a portion of light input to the lens at an incidence angle with respect to the plane of incidence.

In an example first implementation, a lens may be configured to modify incident light, and may comprise a top edge, a bottom edge, a left edge and a right edge collectively defining a lens plane, and may further comprise two raised lens sections. Each raised lens section may comprise an elongated rectangular shape that substantially spans between the top and bottom lens edges and may be substantially parallel to the left and right lens edges. The raised lens sections may include a substantially planar face with a light-receiving side and a light-emitting side wherein the substantially planar face may define a raised lens section plane that is elevated at a distance above the lens plane. The raised lens sections may also include two opposing edges disposed at acute angles relative to the light receiving side of the substantially planar face, wherein each edge may form an overlay attachment feature. The lens may further comprise three substantially planar sections comprising a middle planar section disposed between the two raised sections and two outer planar sections disposed on either side of the raised lens sections.

In an example embodiment, the first example implementation may include one or more optical film overlays disposed in a substantially planar configuration over the light receiving side of each raised section. The optical film overlays may comprise a strip of optical film configured to modify light; the strip of optical film comprising two opposing edges, wherein the two opposing edges nest in two opposing overlay mounting features.

In an example embodiment, the first example implementation may include one or more optical film overlays configured to modify light, wherein the one or more optical film overlays may be disposed over the light receiving side of each raised lens section. The optical film overlays may comprise a strip of optical film comprising two opposing edges and a width that is greater than a width of each raised lens section, wherein the optical film strip may configured into a curved shape by the lateral compression of two opposing edges of the optical film strip, and retained in that compressed curved state by nesting in two opposing overlay mounting features.

In an example embodiment, the first example implementation may further comprise one or more pieces of optical film configured to modify light. The one or more pieces of optical film may comprise one or more edge trusses, wherein each of the one or more edge trusses may include one or more sides configured from a corresponding fold in the one or more optical films. At least one of the one or more sides of the one or more edge trusses may be configured at an angle relative to the lens plane to impart support to the lens and to resist deflection of each edge truss. The raised lens sections and the overlay mounting features may be created by folds in the one or more pieces of optical film.

In an example embodiment, the first example implementation, the substantially planar face of each raised section may be further defined by a plane of incidence and having a first surface comprising a uniform transmittance region. Either side of the substantially planar face may be configured with three groupings of parallel and adjacent elongated linear refraction elements comprising a center grouping of elongated linear refraction elements and two outer groupings of elongated linear refraction elements. The spacing between the linear refraction elements in the two outer groupings may be smaller than the spacing between the linear refraction elements in the center grouping, and wherein each elongated linear refraction element may comprise, as applicable, one or more of:

a height variation of the first surface;
a thickness variation of the substrate;
a refractive index variation of the first surface;
a refractive index variation of the substrate;
a coating in contact with the first surface.

The elongated linear refraction elements may be configured to alter a transmittance angle of at least a portion of light input to the lens at an incidence angle with respect to the plane of incidence.

In an example embodiment, the first example implementation, the substantially planar face of each raised section may further be defined by a plane of incidence and having a first surface comprising a uniform transmittance region. Either side of the substantially planar face may be configured with a single grouping of parallel and adjacent elongated linear refraction elements wherein each elongated linear refraction element comprises, as applicable, one or more of:

a height variation of the first surface;
a thickness variation of the substrate;
a refractive index variation of the first surface;
a refractive index variation of the substrate;
a coating in contact with the first surface.

The elongated linear refraction elements may be configured to alter a transmittance angle of at least a portion of light input to the lens at an incidence angle with respect to the plane of incidence.

In an example embodiment, a lens may comprise a substrate defining a plane of incidence and having a first surface The substrate may comprise a uniform transmittance region and at least one refraction feature pattern or shape region adjacent to the uniform transmittance region and defining a feature pattern or shape region that may comprise at least one refraction element. The at least one refraction element may comprise, as applicable, one or more of:

a height variation of the first surface;
a thickness variation of the substrate;
a refractive index variation of the first surface;
a refractive index variation of the substrate;
a coating in contact with the first surface.

At least one refraction element of the at least one refraction feature pattern or shape region may be configured to alter a transmittance angle of at least a portion of light input to the lens at an incidence angle with respect to the plane of incidence.

In an example second implementation, a lens may comprise a substrate defining a plane of incidence and having a first surface. The substrate may comprise a uniform transmittance region, at least one refraction feature pattern or shape region adjacent to the uniform transmittance region and defining a feature pattern or shape region comprising at least one refraction element. The at least one refraction element may comprise, as applicable, one or more of:

a height variation of the first surface;
a thickness variation of the substrate;
a refractive index variation of the first surface;
a refractive index variation of the substrate;
a coating in contact with the first surface.

The at least one refraction element of the at least one refraction feature pattern or shape region may be configured to alter a transmittance angle of at least a portion of light input to the lens at an incidence angle with respect to the plane of incidence.

In an example embodiment of the second implementation, the at least one refraction element may comprise one or more of: an elongated linear groove, an elongated linear protuberance, and elongated linear regions comprising a coating.

In an example embodiment of the second implementation, the at least one refraction element may comprise a printed surface coating.

In an example embodiment of the second implementation, the at least one refraction element may comprise at least one refraction element comprising a refraction gradient.

In an example embodiment of the second implementation, the at least one refraction element may comprise surface variations created by a laser-based device.

In an example embodiment of the second implementation, the lens may be fabricated by an injection molding process utilizing one or more mold cavities, wherein the one or more refraction elements may comprise surface variation in the lens first surface that are created by textures or patterns in corresponding areas of the one or more mold cavities.

Figure 21:
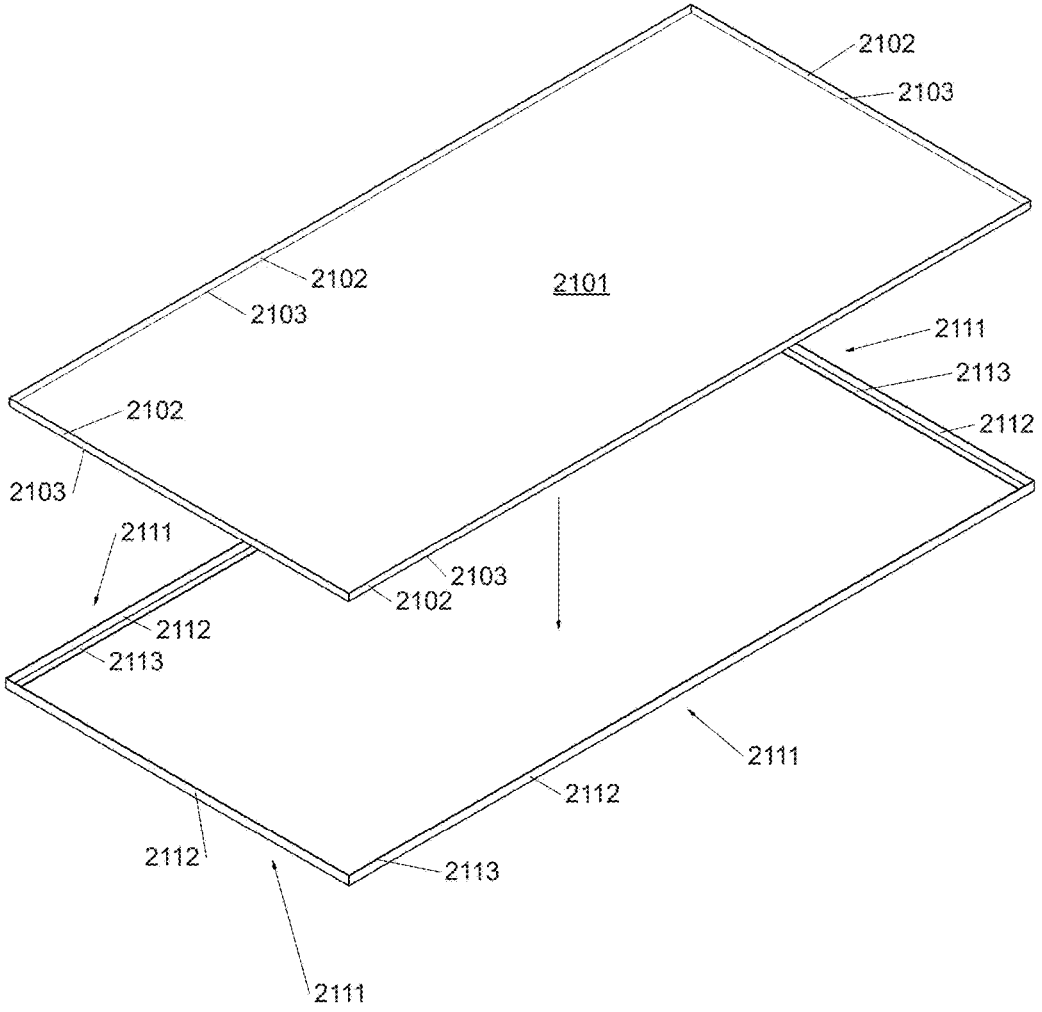
FIG. 21 depicts an exploded perspective view of the backside of a light fixture doorframe and an example embodiment of optical film lens.

FIG. 21 may depict a perspective exploded view of a simplified lens doorframe for a 2'×4' troffer light fixture along with an example embodiment of optical film lens 2101. There may be four frame members 2111, each having at least a horizontal segment 2113 that may function as the mounting surface for the lens 2101, and a vertical segment 2112. For simplicity, various other features and components of the doorframe such as latches and hinges have been omitted. The optical film lens 2101 has its backside (light-receiving side) facing upwards. One-sided edge trusses 2102 are created along fold lines 2103 at an approximate 90-degree angle relative to the aperture plane of the lens 2101. The lens 2101 may insert into the frame, wherein the periphery of the front light-emitting side of the lens may contact the surface of the horizontal segments 2113 of frame members 2111.

Figure 22A:
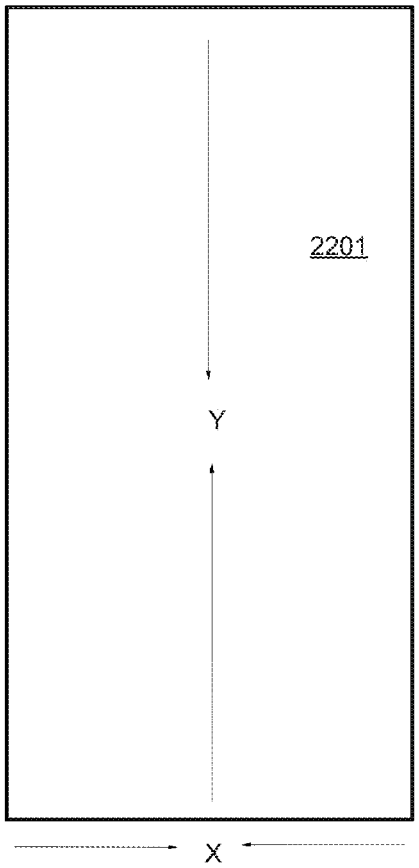
FIG. 22A depicts a top view of the backside of the light fixture doorframe and example embodiment of optical film lens shown in FIG. 21.
Figure 22B:
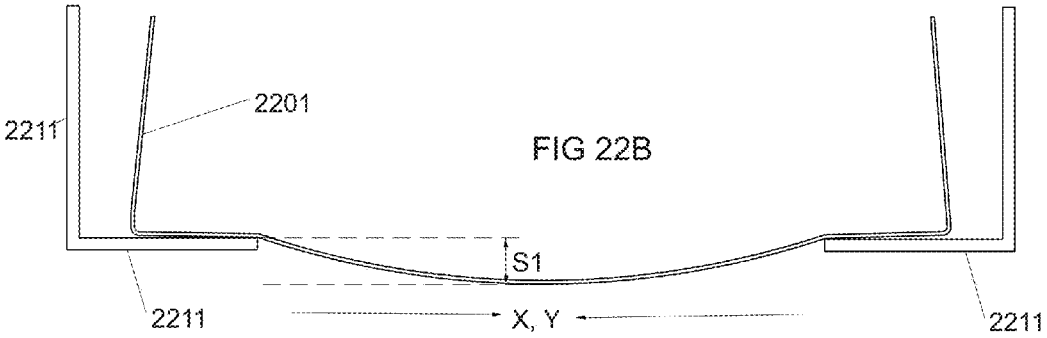
FIG. 22B depicts a side cut-away view diagram of a light fixture doorframe and an example embodiment of optical film lens, and indicates the sag distance.

FIG. 22A depicts a top view of the back (light-receiving side) of an example embodiment of optical film lens 2201 and mounted in a 2'×4' lens doorframe as shown in FIG. 21. The span on lens 2201 between the top and bottom frame members may be indicated by distance Y that may be about twice the distance X between the left and right frame members. In an example embodiment of optical film lens 2201 utilizing a substrate of 250 um and a single edge truss configuration on each edge of the optical film piece, noticeable sagging of the lens may occur due to the long span Y. FIG. 22B depicts a side cut-away view diagram, and may represent either plane X or Y. The distance S1 between the dotted lines may represent the total sag distance of lens 2201. Although the profile of the lens sag may vary between the X and Y planes, the maximum sag distance S1 may be the same for both planes, and may occur near the center of the lens 2201. The representative distance between the two frame members X or Y has been shortened for illustration purposes.

This sagging may be corrected to an acceptable degree by utilizing an optical film with a thicker substrate. However, the typical maximum industry standard thickness of substrates for use in optical films (usually polyester such as PETG or polycarbonate) may be applied may be 250 um. Optical films of greater thicknesses may be able to be custom manufactured, but the cost of manufacturing may be significantly higher. Regardless of availability, the overall cost of using significantly thicker substrates for example embodiments of optical film lenses may raise the manufacturing cost significantly.

Example embodiments of a film tensioning systems and methods may subsequently be described that may enable an acceptably low degree of sag of example embodiments of optical film lenses without utilizing a thicker more costly substrate. A "film tensioning system" may be referred to as example embodiments of optical film lenses with one or more edge trusses configured on each edge of an optical film sheet and configured to mount in a frame, combined with one or more film tensioning devices.

Figure 23D:
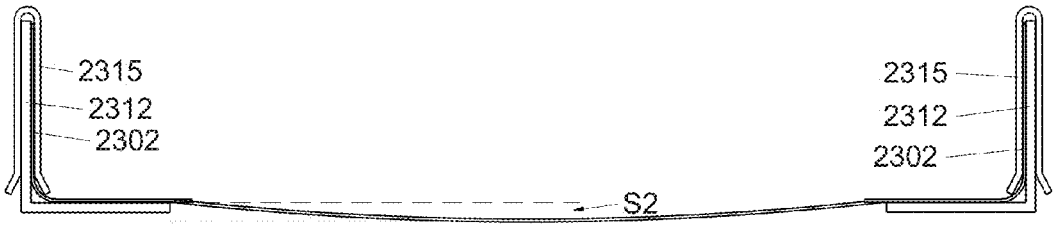
FIG. 23D depicts a side cut-away view diagram of a light fixture doorframe, an example embodiment of optical film lens with lens tensioning devices, and indicates the sag distance.

FIG. 23A depicts a rear perspective view of an example embodiment of optical film lens 2301 mounted in a troffer doorframe (similar to that shown in FIG. 21). One film-tensioning device 2315 may be attached near each corner of the lens assembly on the 2' frame members as shown. FIG. 23B depicts a side cut-away view of one of the shorter 2' frame members. The film tensioning device 2315 may attach over vertical doorframe segment 2312 and film edge truss 2302, pulling the edge truss 2302 against the doorframe segment 2312, which in turn may pull the lens face 2307 (resting on horizontal segment 2313) closer to segment 2312 in the direction of the arrow, through fold 2303. Fold 2303 may become flexed under the applied tension, subsequently functioning as a tensioner. Accordingly, all four film tensioning devices 2315 that may be installed as shown in FIG. 23A, may function to create tension across the lens 2301, which may lessen the degree of sag of the lens 2301. As shown in FIG. 23D, which may be the same lens assembly diagram as shown in FIG. 22B except with film tensioning devices 2315 installed as described, the total sag S2 may be smaller than S1 of FIG. 22B.

The dimensions of the lens 2301 may adjusted which in turn may adjust the amount of tension applied across the lens. Referring to FIG. 23C, if the lens dimensions are made smaller, the gap Z between edge truss 2302 and vertical segment 2312 may increase. Accordingly, once all the film tensioning devices 2315 as shown in FIG. 23B are installed, and assuming the film tensioning devices have sufficient tensioning properties to pull the edge trusses 2302 tight against the vertical segments 2312, the overall tension across the lens may increase. The inverse may also be true, wherein lessening the gaps Z may function to decrease tension across the lens.

Example embodiments of film tensioning devices may comprise a somewhat flexible material, wherein after installation, the film tensioning device may flex to some degree, therein functioning as a tensioner. For example, lens tensioning device 2315 in FIG. 23B may be fabricated from a sufficiently flexible material or thickness of material wherein the left side of the tensioning device 2315 may flex under stress from the pulling force of lens 2301, which may create a gap.

An example embodiment of a film tensioning device as described may comprise any configuration of mechanical apparatus that may include one or more or all of the following properties:

function to adequately create tension between an edge truss of an optical film lens and a vertical segment of a lens doorframe by mechanically pulling the edge truss towards the vertical segment.

Securely attach to a frame-member.

Not interfere with the proper functioning of the frame.

Be reasonably quick and easy to install.

In consideration of these properties, example embodiments of film tensioning devices for example embodiments of film tensioning systems may be formed into a required profile utilizing flat spring metal strips. Spring metal may have an advantage of having a high strength to thickness ratio, imparting sufficient tension while having a low profile that does not interfere with the functionality of a frame. Spring steel clips may be able to be formed into a required profile shape utilizing automated processes found in the clip manufacturing industry and may be manufactured in large quantities at a relatively low cost. Spring metal may allow parts of the profile to expand to allow installation on frame-members with more complicated profiles. FIGS. 24A and 24B show two common frame profiles that film tensioning devices comprising spring steel clips may be suitable. Each frame profile has a vertical segment 2412 and an additional top segment 2414. Accordingly, the top channels of the film tensioning devices 2415 may need to flex in the direction of the arrows in order to be installed.

On doorframe profiles that are simple and do not require much flex to the film tensioning device during installation, the film tensioning device may be fabricated using metal or plastic extrusions. Extrusions may have an advantage of being able to cut to the desired length, wherein they may be able to tension a significant portion of an entire edge truss as shown in FIG. 24C. Film tensioning device 2415 may be installed over edge truss 2412 of lens 2401 and vertical frame segment 2412.

Referring to FIG. 24D, on installations where it may be practical or allowable to attach screws to a frame, film tension devices 2416 may comprise screws, wherein the screws may be installed through edge truss 2402 on lens 2401 and into vertical segment 2412, thereby clamping the edge truss 2402 securely to the vertical segment 2412. The film tensioning devices 2415 may comprise: self-tapping screws, machine screws with nuts and/or washers that may attach in either direction through corresponding pre-drilled holes in the edge truss 2402 and vertical segment 2412, plastic or metal rivets through pre-drilled holes, or any other suitable fastener. Round washers may be used to provide additional tensioning surface area.

In example embodiments of film tensioning systems, one or two or more film tensioning devices on each of the 2' frame members may be installed as previously described.

One film-tensioning device may be centered and attached as previously described on each 2' frame member. However, the width of the film tensioning devices may affect the total amount of tension applied to the lens, as well as the distribution of the applied tension. Smaller widths may concentrate the applied tension to a central area of the lens, and not apply enough tension to the side areas, which may cause distortions or rippling of the lens as well as insufficient sag reduction. As the width of an example embodiment of lens tensioning device is increased, the overall applied tension may increase, as well as the tension being more evenly distributed more towards the lens sides. The width of an example embodiment of lens tensioning device that produces acceptable sag and lack of distortions may be determined by trial and error on a given application.

In an example embodiments, a film tensioning device near each end of each 2' frame member as shown in FIG. 23A may be utilized, and may have advantages over utilizing a single device on each 2' frame member as described. This method may apply increased total tension to the lens, as well as provide a more uniform application of the tension across the lens, which may decrease the total sag as well as lessening or eliminating any noticeable distortions. The width of the film tensioning devices may be reduced, which may lower manufacturing costs. In some applications, widths of ½" to 1 inch may achieve good results.

In certain example implementations, a film-tensioning device may comprise a film tensioning system comprising one or more individual components. An example embodiment of film tensioning system may be shown in FIGS. 25A, 25B-1, and 25B-2. Referring the side cut-away view in FIG. 25A, a film-tensioning strip 2517 may comprise any suitably rigid strip of material, such as aluminum, steel or plastic for example. Each film-tensioning strip 2517 may preferably be configured to span a substantial portion of a frame member. A single screw 2566 (for example a self-tapping sheet metal screw) may be driven through the back-side of the vertical segment 2512 of the frame member, through the edge truss 2502, and into the film tensioning strip 2517, thereby securing the center of the film tensioning strip against the vertical segment 2512. Due to the inherent flex that may occur in each unfastened end of the film tensioning strip 2517, the end portions of the film tensioning strips 2517 may function as tensioners. FIG. 25B-1 depicts a perspective view, and FIG. 25 B-2 depicts a perspective exploded view of the FIG. 25 B-1. Alternatively, two or more screws 2566 may be used to pull the film-tensioning strip 2517 towards the vertical segments 2512.

In example embodiments of film tensioning systems as described in FIG. 21 through FIG. 25B-2, frame member segments that attach to lens tension devices or assemblies may be shown to be vertical, as may the case with luminaire doorframes. However, a frame member surface that may attach to a film tensioning device or assembly may comprise any angle greater than zero relative to the aperture plane of the lens that may be practical. For example, a frame member segment may be angled as shown in FIG. 26E.

In example embodiments, a substrate attachment system may be provided. Referring to FIG. 26A, a side cut-away view of a frame member may be shown. A substrate 2601 with a single edge truss 2602 with outer perimeter edge 2621 may be configured along a fold or crease in the substrate wherein the edge truss may be configured at an angle relative to the substrate. The relative angle of the edge truss may be configured to a suitable angle for a given frame member profile, such that sufficient elastic tension exists between the substrate and the edge truss wherein the outer perimeter edge of the edge truss may contact an edge truss retention feature once inserted into the given frame member, as may subsequently be described. A frame member 2611 may be configured similar to that shown, wherein the frame member may include an edge truss retention feature 2620. The edge truss retention feature 2620 may include any protrusion capable of engaging an outer perimeter edge of an edge truss. For example, the edge truss retention feature may comprise a protrusion emanating from a segment of a frame member, or may comprise an individual frame segment. The substrate 2601 may be inserted into the frame member 2611 in the direction of the arrow. Referring to FIG. 26B, the perimeter edge 2621 of the edge truss 2602 may contact the edge truss retention feature 2620 of the frame member 2611 and flex downward upon insertion, and then flex back upward due to the elasticity between the substrate and the edge truss as previously described. After the perimeter edge 2621 of the edge truss 2602 clears the edge truss retention feature 2620, the outer perimeter edge 2621 of the edge truss 2602 may become engaged against the edge truss retention feature 2620. When a lateral pull-out force X is applied to substrate in the direction of the arrow, the edge truss 2602 pushing on the edge truss retention feature 2620 may function to resist the force X, which may function to secure and "lock" the substrate 2601 in the frame 2611 as shown.

FIG. 26B depicts an edge truss that may be configured with a length that is about the same dimension as the diagonal between the edge truss retention feature 2620 and the opposing frame corner, wherein the edge truss 2602 may exhibit little or no flex when fully seated in the frame member 2611. Referring to FIG. 26C, substrate 2601 may be configured with the edge truss 2602 length being greater than the diagonal between the edge truss retention feature 2620 and opposing frame member corner, wherein the edge truss may exhibit some flexing as shown. This "pre" flexing of the edge truss 2602 may function to create a more secure lock of the substrate in the frame member 2611 compared to that shown in FIG. 26B.

Referring FIG. 26D, a frame member 2611 may be configured with a shallower profile. In an application such as will be later described in FIG. 31A for example, wherein the opposite edge of the substrate is also tensioned or fastened in a static configuration, the shallower profile may function to resist an increased pull-out force X as shown by the double arrows. Accordingly, the degree of resistance to pull-out forces in example embodiments may be varied by increasing or decreasing the profile height as described, or increasing or decreasing the edge truss length.

In an example embodiment of substrate attachment system as shown in FIG. 26E, a frame member 2611 may also comprise two segments, along with edge truss retention feature 2620, edge truss 2602, edge truss outer perimeter edge 2621, and substrate 2601. This configuration may have the advantage of a slimmer profile, and a lower weight, lower cost frame.

Example embodiments of substrate attachment systems may utilize any substrate that maybe sufficiently flexible enough wherein folds may be configured thereon without damaging the substrate. Example substrates may include thin sheet metals, reflection films, various non-optical plastic films, plastics etc. Example embodiments of substrate attachment systems may be used in any application where a substrate may require attachment. For example, plastic sheets or sheet metal may be configured to attach to frame members or channels to form enclosure surfaces etc. Example embodiments of optical film lenses may be attached to a light fixture or light fixture doorframe for example. Banners or other media may be attached to frames for display purposes.

An example embodiment of lens over-mounting, attachment and tensioning system may now be described. Referring to FIG. 27A, an example embodiment of optical film lens 2701 may be provided, wherein the lens 2701 is configured with a single edge truss 2702 on each edge of the film piece as shown. An enclosure 2722 may be provided, wherein the enclosure may include a top edge surface 2723. Although the top edge surface 2723 as shown may comprise a troffer mounting flange, other types of enclosures or frames may have different configurations of top edge surfaces top edge surfaces that may be suitable for example embodiments of optical film lens over-mounting, attachment and tensioning systems. For example, an enclosure side need not have a flange. The enclosure may comprise a light fixture enclosure such as a troffer, or any other square enclosure. The enclosure may also comprise a frame. Each top edge surface 2723 may comprise an outer perimeter edge 2740.

Figure 27C:
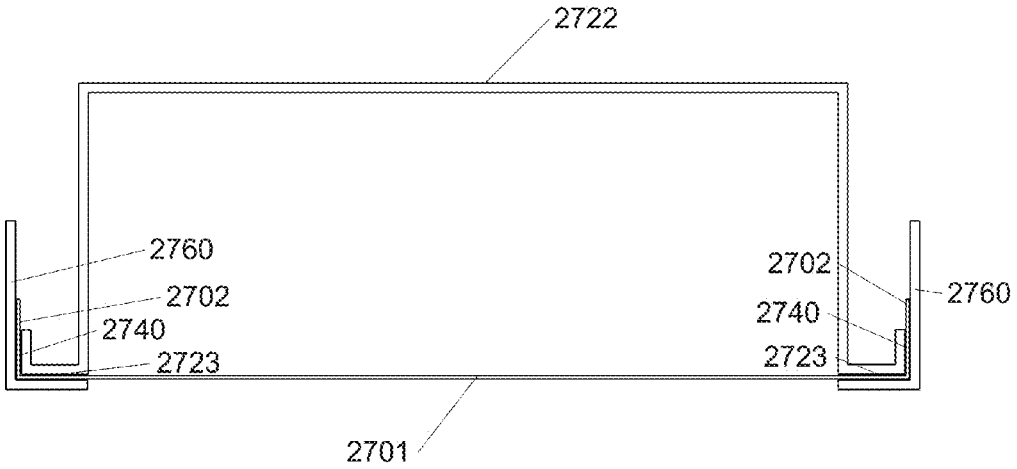
FIG. 27C depicts a side cut-away view of an example embodiment of light fixture with lens over-mounting, attachment and tensioning system installed in a suspended ceiling grid.

As shown in FIG. 27B, the lens 2701 may be placed onto the enclosure 2722 such that the back light-receiving side of the lens 2701 may be disposed on all or a portion of the top edge surfaces 2740, and the edge trusses 2702 may be disposed outside the enclosure perimeter defined by the outer perimeter edges 2740. The lens 2701 may be secured to the top edge surfaces 2723 along a portion, or all of the top edge surfaces 2723 by any suitable means, such as adhesives etc. It may be advantageous to only adhere the lens 2701 to the enclosure 2722 at each corner of the enclosure, which may be sufficient in the case of a troffer light fixture for example, wherein the lens may only be required to be fastened sufficiently well enough to enable the fixture to be installed in a ceiling grid. FIG. 27C depicts a simplified side cut-away view (not to scale) of the example embodiment shown in FIGS. 27A and 27B when mounted in a drop ceiling grid frame. The fixture is turned upside down and installed in a ceiling grid wherein a portion of, or the entire perimeter of the lens 2701 may become sandwiched between the top edge surfaces 2723 and the ceiling grid frame members 2760, and the edge trusses 2702 may be disposed outside the enclosure perimeter defined by the outer perimeter edges 2740. This may function to create an excellent seal between the enclosure 2722 and the lens 2701. This seal may function to eliminate or substantially reduce insect or dirt entry into the light fixture without the use of gaskets, seals or sealants along the entire perimeter of the enclosure. This method also has the major advantage of not requiring a doorframe for the lens. With the advent of LED light fixtures, access to the inside if the light fixture may no longer be required, as there may be no user serviceable parts inside that require access. The only reason for access may be to remove insects or dirt and dust. The example embodiment of optical film lens mounting, attachment and tensioning system may both eliminate the cost and design restrictions of a light fixture doorframe, but also seal the fixture from dirt, dust and insects.

Referring to FIG. 27C, the lens 2701 may also not be secured to the enclosure 2722 at all. During installation of the light fixture in a ceiling grid, the lens 2701 may be positioned and placed in the grid frame 2760, and the light fixture enclosure 2722 may be placed over top of the lens 2701.

Referring to FIG. 27A, the lens 2701 may be configured such that the length between two opposing edge trusses may be slightly smaller than the corresponding span between opposing outer perimeter edges 2740 of the enclosure. When the lens 2701 may be fully inserted over top of each top edge surface 2723, and the lens aperture may be disposed flat on the surface of each top edge surface 2723 as shown, the opposing edge trusses as described may be forced slightly outward. The elasticity created by the folds in the optical film may function to flex the film, and create tension across the lens. This may function to decrease sag. The lens may also be configured with dimensions that are equal or greater to the dimensions of the enclosure, wherein no tensioning may be imparted to the lens 2701.

Figure 27D:
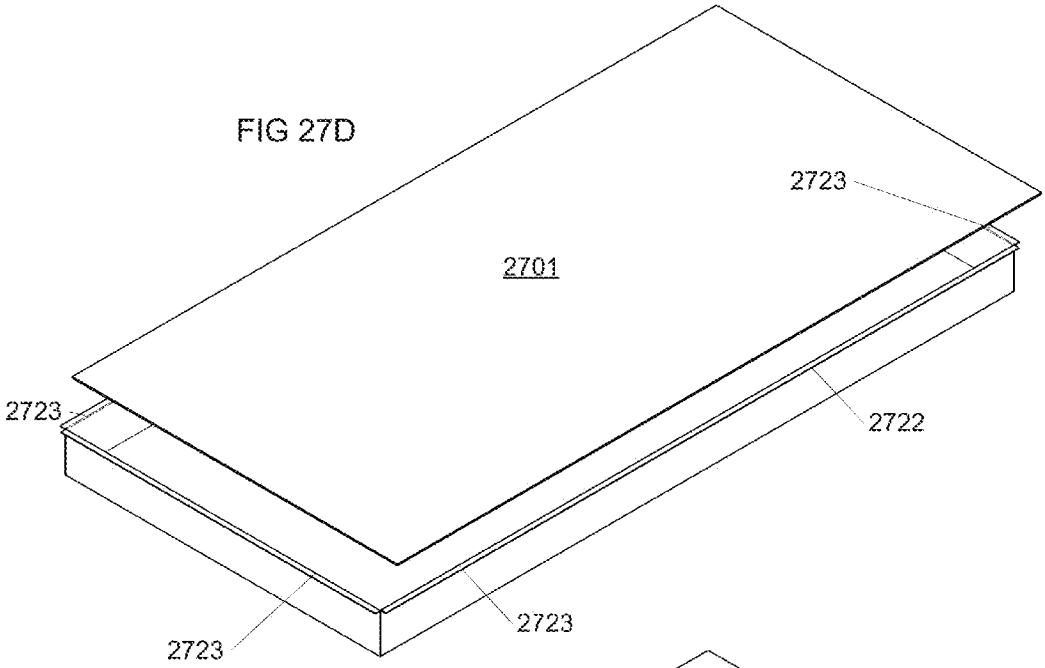
FIG. 27D depicts a top exploded perspective view of an example embodiment of lens over-mounting, attachment and tensioning system comprising a rigid or semi-rigid light modifying element and a structure comprising a perimeter flange.
Figure 27E:
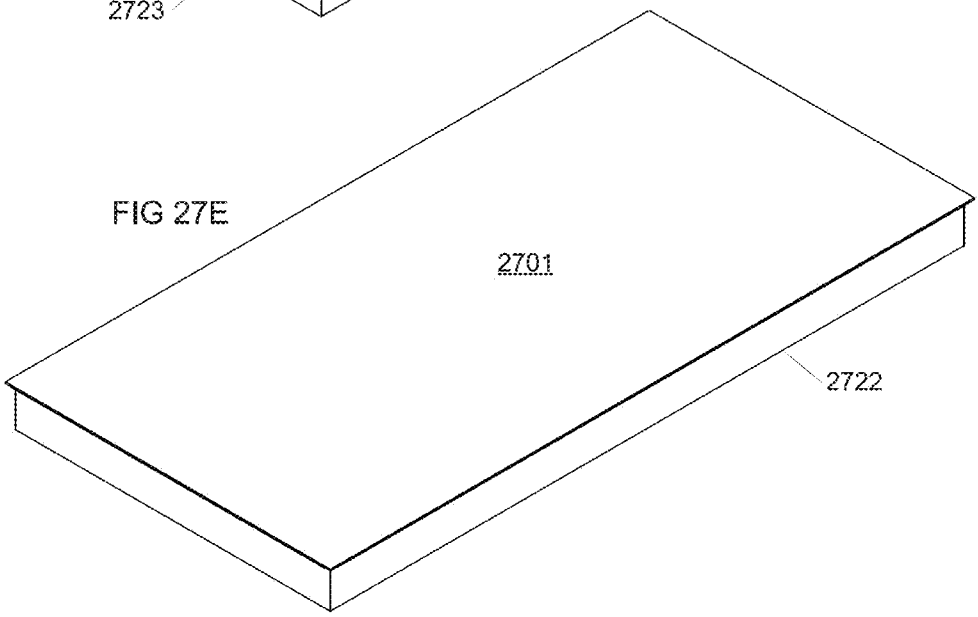
FIG. 27E depicts a top perspective view of the example embodiment of lens over-mounting, attachment and tensioning system comprising a rigid or semi-rigid light modifying element comprising a perimeter flange as shown in FIG. 27A.

An example embodiment of lens mounting, attachment and tensioning system may also comprise a single sheet of rigid or semi rigid clear or translucent substrate. Referring to FIGS. 27D and 27E, the substrate 2701 may include any type of substrate that may provide suitable enclosure and optical properties for the intended application. Examples of suitable substrates may include polycarbonates or acrylics. The substrate may have associated with it any type of light modifying features that may be suitable for an intended application. In one example implementation, the substrate may have a light modifying layer deposited on either or both surfaces. In one embodiment, the light modifying layer(s) may include diffusion particles such as glass beads. In other example implementations, the substrate may have light modifying elements incorporated within the substrate itself, such as diffusion particles for example. In certain example implementations, the substrate may have features formed onto its outer surface, such as prismatic or Fresnel features. In accordance with various example implementations of the disclosed technology, the substrate may have various combinations of light modifying features, for example, particles incorporated into the substrate itself and a light modifying layer deposited on one or more surfaces. In certain example implementations, the substrate may include an optical film overlay. The substrate 2701 may be disposed on the top edge surfaces 2723 and attached with adhesives etc. as previously described, or the substrate 2701 may be first placed on a ceiling grid frame with the light emitting side facing the grid frame, and the enclosure 2722 may subsequently be placed in the ceiling grid frame wherein the top edge surfaces 2723 may be disposed on the substrate 2701.

With the advent of low cost energy saving LED technology, there may be a large market for retrofitting LEDs into commercial linear fluorescent light fixtures. Whether the retrofit is LED strips or LED tubes (such as T8 LED tubes for example), both retrofit examples may typically have an approximate 120 degree beam angle that does not distribute light evenly and adequately within the light fixture as would be distributed with omni-directional fluorescent tubes. This may create a large disadvantage of a relatively dark lens with very bright strips in the area directly over the LED light source, which may be objectionable to many users. An example embodiment of lens assembly and light fixture retrofit assembly may be herein described that may over the disadvantages as described.

FIG. 28A depicts a side profile view of an example embodiment of a lens assembly and light fixture LED retrofit assembly. A base 2826 may comprise an aluminum extrusion. An aluminum extrusion base may have the advantages of excellent thermal dissipation, low cost, and the design freedom to create a profile to the exact shape and functional requirements of an application. Alternatively, any sheet metal may be utilized with roll example fabrication methods such as roll forming, stamping or folding methods etc. The base 2826 may include a top mounting surface or channel wherein an LED strip 2850 may attach. The LED strips may be fastened to a top mounting surface with screws, adhesives etc.

An example embodiment of a light fixture retrofit assembly similar to that as shown in FIG. 28A may also comprise a configuration that includes mounting surfaces or channels etc. for two or more adjacent parallel LED strips. The two or more adjacent LED strips may be configured wherein the plane of both of the extrusion's LED mounting surfaces are oriented parallel to the plane of the mounting base of the extrusion, or the plane of adjacent LED mounting surfaces may be oriented at an angle relative to each other and to the plane of the mounting base of the extrusion. For example, adjacent LED mounting surfaces may be angled outwards or inwards relative to each other.

Figure 28D:
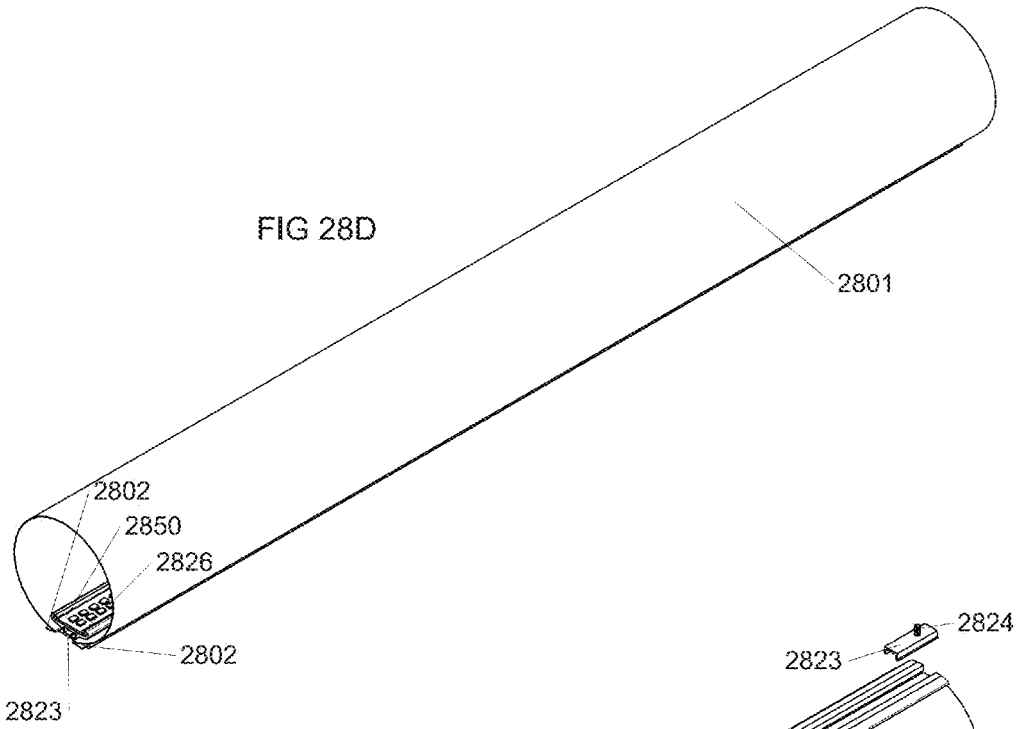
FIG. 28D depicts a perspective view of the example embodiment of lens assembly or LED retrofit assembly shown in FIG. 28A.

An example embodiment of optical film lens may be shown in FIGS. 28B and 28C. Optical film lens 2801 may preferably comprise a diffusion film with light condensing properties, or any optical film as previously described that may suit a given application, and may include two edge trusses 2802 as shown. A diffusion film with light condensing properties will be utilized for subsequent example purposes. The edge trusses 2802 may be inserted into corresponding opposing attachment features 2821 in the base 2826 as shown in FIG. 28A, wherein the outside perimeter 2822 edge of each edge truss 2802 may lock against corresponding edge truss retention features 2820 in a manner similar to that described in FIG. 26A through FIG. 26D. The lens 2801 may form a curved or round shape as shown. FIG. 28D depicts a perspective view of the assembly as shown in FIG. 28A, indicating the base 2826, LED strip 2850, lens 2801, mounting clips 2823 with attachment screw 2824, and edge trusses 2802.

The resultant curved or round lens as shown may have the advantage of distributing light over a very wide range of angles, and creating a large and evenly illuminated apparent light source. Referring to FIG. 28G, retrofit base 2826 may include LED light source 2850. In an extreme simplification, example light rays R3 and R4 may refract through lens 1 in a direction closer to the normal of the surface of the lens due to the light condensing properties of the lens, thus spreading the light rays in a more lateral direction. The refracted light rays are indicated by light rays R3-B and R4-B. Light ray R5 striking the lens 1 surface at a relatively perpendicular angle may refract relatively straight through as shown by light ray R5-B. Light rays may also be reflected by the lens surface as shown by example light rays R1 and R2. Some light rays may be reflected by TIR and are indicated by reflected light rays R1-B and R2-B that may exit the lens as shown. Accordingly, through refraction and reflection of the light source as described, light from the LED source 2850 may be distributed through a wider range of angles, and may also function to greatly increase diffusion of the light source. As shown in FIG. 28F, two example embodiments of retrofit assemblies 2855 as described may be retrofitted into a light fixture enclosure 2822. As indicated by the arrows, example light rays exiting the lens may be distributed relatively evenly throughout the enclosure 2822. If the chosen optical film for the lens comprises adequately high diffusion levels, the lens surface may become relatively evenly illuminated. As shown, the size of the lenses may be very large relative to a typical fluorescent tube or LED tube. This may create relatively large apparent light sources within the enclosure 2822, which may create an advantageously soft and desirable appearance.

Figure 28E:
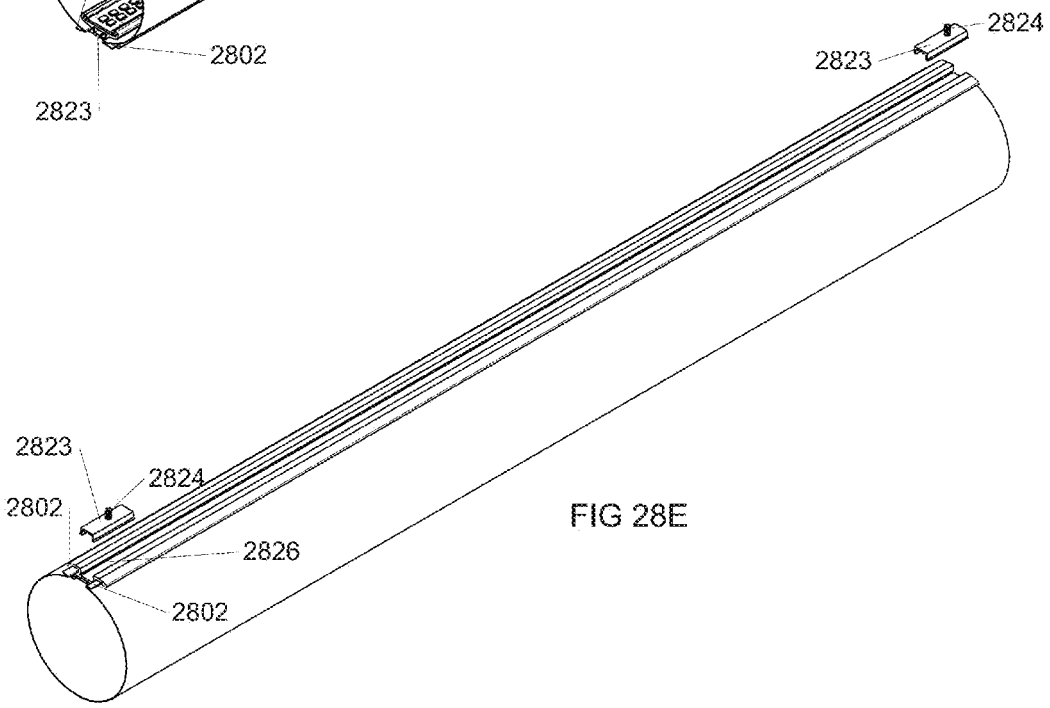
FIG. 28E depicts an upside down perspective view of the example embodiment of lens assembly or LED retrofit assembly shown in FIG. 28A, with mounting clips detached from the base.

Another advantageous element of the example embodiment of light fixture retrofit assembly as described may be the mounting system, which includes bracket 2823 and screw 2824 as shown in FIG. 28A and FIG. 28E. Typically during a retrofit of a troffer in a ceiling grid, the contractor may be on a ladder and working overhead with his hands. Especially with a 4' troffer length, ease of installation and safety of an installation may be crucial. Using a typical retrofit example where the fluorescent tube may be retrofitted with led strips screwed onto the back of the troffer, holding a 4' LED strip with one hand and installing a screw at each end with an electric screwdriver may be difficult and time consuming. FIG. 28 E depicts an upside down perspective view of the example embodiment. As shown, two small brackets 2823 may be fastened individually to a troffer with screws 2824. This may be much quicker and easier to install than with LED strips as described. Subsequently, the entire retrofit assembly may be snapped onto the brackets 2823. Brackets 2823 may comprise any material that may have sufficient elasticity, such as plastic or spring steel for example, and may be configured with tabs on the end of two flanges that nest in corresponding cavities 2829 in the base 2826 as shown in FIG. 28A. There may be many possible configurations of brackets and corresponding mating cavities on the base that may function adequately, the one shown may be only an example for illustrative purposes.

Example embodiments of optical film lens strips may subsequently be described that may be suitable for use with light emitting devices, for example, the light fixture shown in FIGS. 1A and 1B. Example embodiments of optical film strips may be suitable to function to hide the shadow and gap between each LED strip with a pleasing decorative fully illuminated shape. Luminaire efficiency may be increased compared to an opaque center strip between each lens section.

Figure 29A:
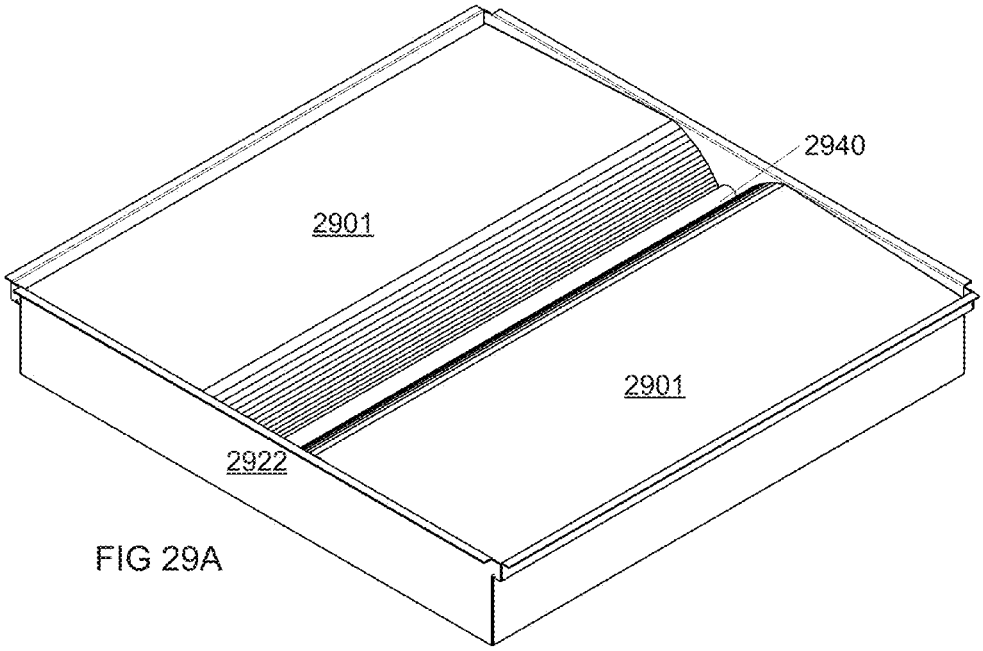
FIG. 29A depicts a perspective view of an example embodiment of a light fixture that includes an example embodiment of optical film lens strip.
Figure 29B:
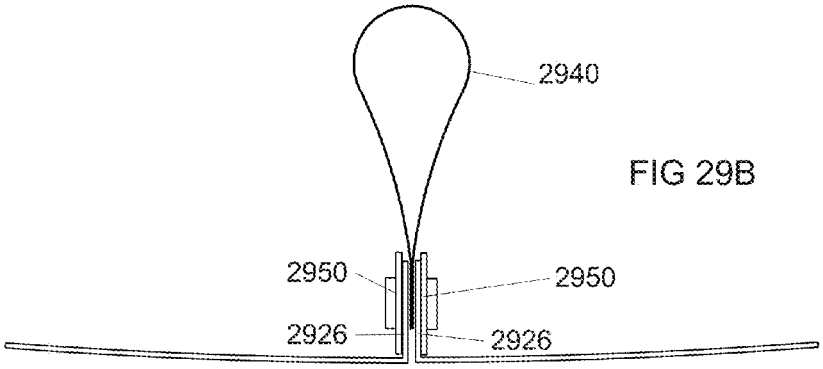
FIG. 29B depicts a side view of the optical film lens strip, LED mounting bases, and LED strips from the example embodiment of light fixture as shown in FIG. 29A.

FIG. 29A depicts an example embodiment of light fixture similar to that shown in FIGS. 1A and 1B as described, including an enclosure 2922 and lens sections 2901, along with an example embodiment of optical film lens strip 2940. FIG. 29B depicts a side view of the just the LED mounting base 2926, with LED strips 2950 mounted thereon. Lens strip 2940 may comprise a strip of any optical film as described, but may preferentially comprise a diffusion film as previously described. Opposing edges of the lens strip 2940 may be inserted between bases 2926 and fastened in any suitable manner as previously described, such as with a screw or rivet on each end of the base for example. The example embodiment of lens strip 2940 may also be configured with locking edge trusses as previously described. The resultant shape may be similar to that shown. When installed a light fixture as shown in FIG. 29A, the lens strip may become relatively fully illuminated when viewed from most angles. When being viewed from relatively straight-on angles, light from the LED strips directly below may function to illuminate the lens strip 2940, and from off more off axis viewing angles, light from each lens section 2901 may be seen refracting through the lens strip 2940. The lens strip 2940 may function to hide the shadow and gap between each LED strip with a pleasing decorative fully illuminated shape. Luminaire efficiency may be increased compared to an opaque center strip between each lens section 2901.

Figure 30A:
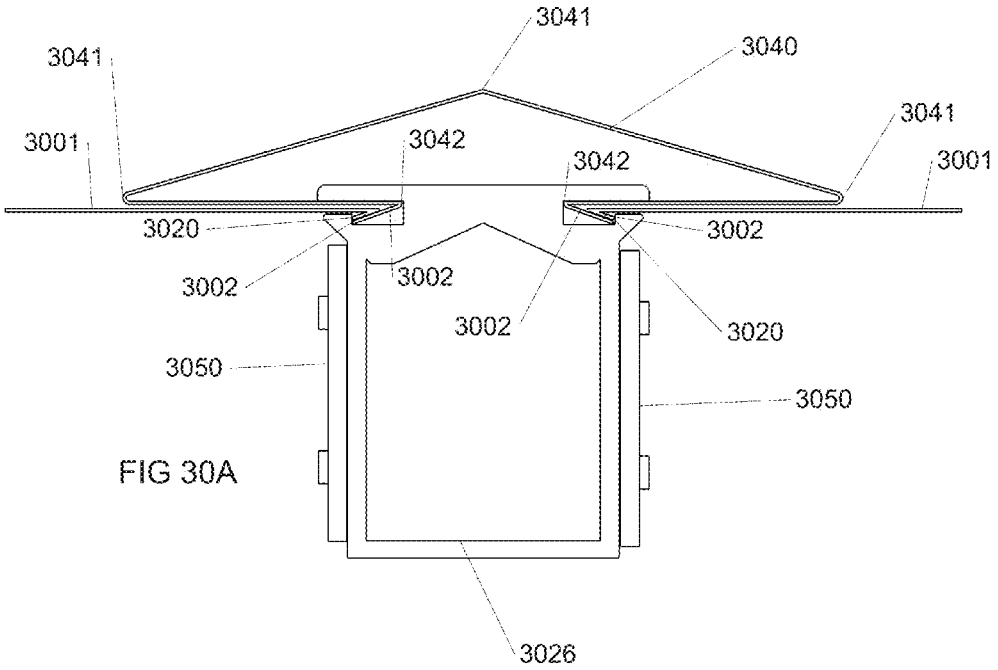
FIG. 30A depicts a side view of a mounting base with an example embodiment of optical film lens attached, as well as a triangular shaped example embodiment of optical film lens strip attached.
Figure 30B:
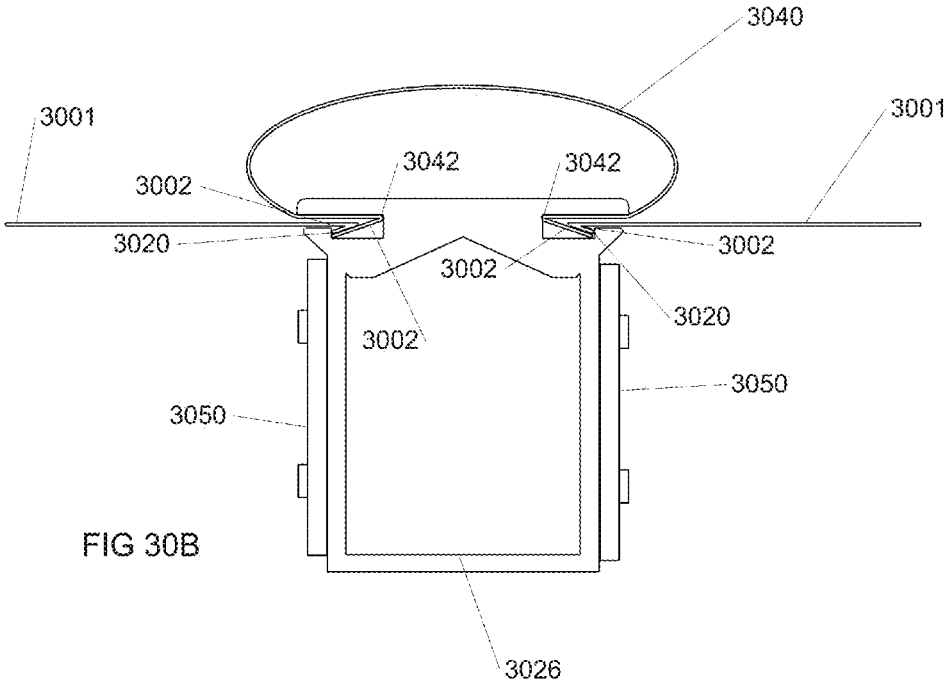
FIG. 30B depicts a side view of a mounting base with an example embodiment of optical film lens attached, as well as an elliptical shaped example embodiment of optical film lens strip attached.
Figure 30C:
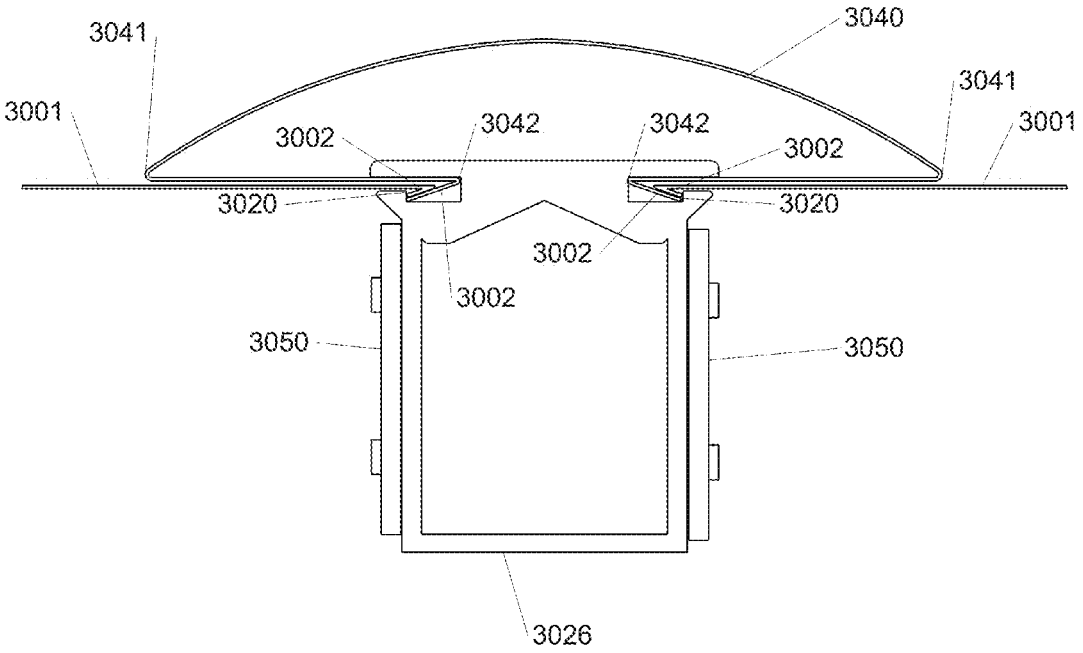
FIG. 30C depicts a side view of a mounting base with an example embodiment of optical film lens attached, as well as a dome shaped example embodiment of optical film lens strip attached.

Example embodiments of optical film lens strips may be configured in any shape that may be visually pleasing or that may function to blend or hide the gap between the opposing LED strips. They may include one or more folds that may function to form different shapes. They may include edge trusses on opposing edges that may function to attach the edges to mounting channels as previously described. FIG. 30A, FIG. 30B and FIG. 30C depicts example embodiments of optical film lens strips. Base 3026 may comprise extruded aluminum with LED strips 3050 mounted on opposing sides, along with lenses sections 3001 with edge trusses 3002 attached in opposing upper channels against edge truss retention features 3020.

In FIG. 30A, an example embodiment of a triangular optical film lens strip 3040 may be configured from an optical film strip of suitable pre-configured dimensions with three folds 3041 that fold inwards, with the apex of the folds being away from the unstructured bottom surface of the film, along with two outward folds 3042 (folds in the opposite direction) creating the edge trusses 3002. The folds may be configured in a manner similar to those previously described. When opposing edge trusses 3002 are inserted into the opposing attachment features on the base 3026, the optical film lens strip may form the shape similar to that shown.

In FIG. 30B, an example embodiment of elliptical optical film lens strip 3040 may be configured from an optical film strip of suitable pre-configured dimensions with two outward folds 3042 creating the edge trusses 3002. The folds may be configured in a manner similar to those previously described. When opposing edge trusses 3002 are inserted into the opposing channels on the base 3026, the optical film lens strip may form the shape similar to that shown.

In FIG. 30C, an example embodiment of dome shaped optical film lens strip 3040 may be configured from an optical film strip of suitable pre-configured dimensions with two folds 3041 that fold inwards, with the apex of the folds being away from the unstructured bottom surface of the film, along with two inward folds 3042 (folds in the opposite direction) creating the edge trusses 3002. The folds may be configured in a manner similar to those previously described. When opposing edge trusses 3002 are inserted into the opposing channels on the base 3026, the optical film lens strip may form the shape similar to that shown.

Fluorescent troffer light fixtures with parabolic louvers used to be very popular, and may be one of the most common commercial light fixtures installed across the USA. Unfortunately, the light distribution they provide along with the light source being directly visible through the louvers may no longer be popular or desirable. As previously described, linear fluorescent fixtures are being retrofitted with LED tubes and LED strips as an alternative to fixture replacement. Parabolic troffers have no lens, so when they are retrofitted with LED strips, the harsh direct light from the LEDs may be visible, making this a very poor retrofit option. LED tubes with a frosted lens may be a better option, but they still may create thin strips of very bright light that does little to distribute that light within the fixture. An example embodiment of lens retrofit assembly may now be described that may overcome these inherent disadvantages of parabolic troffers.

Figure 31A:
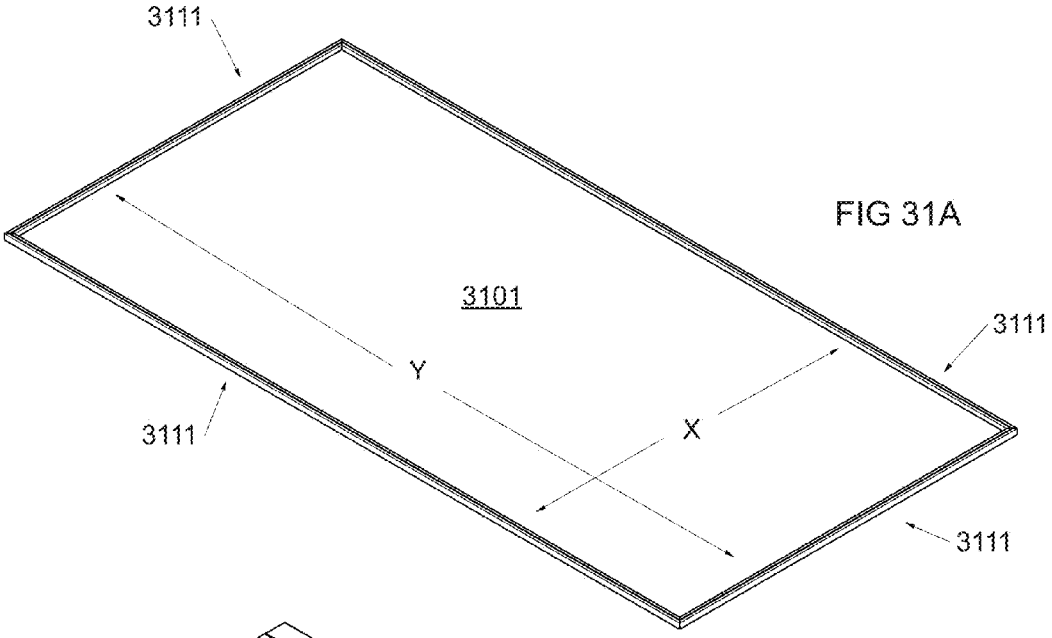
FIG. 31A depicts a back perspective view of an example embodiment of light fixture retrofit lens assembly.

FIG. 31A depicts an upside down perspective view of an example embodiment of lens retrofit which includes an example embodiment of optical film lens 3101 with a single edge truss on each edge, and four frame members 3111. The frame members may comprise aluminum-extruded tubing. Folded or roll formed construction may also be used if there may be some commercial advantage. A cross section cut-away view of one of the frame members 3111 may be shown in FIG. 31C, that may be representative of all four sides. Each edge truss 3102 of lens 3101 may insert into the attachment feature as shown, and the top edge of each edge truss may lock against edge truss retention feature 3120 in a similar manner to that previously described. The width and length of the lens 3101 and edge trusses 3102 may be configured wherein the appropriate amount of tension is created between opposing sides, as represented by tension forces X and Y in FIG. 31A. Increasing the dimensions may function to lower the applied tension, and decreasing the dimensions may function to increase tension.

Figure 31B:
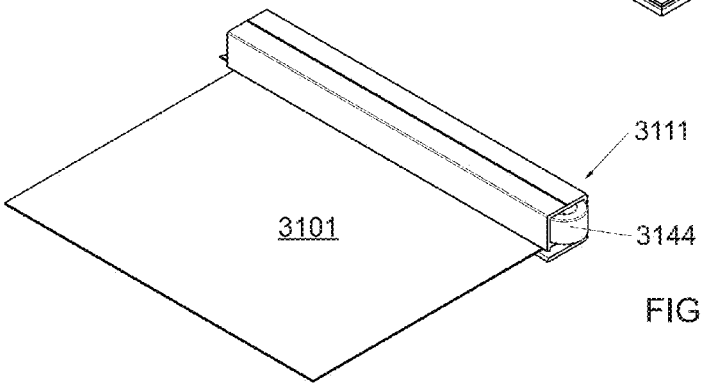
FIG. 31B depicts a perspective cut-away view of a portion of the frame member and lens shown in FIG. 31A.
Figure 31C:
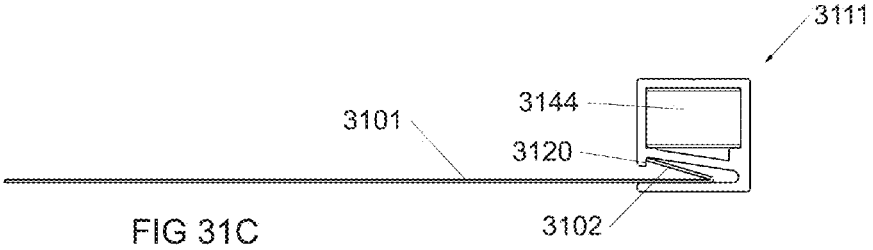
FIG. 31C depicts a side cut-away view of a portion of the frame member and lens shown in FIG. 31A.

The frame members 3111 may be joined at the corners with internal connectors (not shown), screws, or other fasteners or fastening methods. A magnet 3144 as shown in FIG. 31B and FIG. 31C may be inserted inside the frame members in each corner. The completed assembly as shown in FIG. 31A, when configured with appropriate dimensions for a particular parabolic troffer, may simply snap into the louver mounting ledges in the troffer, and be securely held by the magnetic attraction between the troffer and the internal magnets within the frame members.

Figure 32A:
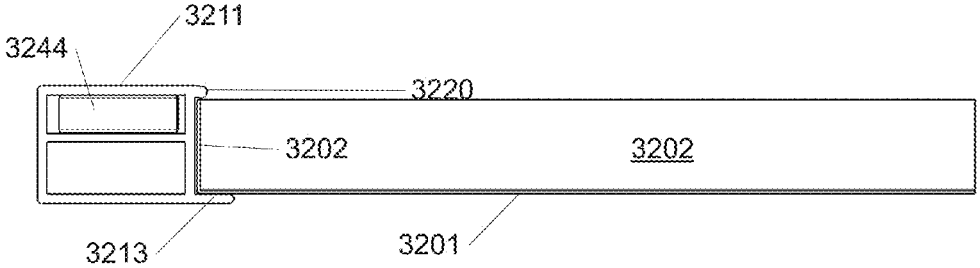
FIG. 32A depicts a side cut-away view of a portion of a frame member and lens from another example embodiment of light fixture retrofit lens assembly.
Figure 32B:
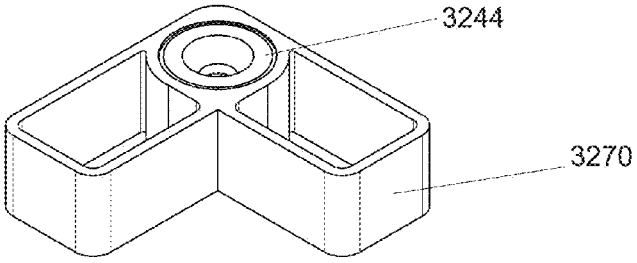
FIG. 32B depicts a perspective view of a frame corner connector from an example embodiment of light fixture retrofit lens assembly.

Example embodiments of retrofit lenses may also be configured utilizing other lens mounting methods previously described. FIG. 32A depicts a cut-away cross section view of a frame member 3211 with lens 3201 mounting in a similar manner as described with a light fixture doorframe mounted lens. Lens 3201 may be configured with one sided edge trusses 3202 on each edge of the lens. The front periphery of the lens 3201 may be disposed on a horizontal ledge 3213 of frame member 3211, and the top edge of the edge trusses 3202 may tuck underneath edge truss retention feature 3220. If additional tensioning of the lens is required, any appropriate tensioning method previously described may be utilized. Magnet 3244 may be inserted into each corner as previously described. Corner connectors 3270 similar to that shown in FIG. 32B may be utilized, wherein magnets 3244 may nest in holes configured in the connectors 3270.

Figure 33:
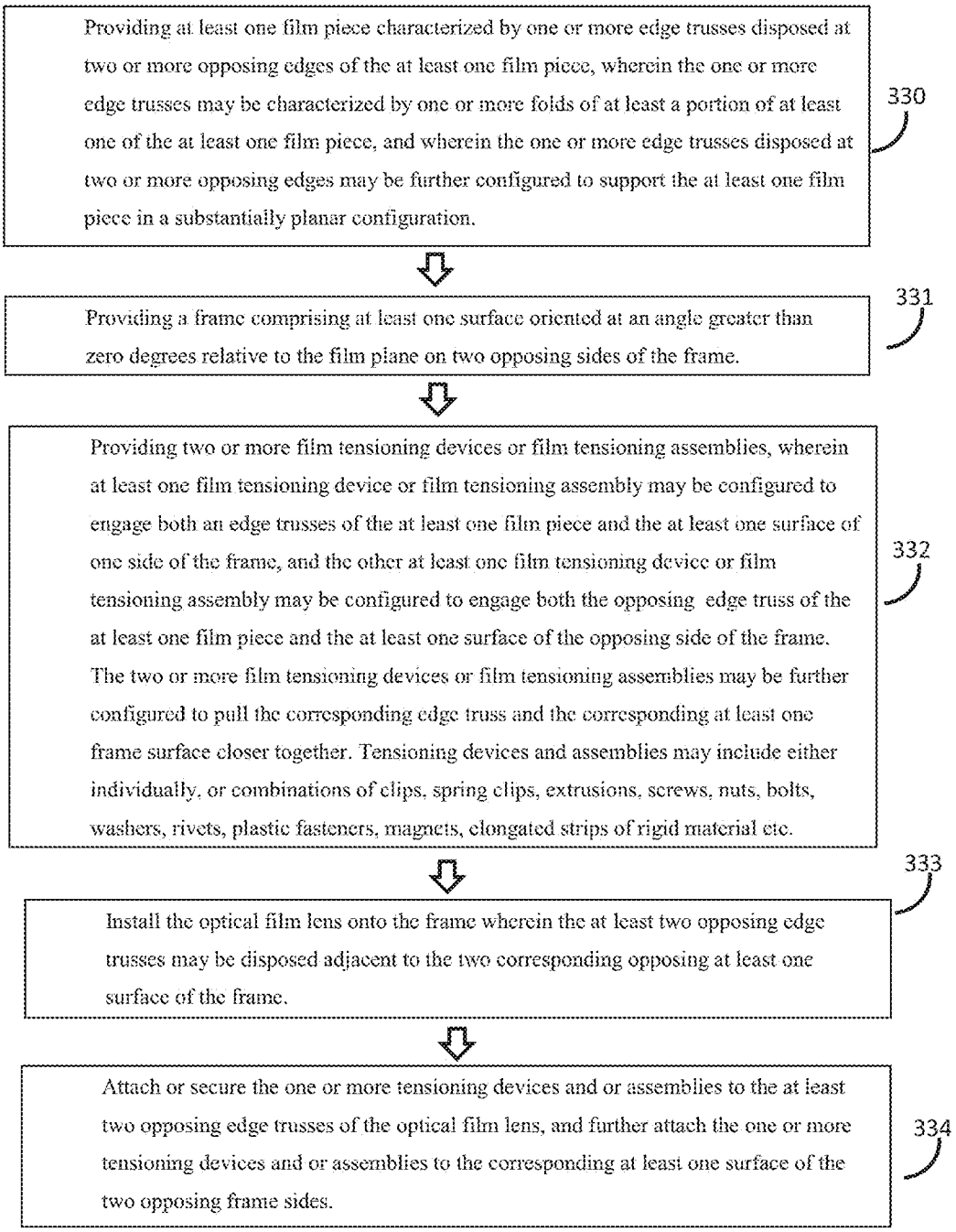
FIG. 33 depicts a block diagram of the method steps involved in an example embodiment of optical film tensioning method.

An example embodiment of a method of tensioning film may now be presented. The steps in the method are shown in FIG. 33, and may comprise:

a) As represented in block 330, providing at least one film piece characterized by one or more edge trusses disposed at two or more opposing edges of the at least one film piece, wherein the one or more edge trusses may be characterized by one or more folds of at least a portion of at least one of the at least one film piece, and wherein the one or more edge trusses disposed at two or more opposing edges may be further configured to support the at least one film piece in a substantially planar configuration.

As represented in block 331, providing a frame comprising at least one surface oriented at an angle greater than zero degrees relative to the film plane on two opposing sides of the frame.

As represented in block 332, providing two or more film tensioning devices or film tensioning assemblies, wherein at least one film tensioning device or film tensioning assembly may be configured to engage both an edge trusses of the at least one film piece and the at least one surface of one side of the frame, and the other at least one film tensioning device or film tensioning assembly may be configured to engage both the opposing edge truss of the at least one film piece and the at least one surface of the opposing side of the frame. The two or more film tensioning devices or film tensioning assemblies may be further configured to pull the corresponding edge truss and the corresponding at least one frame surface closer together. Tensioning devices and assemblies may include either individually, or combinations of clips, spring clips, extrusions, screws, nuts, bolts, washers, rivets, plastic fasteners, magnets, elongated strips of rigid material etc.

As represented in block 333, install the optical film lens onto the frame wherein the at least two opposing edge trusses may be disposed adjacent to the two corresponding opposing at least one surface of the frame.

As represented in block 334, attach or secure the one or more tensioning devices and or assemblies to the at least two opposing edge trusses of the optical film lens, and further attach the one or more tensioning devices and or assemblies to the corresponding at least one surface of the two opposing frame sides.

Figure 34:
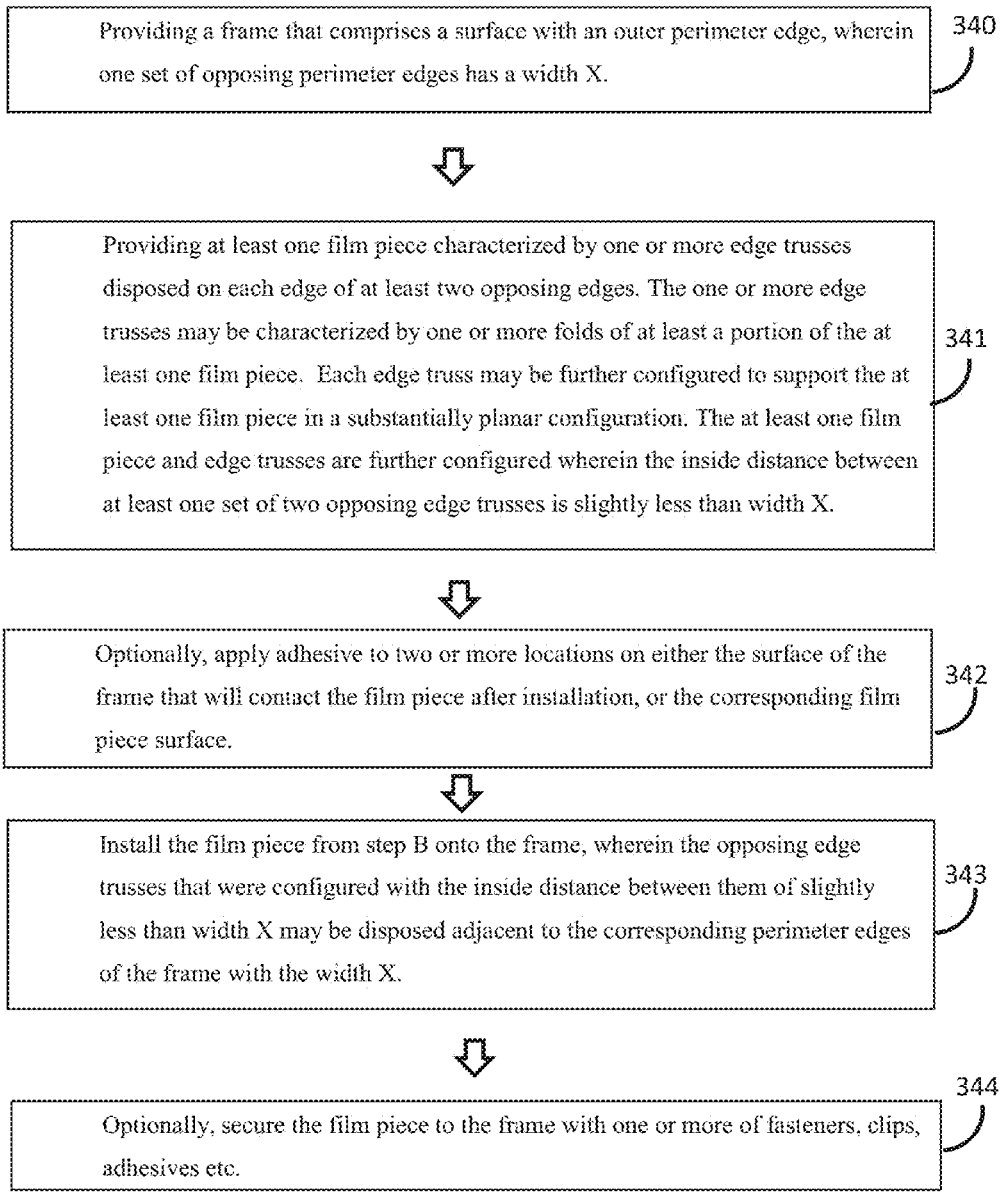
FIG. 34 depicts a block diagram of the method steps involved in another example embodiment of optical film tensioning method.

An example embodiment of a method of tensioning film may now be presented. The steps in the method may be shown in FIG. 34, and may comprise:

As represented in block 340, providing a frame that comprises a surface with an outer perimeter edge, wherein one set of opposing perimeter edges has a width X.

As represented in block 341, providing at least one film piece characterized by one or more edge trusses disposed on each edge of at least two opposing edges. The one or more edge trusses may be characterized by one or more folds of at least a portion of the at least one film piece. Each edge truss may be further configured to support the at least one film piece in a substantially planar configuration. The at least one film piece and edge trusses are further configured wherein the inside distance between at least one set of two opposing edge trusses is slightly less than width X.

As represented in block 342, optionally, apply adhesive to two or more locations on either the surface of the frame that will contact the film piece after installation, or the corresponding film piece surface.

As represented in block 343, install the film piece from step B onto the frame, wherein the opposing edge trusses that were configured with the inside distance between them of slightly less than width X may be disposed adjacent to the corresponding perimeter edges of the frame with the width X.

As represented in block 344, optionally, secure the film piece to the frame with one or more of fasteners, clips, adhesives etc.

Figure 35:
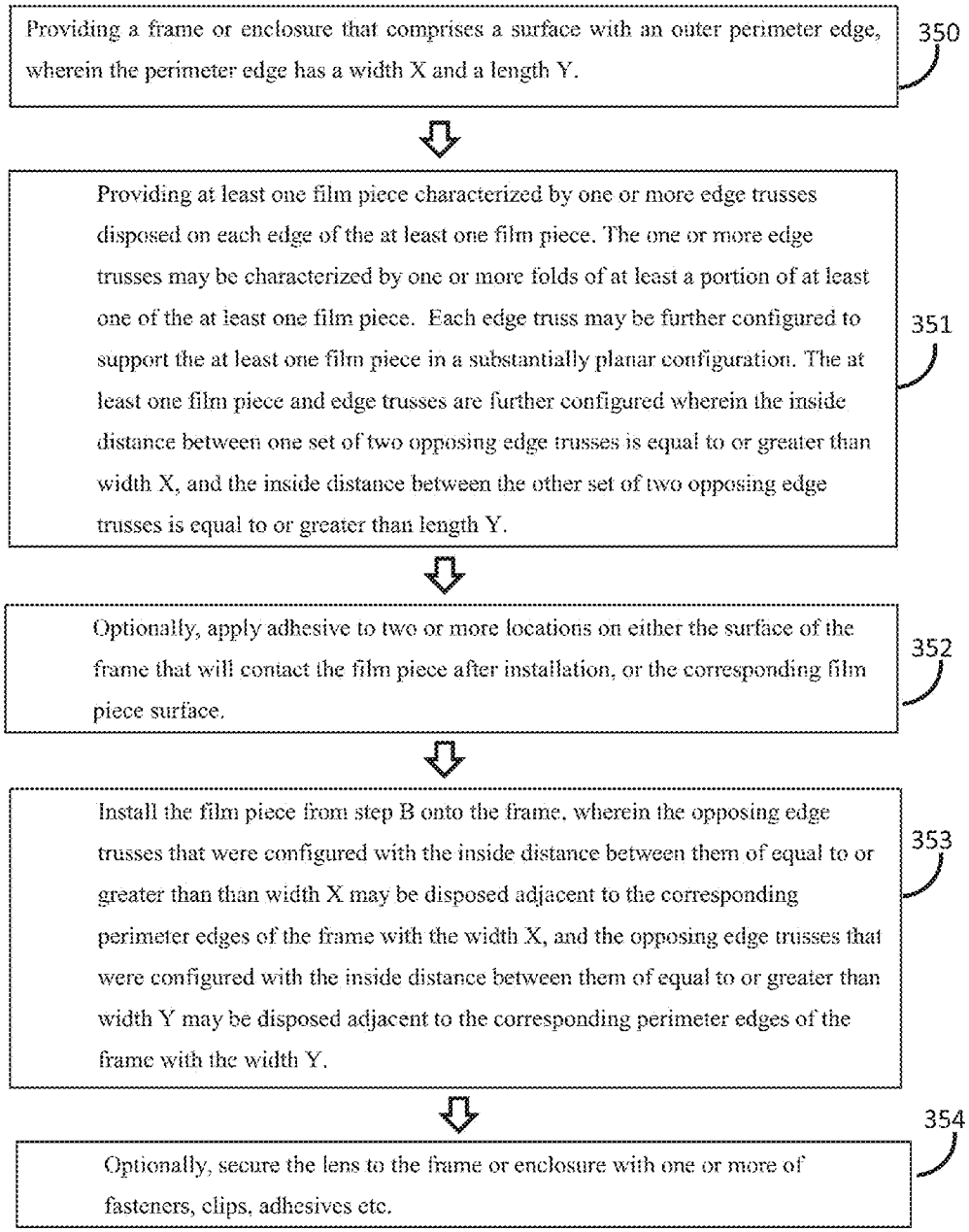
FIG. 35 depicts a block diagram of the method steps involved in an example embodiment of a method for mounting optical film lenses on a frame or enclosure.

An example embodiment of a method of mounting an optical film lens on a frame or enclosure will now be presented. The steps in the method may be shown in FIG. 35, and may comprise:

As represented in block 350, providing a frame or enclosure that comprises a surface with an outer perimeter edge, wherein the perimeter edge has a width X and a length Y.

As represented in block 351, providing at least one film piece characterized by one or more edge trusses disposed on each edge of the at least one film piece. The one or more edge trusses may be characterized by one or more folds of at least a portion of at least one of the at least one film piece. Each edge truss may be further configured to support the at least one film piece in a substantially planar configuration. The at least one film piece and edge trusses are further configured wherein the inside distance between one set of two opposing edge trusses is equal to or greater than width X, and the inside distance between the other set of two opposing edge trusses is equal to or greater than length Y.

As represented in block 352, optionally, apply adhesive to two or more locations on either the surface of the frame that will contact the film piece after installation, or the corresponding film piece surface.

As represented in block 353, install the film piece from step B onto the frame, wherein the opposing edge trusses that were configured with the inside distance between them of equal to or greater than width X may be disposed adjacent to the corresponding perimeter edges of the frame with the width X, and the opposing edge trusses that were configured with the inside distance between them of equal to or greater than width Y may be disposed adjacent to the corresponding perimeter edges of the frame with the width Y.

As represented in block 354, optionally, secure the lens to the frame or enclosure with one or more of fasteners, clips, adhesives etc.

An example embodiment of a method of attaching an edge of optical film lens onto a structure will now be presented. The steps in the method may be shown in FIG. 36, and may comprise:

As represented in block 360, providing a structure that comprises a channel, wherein the channel comprises at least a top and a bottom surface. The channel top or bottom may be configured with a protruding edge truss retention feature. The dimensions of the channel and edge truss retention feature may be configured to accommodate the edge of the optical film piece configured in block 361.

As represented in block 361, providing at least one film piece characterized by at least one edge truss disposed on one edge of at least one the at least one film piece. The at least one edge truss may be characterized by a fold of at least a portion of the optical film piece and includes an outer edge. The edge truss may be configured to the appropriate dimensions wherein the outer edge of the edge truss may contact the edge truss retention feature in the channel when fully inserted into the channel.

As represented in block 362, fully insert the edge of the at least one film piece with the configured edge truss into the channel of the structure, wherein the edge truss outer edge is oriented towards the edge truss retention feature in the channel, and wherein the outer edge of the edge truss contacts, and is retained by the edge truss retention feature in the channel.

An example embodiment of lens assembly may now be disclosed wherein an example embodiment of optical film lens may be supported with one or more example embodiments of novel film support devices, wherein the lens assembly when disposed horizontally, may be disposed in a substantially flat configuration without requiring an external frame. Example embodiments of film support devices may also function as light modifying elements.

A film support device may comprise any elongated structure attached to a lens surface that may function to reduce sag of the lenses surface. It may be beneficial that a lens support device be of a length that is about equal to, or somewhat less than the length of the lens it may be attached to. Example embodiments of film support devices that span the full length of a lens may impart greater support to the lens as compared to example embodiments that span less than the full length of the lens. The elongated structure should at least have sufficient elastic modulus to remain in a substantially planar configuration when suspended from each end. Preferably, one or more elongated structures may have sufficient elastic modulus to remain substantially planar when giving support to an example embodiment of optical film lens. An example embodiment of film support device may comprise any material that may have suitable elastic modulus and suitable weight for a given application. It may be preferable to utilize materials that have a high stiffness to weight ratio in order to obtain as thin a profile as possible in order to minimize shadows on the lens surface in example embodiments where the film support device may be mounted on the back light-receiving side of the lens surface. Shadows may be caused by light from one or more light sources within a light fixture that strike the film support device. In example embodiments where the film support device may be mounted on the front light-emitting side of the lens surface, a thin profile may also be preferable so the film support device does not protrude below the ceiling line. The material may comprise opaque, translucent or transparent materials. Transparent materials such as acrylic or polycarbonate my give a better aesthetic appeal as well as increased optical efficiency of the lens. An example of a translucent material that may be suitable may be an acrylic or polycarbonate with diffusion particles deposited on its surface, or embedded in the substrate.

An example embodiment of film support device may comprise any shape or size that may be aesthetically and or optically suitable for a particular application. It may comprise a flat profile, or a flat profile with strengthening ribs for example. For example, it may comprise any Fresnel or other lens profile and function to redistribute or diffuse light from a light source from within a light fixture. It may comprise a profile that may create refraction elements that may form a pattern or design on a lens surface, such as that shown in FIG. 12A for example.

An example embodiment of film support device may attach to an optical film lens with an adhesive or lamination. The adhesive or lamination may be applied either to the attachment surface of the film support device, or to the optical film lens, or both. In example embodiments of film support devices that comprise multiple attachment surfaces, it may be preferable to apply the adhesive or lamination to the attachment surfaces of the film support device. The attachment surfaces of the film support device may include a surface texture or pattern that may function to obscure or blend the appearance of the adhesive or lamination visible through the optical film. When an example embodiment of film support device with multiple attachment surfaces may be attached to a lens with adhesives or lamination applied to only some of the attachment surfaces, the contact area between the attachment surfaces of the film support device and the lens surface may look visually differently in the contact areas with adhesives or lamination, as compared to contact areas without adhesives or lamination. This difference may be used to advantage to give a visual accent or differentiation to that area compared to other contact areas without the adhesives or lamination. Alternatively, the adhesives or lamination may be applied evenly to all the attachment surfaces. Example embodiments of film support devices may be attached to optical film lenses using any other suitable method that may be visually suitable. For example, thermo-bonding methods may be utilized if visually acceptable. Fasteners such as screws, clips or rivets may also be utilized, and may be fastened through the lens face or through a lens edge truss.

Any example embodiments of film support devices may also attach to, or support an optical film lens on the front light-emitting side of the lens. In such configurations, attachment to the lens utilizing adhesives or lamination may only require the adhesive or lamination to only be applied near the ends of the film support device since the lens face may be disposed on top of, and supported by the film support devices, wherein gravity may cause the lens surface to sufficiently contact the film support device. This may advantageously lower manufacturing costs and may be visually more appealing in some applications. Alternatively, thin end panels, perhaps utilizing the same substrate as the film support devices, may be glued or fastened to the ends of the film support devices, and to the corresponding sides of the edges trusses of the lens, wherein no adhesives or lamination may be required on the light-emitting lens face. Any other means for fastening the film support devices to the optical film lens may be utilized that may provide acceptably secure attachment and be visually acceptable.

Figure 37A:
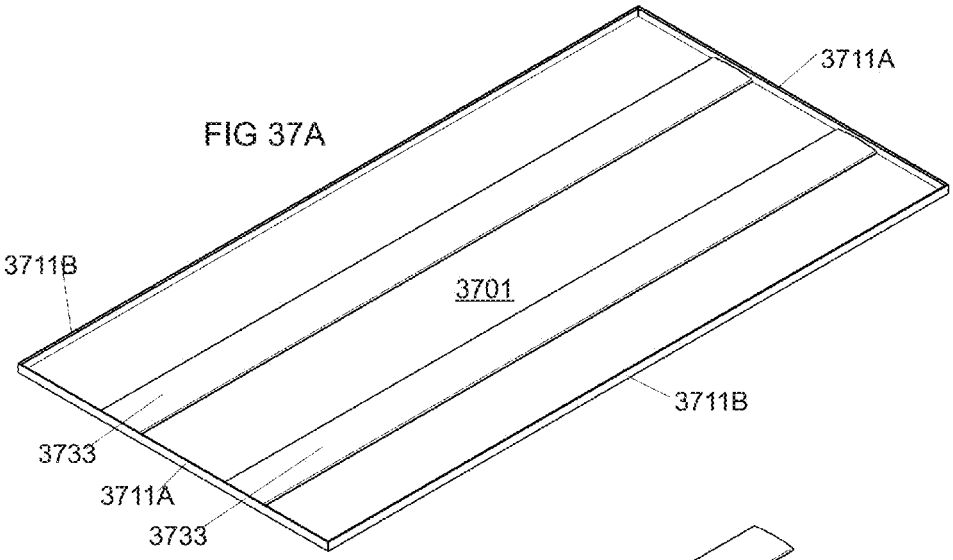
FIG. 37A depicts a perspective view of an example embodiment of optical film lens mounted in a light fixture doorframe, along with two example embodiments of film support devices mounted on the lens.
Figure 37B:
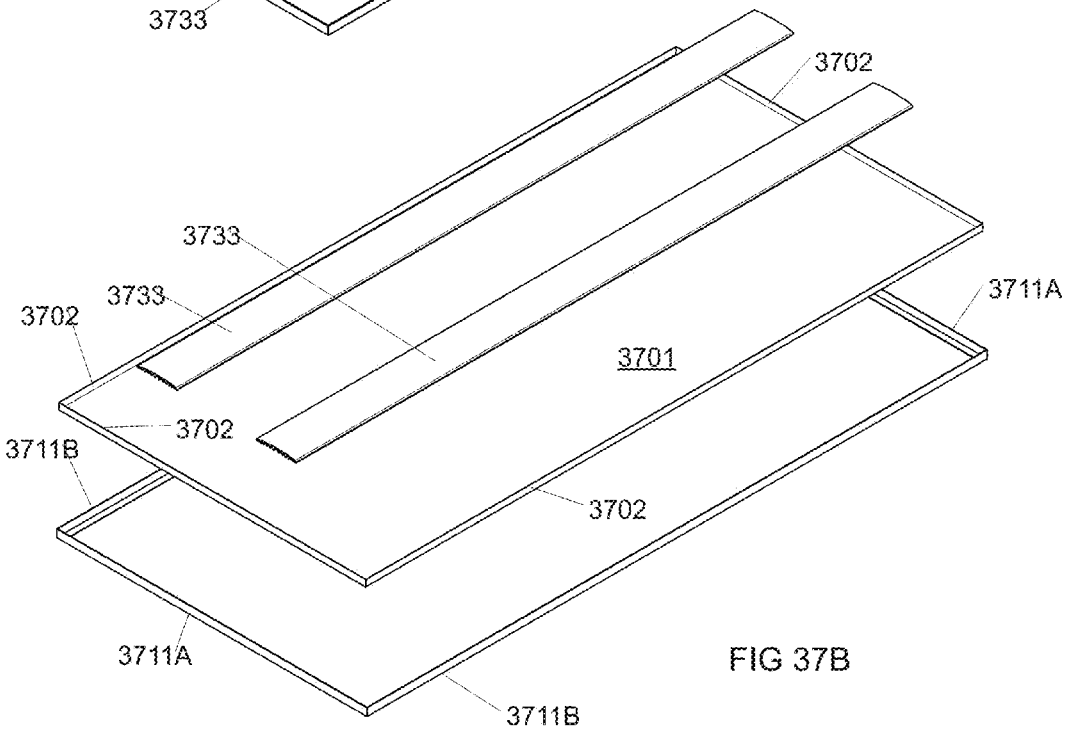
FIG. 37B depicts an exploded perspective view of the example embodiment of optical film lens mounted in a light fixture doorframe, along with two example embodiments of film support devices mounted on the lens as shown in FIG. 37A.

FIG. 37A may show an example embodiment of optical film lens 3701 with four edge trusses 3702 (FIG. 37B) mounted in a frame with four frame members comprising frame members 3711A and 3711B, that may be substantially similar to that shown and described in FIG. 21. FIG. 37B may show an exploded perspective view of the same. Two film support devices 3733 may attach to the back light-receiving side of the optical film lens 3701.

When an example embodiment of film support device 3733 may be attached as described to an example embodiment of optical film lens 3701 as shown in FIG. 37A, sagging of the lens 3701 may be significantly reduced. Each end of both film support devices 3733 may be supported on the corresponding film surface of the ends of the lens 3701 that may in turn be supported by the frame members 3711A. By virtue of the film support devices having sufficient elastic modulus to be disposed in a substantially planar configuration, and the attachment of the lens 3701 to the film support devices as described, the lens may thus receive a significant degree of support, which may significantly reduce sagging of the lens 3701. As previously described with example embodiments of film tensioning assemblies and devices, this additional support imparted to an optical film lens may enable the use lighter gauges of optical film, which may save on manufacturing costs.

Example embodiments of film support devices may be configured to be thin and light enough wherein they may provide a small degree of sag that may match the small degree of inherent sag between the film support devices and the edges of the lens. This may provide a smoother visual transition from one edge of the lens to the other with minimal dips or distortions.

Examples embodiments of lens assemblies may include any optical film light modifying elements or example embodiments of optical film lenses described in this application, or described in related applications. For example, example embodiments of frameless optical film lenses as described in related applications may be utilized, wherein the frameless lenses may attach to a light emitting device without a frame, and may be suspended in a substantially planar configuration therein.

Figure 38A:
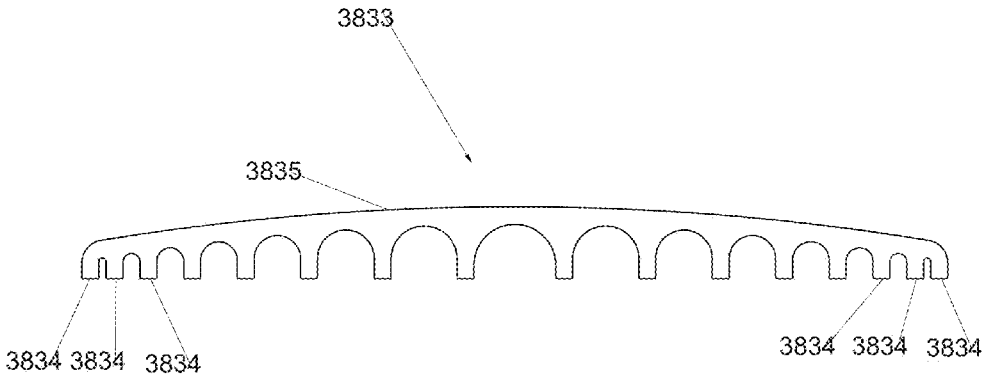
FIG. 38A depicts a side profile view of an example embodiment of film support device.
Figure 38B:
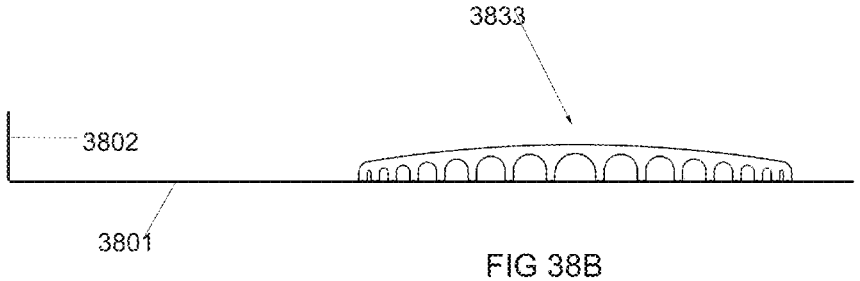
FIG. 38B depicts a side profile view of an example embodiment of film support device mounted on a section of an example embodiment of optical film lens.

An example embodiment of film support device may be shown in FIG. 38A. The film support device 3833 may comprise an acrylic material for example, and may comprise a top light-receiving side 3835 and attachment surfaces 3834. Although the numeric indicators 3834 indicates particular surfaces as shown, the attachment surface may comprise any or all of the adjacent co-planar surfaces. FIG. 38B may show a side cut-away view of a section of an example embodiment of lens assembly which includes the example embodiment of film support device shown in FIG. 38A, which may be mounted on the back light-receiving side of an example embodiment of optical film lens 3801, which includes edge truss 3802. Adhesives or lamination may be applied to the attachment surfaces 3834 as shown in FIG. 38A, or adhesive or lamination may be applied to all the attachment surfaces, or to the lens 3801, and the film support device may be subsequently attached to the lens 3801.

Figure 38C:
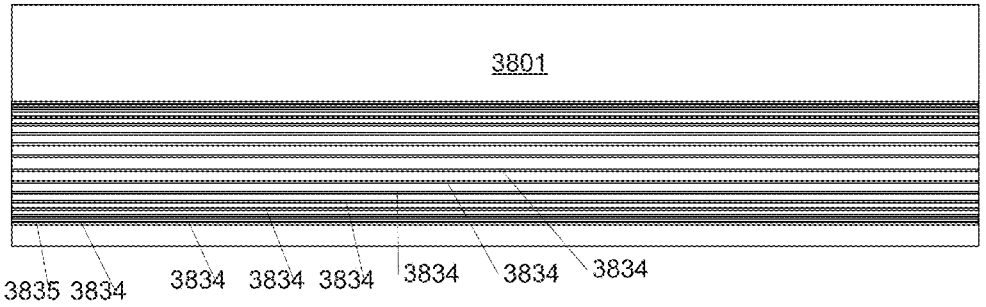
FIG. 38C depicts a plan view of the example embodiment of film support device mounted on a section of an example embodiment of optical film lens as shown in FIG. 38B.

FIG. 38C may show a plan view of a section of the front light-emitting surface of the optical film lens 3801 with the film support device 3833 mounted on the backside of the lens. When a light source may be disposed behind the film support device 3833, the film support device 3833 may form a refraction design feature on the lens as indicated by numeric indicators 3735 (for brevity, only one half of the linear refraction features were indicated). This refraction design feature may be visually pleasing, and may also function to obscure the lamp image. In the case of a linear LED light source, this obscuring of the light source may be especially beneficial.

Figure 39A:
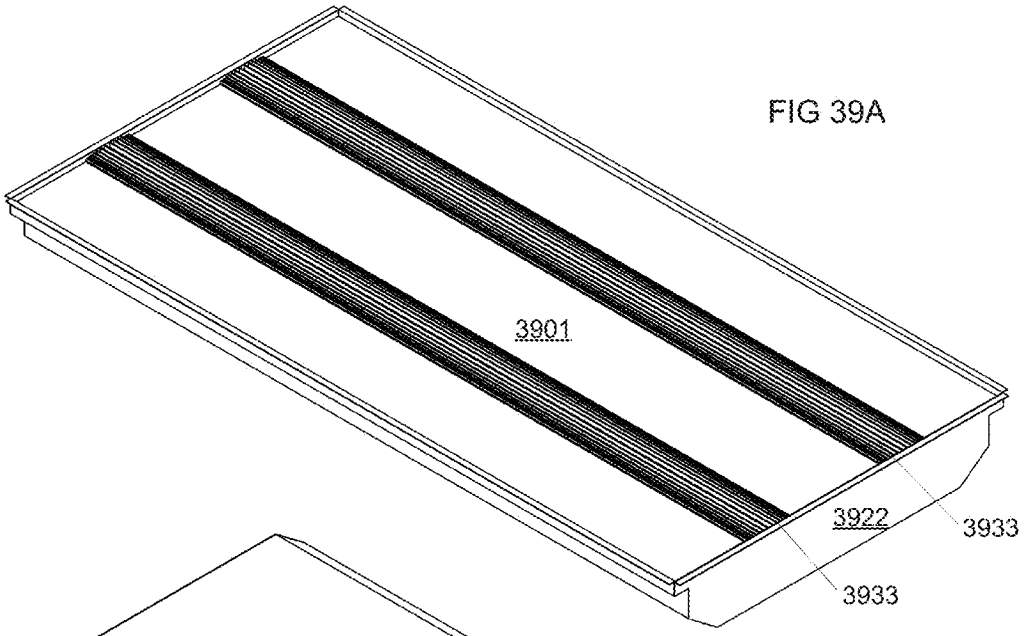
FIG. 39A depicts a perspective view of an example embodiment of retrofit lens assembly mounted in a light fixture, the retrofit lens assembly comprising two example embodiments of film support devices mounted on an example embodiment of frameless optic film lens.
Figure 39B:
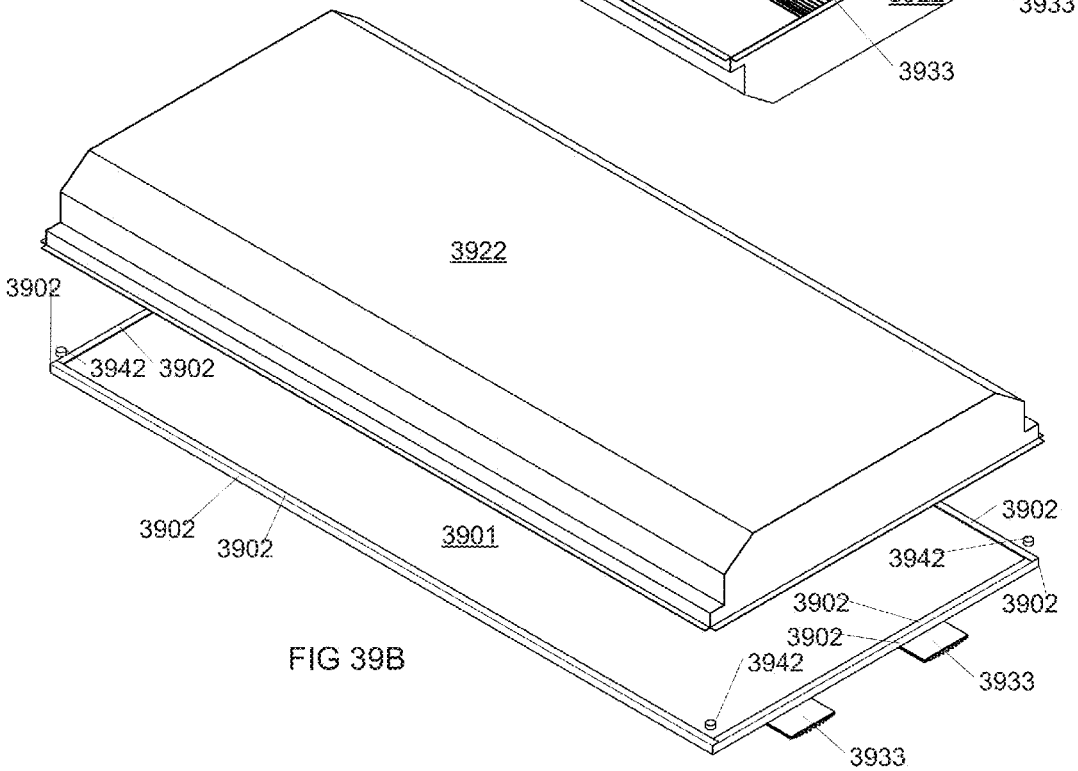
FIG. 39B depicts an upside down exploded perspective view of the example embodiment of retrofit lens assembly mounted in a light fixture, the retrofit lens assembly comprising two example embodiments of film support devices mounted on an example embodiment of frameless optic film lens as shown in FIG. 39A.

FIG. 39A may show a perspective view of an example embodiment of a retrofit lens assembly mounted on a troffer light fixture. FIG. 39B may show an upside-down exploded view of the same. The lens 3901 may comprise a frameless optical film lens as described in related applications, and may comprise two edge trusses 3902 on each edge of the lens 3901. Example embodiments of film support devices 3933 may attach to the front light-emitting surface of the lens 3901 in any manner as previously described, and may comprise any configuration as previously described. FIG. 40 may show a side profile view of the example embodiment of film support device as shown in FIGS. 39A and 39B, and may include a light receiving surface 4035 that may contact the light-emitting front surface of the lens 3901 in FIG. 39A and FIG. 39B.

Referring to FIG. 39B, magnets 3942 may mount in each corner of the lens 3901 and attach to the lens 3901 using any suitable attachment means, such as fasteners, clips, rivets or adhesives for example. The magnets may enable the retrofit lens assembly to attach to a light fixture because the majority of troffers may be fabricated with steel. In troffer retrofit applications where the troffer is being retrofitted with LEDs to replace linear fluorescent tubes, the troffer may comprise a doorframe that may include a prismatic lens, or the troffer may be a parabolic troffer with a louver assembly. The example embodiment of lens assembly may enable the louver or doorframe assemblies to be discarded, and the example embodiment of retrofit lens assembly may nest in the perimeter channel of the light fixture where the louver or doorframe may have previously nested, and do so without an external frame. This may enable a very low cost and quick lens replacement retrofit, that may function to replace outdated prismatic lenses and louvers that may no longer function adequately with an LED light source.

Figure 40A:
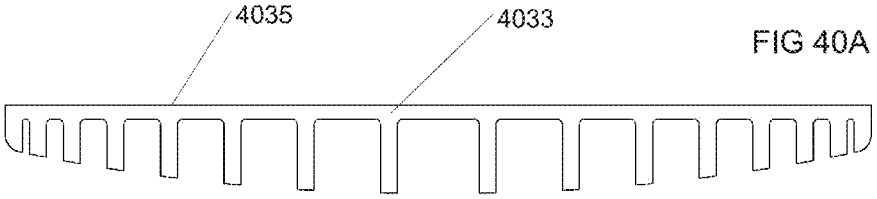
FIG. 40A depicts a side profile view of the example embodiment of film support device shown in FIG. 39A and FIG. 39B.
Figure 40B:
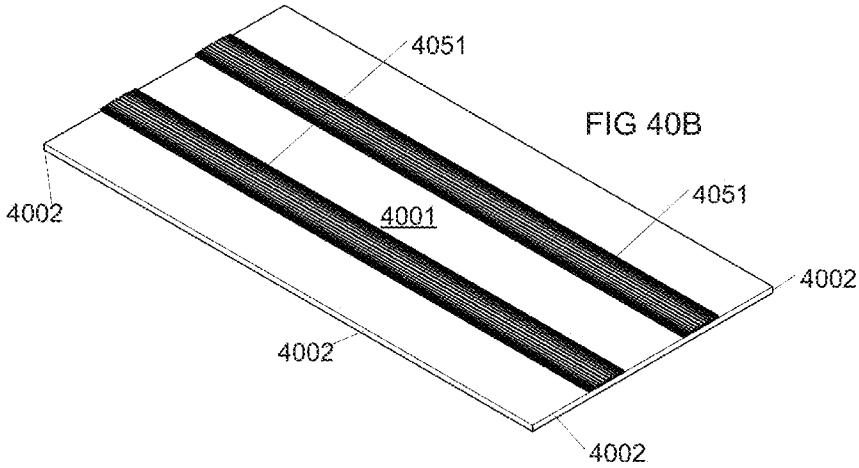
FIG. 40B depicts a perspective view of an example embodiment of retrofit lens assembly comprising two example embodiments of film support devices mounted on an example embodiment of frameless optic film lens.
Figure 40C:
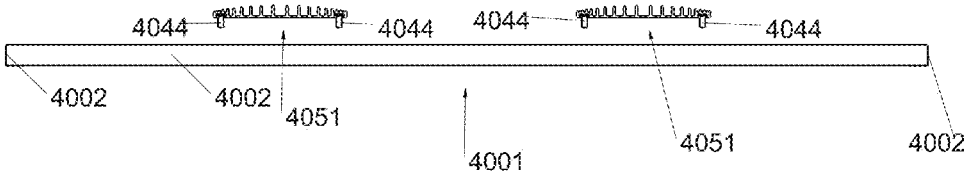
FIG. 40C depicts an exploded side profile view of the example embodiment of retrofit lens assembly comprising two example embodiments of film support devices mounted on an example embodiment of frameless optic film lens as shown in FIG. 40B.
Figure 40D:
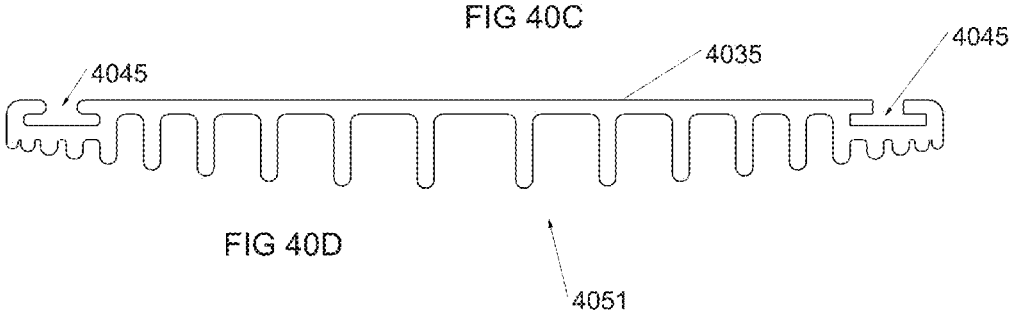
FIG. 40D depicts a side profile view of the example embodiment of film support device as shown in FIG. 40B and FIG. 40C.

An example embodiment of lens assembly with example embodiments of film support devices may be shown in FIG. 40B and FIG. 40C. FIG. 40B may show a perspective view of the top light-emitting side of an example embodiment of frameless optic film lens 4001, with edge trusses 4002, and with two film support devices 4051 disposed on the surface of the lens 4001. FIG. 40C may show a side exploded view of the same. Fasteners 4044 may comprise any fastener as previously described, such as a clear plastic rivet for example as shown. The rivet heads may nest in channels 4045 in the film support devices 4051 as shown in a side view in FIG. 40D. Surface 4035 may be disposed on the light-emitting surface of the lens 4001 when installed, and the rivets 4044 may protrude through holes (not shown) in the lens surface, thereby securely attaching the film support devices 4051 to the lens 4001 (FIG. 40B). Adhesives or plugs etc. may be subsequently inserted into the channel 4045 (FIG. 40D) to secure the film support devices 4051 from lateral movement after installation.

According to various implementations of the disclosed technology, a light emitting device may be provided. The light emitting device may comprise an enclosure that comprises a back surface, four sides, a top edge surface associated with each of the four sides, and an opening defined by the four sides. The top edge surfaces may be disposed adjacent to the opening. The enclosure may be capable of mounting on a grid frame of a suspended ceiling such that a portion of the top edge surface of at least two of the four sides contacts a portion of the grid frame. The light emitting device may further comprise a light modifying element capable of modifying light from a light source. The light modifying element may be characterized by a substrate with four or more edges, a light-receiving back surface disposed on the entirety of, or a portion of the top edge surface of each of the four sides of the enclosure, and a light-emitting front surface. All or a portion of a periphery of the light-emitting front surface may be capable of contacting, or being disposed in close proximity to the grid frame after the light emitting device is mounted to the grid frame.

In the example implementation, the light modifying element of the light emitting device may be further characterized by at least one film piece with at least one supporting edge truss on at least two opposing edges of the at least one film piece. Each supporting edge truss may be configured from a corresponding fold in the at least one film piece, wherein the supporting edge trusses may be angled towards the light-receiving back surface. The supporting edge trusses on the at least two opposing sides of the light modifying element may be disposed outside the area defined by an outer perimeter of the top edge surfaces of the enclosure sides.

In the example implementation, the light emitting device may be further defined by an outer perimeter edge of each of a first two opposing top edge surfaces of the enclosure sides defining a width W of the enclosure equal to a distance X. The light modifying element may be further defined by at least one film piece with at least one supporting edge truss on at least two opposing edges of the at least one film piece, wherein each edge truss may be configured from a corresponding fold in the at least one film piece. Each supporting edge truss may be angled towards the light-receiving back surface wherein the distance between the at least two opposing edge truss folds may be less than the distance X, therein causing the at least two opposing edge trusses to be forced laterally apart and therein creating tension across the light modifying element.

In the example implementation, the light modifying element may be further characterized by a rigid or semi-rigid clear or translucent substrate.

In the example implementation, the light modifying element may be attached to the top edge surface of one or more sides of the enclosure with an adhesive or fasteners.

In the example implementation, the enclosure may comprise at least a portion of a troffer light fixture.

According to various implementations of the disclosed technology, a substrate attachment system may be provided. The substrate attachment system may comprise a substrate having a first surface configured with at least one supporting edge truss configured from a corresponding fold in the substrate. The fold may be adjacent to a least one edge of the substrate, wherein the at least one supporting edge truss may be configured at an angle relative to the first surface, and wherein the at least one supporting edge truss may include an outer perimeter edge. The example embodiment of a substrate attachment system may further comprise at least one elongated frame member with a cross section comprising at least two segments, wherein the at least two segments may define at least a first surface and an adjacent second surface. The adjacent second surface may further comprise an edge truss retention feature. The substrate may be capable of being attached to the at least one elongated frame member such that the first surface of the substrate may be disposed on the first surface of the at least two frame segments, and the outer perimeter edge of the edge truss may be engaged by the edge truss retention feature on the adjacent second surface of the at least two frame segments.

In the example embodiment, the substrate may comprise an optical film.

In the example embodiment, the substrate may comprise sheet metal.

In the example embodiment, the substrate may comprise a reflective substrate.

According to various implementations of the disclosed technology, a film tensioning system may be provided. The film tensioning system may comprise at least one film piece defining a film plane, and may be characterized by at least one supporting edge truss on two or more opposing edges of the at least one film piece. Each supporting edge truss may be configured from a corresponding fold in the at least one film piece, wherein each supporting edge truss is further configured to assist in the support of the at least one film piece in a substantially planar configuration. The film tensioning system may further comprise a frame comprising at least one film attachment surface on each of two opposing sides of the frame, wherein the film attachment surface may be oriented at an angle relative to the film plane. At least one film tensioning device may engage both a supporting edge truss of the at least one film piece and the at least one film attachment surface of one side of the frame. Another at least one film tensioning device may engage both the opposing supporting edge truss of the at least one film piece and the at least one film attachment surface of the opposing side of the frame. Each film tensioning device may be configured to pull a corresponding supporting edge truss and a film attachment surface closer together to impart tension within the at least one film piece.

In the example embodiment of film tensioning system, each film-tensioning device may comprise one or more of clips, spring clips, extrusions, screws, washers, nuts, bolts, rivets, plastic fasteners, magnets, or one or more elongated strips or extrusions of rigid or semi-rigid material.

In the example embodiment of film-tensioning system, the frame may comprise a light fixture doorframe.

In the example embodiment of film-tensioning system, the at least one film piece may be characterized by an optical film configured to modify light.

The example embodiment of film-tensioning system may further comprise two film-tensioning devices attached to the corresponding supporting edge trusses and film attachment surfaces on each of two opposing sides of the frame.

According to various implementations of the disclosed technology, a lens assembly may be provided. The lens assembly may comprise an elongated structure comprising at least two opposing attachment features, wherein each of the at least two opposing attachment features may comprise at least a first surface and an adjacent second surface, and wherein the adjacent second surface may further comprise an edge truss retention feature. The lens assembly may further comprise at least one optical film piece defining an aperture plane and may have a first surface configured with at least one supporting edge truss on at least two opposing edges of the optical film piece. The at least one supporting edge truss may be configured from a corresponding fold in the at least one optical film piece, wherein the fold may be adjacent to at least one edge of the at least one optical film piece. The at least one supporting edge truss may be configured at an angle relative to the aperture plane, wherein each supporting edge truss may include an outer perimeter edge. At least one optical film piece may be capable of attachment to the elongated frame member such that a portion of the first surface of the optical film piece may be disposed on the first surfaces of the at least two opposing attachment features, and the outer perimeter edge of each opposing supporting edge truss may be capable of engaging with the corresponding edge truss retention feature wherein the aperture plane may form a curve.

The example implementation of lens assembly may further comprise one or more linear LED arrays. In the example implementation of lens assembly, the elongated structure and the at least one optical film piece may be further configured for use with a light emitting device.

The example implementation of lens assembly may further comprise one or more linear LED arrays, wherein the lens assembly may be a retrofit LED lighting module configured to retrofit in a light fixture. In the example implementation of lens assembly, the elongated structure may be capable of dissipating heat from one or more linear LED arrays.

In example embodiments, substrate tensioning systems may be described that may allow substrates to be suspended in a substantially flat configuration on low cost and lightweight frames with very thin frame member profiles, such that other than the substrate and the frame, the systems do not require any fasteners, parts, or external tensioning devices. In example embodiments, substantially all of the substrate's edges may be securely locked within frame member channels, thereby creating an extremely robust, secure and professional looking substrate tensioning assembly that requires only a frame and a substrate, with no other parts. In example embodiments, substrates may be able to be utilized that may be substantially thinner than those utilized in other example embodiments relating to flat optical film lenses as described in related applications. In example embodiments, substrate tensioning systems may suspend substrates in substantially flat configurations with very low tensioning force, which may allow for extremely thin lightweight frames to be utilized. In certain example embodiments, a frame profile as thin as ¼" may be utilized. In example embodiments, substrates may form a seal with corresponding frame members which may function to keep dirt, dust and insects etc. from entering the inside of an enclosure. In example embodiments, substrate tensioning systems may be described which may allow a substrate to be suspended such that the plane of the substrate may be disposed directly on a top surface of a frame without any protrusions above the substrate plane. This may be advantageous in certain applications such as displays, wherein the plane of optical film (or film stack) may be located in closer proximity, or directly contacting the viewing screen, perhaps allowing for a thinner display profile, or increased viewing surface area. In an example embodiment, frame elements from a substrate tensioning system may be integrally incorporated into the structure of an enclosure, which may lower or substantially eliminate the manufacturing cost of separate frame members and connectors.

Figure 41A:
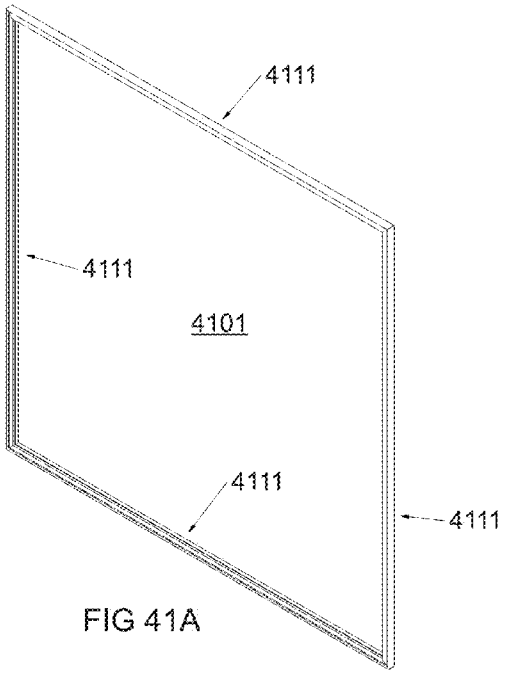
FIG. 41A shows a perspective view of an example embodiment of substrate tensioning system comprising a frame and a substrate.

In an example embodiment, FIG. 41A shows a frame configured from four frame members 4111, wherein each frame member 4111 may attach to adjacent frame members with connectors, therein forming a four-sided frame. Frame members may comprise any suitable material, such as metals, plastics, carbon fiber etc. In example embodiments, the frame members may be fabricated utilizing any suitable method such as roll forming, stamping or extruding for example. Extruded profiles may allow greater design flexibility with regards to form and strength compared to other methods. Extruded aluminum profiles may provide a high strength to weight ratio at a relative low cost, and therefore may be an exemplary choice for frame members in example embodiments. In example embodiments, frames may comprise more than four sides. In example embodiments, any alternate configuration of frame may utilized that may be advantageous for a particular application, provided the frame includes the required elements to adequately engage an example embodiment of substrate as may be subsequently described.

In an example embodiment, frame members may be configured similarly to that shown in FIG. 42A, which shows a side cut-away view of two opposing sides of the tensioning system. Certain elements indicated on the left side of the drawing that are identical to their opposing corresponding elements on the right side may not be indicated for simplification purposes. Frame members 4211 may comprise substrate attachment channels 4290 configured to nest the edge trusses 4202 of the substrate 4201B within the channels. Frame members 4211 may be configured with a first surface 4212, at least a second surface 4213, and an edge truss retention feature 4220 configured to engage a perimeter edge 4221 of the edge truss 4202 of the substrate 4201B. In an example embodiment, the perimeter edge 4221 of the edge truss 4202 of the substrate 4201B may become engaged, lodged and secured by the edge truss retention feature 4220 after insertion into the channel 4290, therein locking the edge truss 4202 inside the channel 4290.

In example embodiments, a substrate may comprise any suitable substrate as previously described, which may include any substrate suitable for a given application, provided the substrate has suitable mechanical properties to allow attachment to frame members, that will allow tensioning as described. In addition to example embodiments being utilized as lens assemblies comprising optical films, example embodiments may be utilized as panels with translucent or opaque substrates that utilize various substrates such as thin aluminum, plastics, carbon fiber, textiles etc.

Figure 41B:
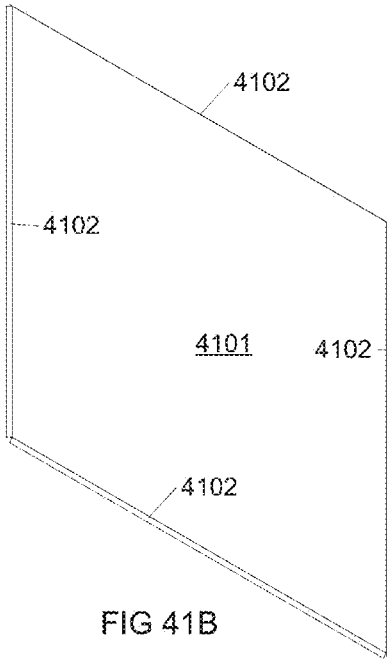
FIG. 41B shows a perspective view of the example embodiment of substrate with edge trusses as shown in FIG. 41A.
Figure 41C:
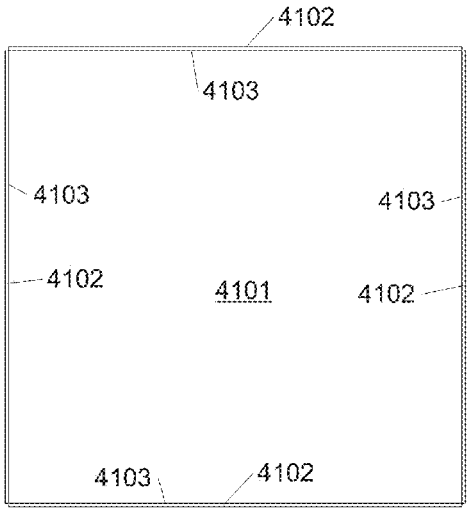
FIG. 41C shows a plan view of the example embodiment of substrate with edge trusses shown in FIG. 41A.
Figure 41D:
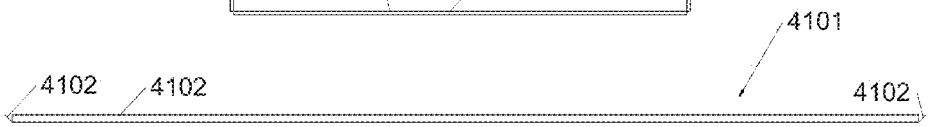
FIG. 41D shows a side view of the example embodiment of substrate with edge trusses shown in FIG. 41A.
Figure 42C:
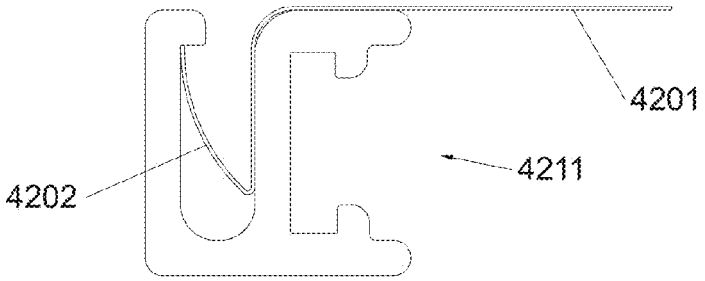
FIG. 42C shows a side cutaway view of a small section of one edge of the example embodiment of substrate tension system shown in FIG. 41A, and shows edge truss deflection.
Figure 42D:
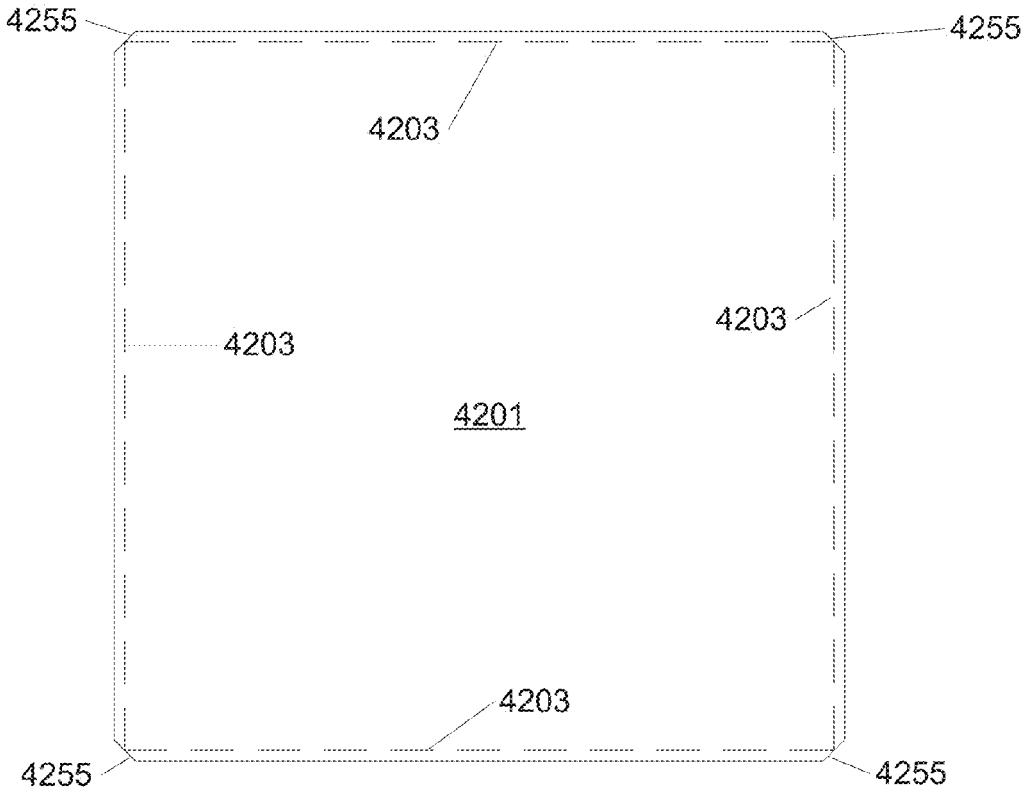
FIG. 42D shows a substrate cutting template for the example embodiment of substrate comprising one edge truss on each major edge as shown in FIG. 41C.

In an example embodiment, the substrate may be configured as shown in FIG. 41B, FIGS. 41C and 41D, wherein the substrate 4101 may be configured with edge trusses 4102 created along folds 4103 as shown in FIG. 41C. In example embodiments, the folds may be created in any manner previously described in this application, or related applications, such as folding the substrate along score lines or perforated lines, or utilizing mechanical folding machines that do not require score lines or perforated lines to create precise folds. The angle of the folds should be sufficiently large so that there is sufficient elastic tension created within the edge truss fold region when it is compressed within the channel 4290, that the perimeter edges of the edge trusses will be forced against the second surface 4213, and engaged by the edge truss retention features 4220 as shown in FIG. 42A. FIG. 42D shows a cutting template for a substrate similar to that shown in FIG. 41B through FIG. 41D. In an example embodiment, the substrate 4201 includes perforated lines 4203, wherein folds may be created along the perforated lines 4203. Corner cut-outs may be created along cut lines 4255. In an example embodiment, forty five degree angles of the cut lines 4255 may allow easier installation of the substrate onto a frame, however any other corner cut line angles may also be used that may provide suitable results, such as 90 degree angles for example, which may form a square corner cut-out. A square corner cutout pattern may allow increased tension in the corner regions due to the increased length of edge truss perimeter contacting the frame channel compared to corner cutouts with 45 degree cut lines, which may be advantageous in applications where increased resistance to substrate tension is required in the corner regions. In an example embodiment for example, where the frame members undergo deflection due to high tension in the substrate, there may be more tension in the substrate corner regions than in the central regions along each edge of the substrate. In such cases, increased resistance to substrate tension in the corner regions may prevent the edge trusses from reaching their limit of deflection, or from pulling out of the frame.

Again referring to the profile cut-away view in FIG. 42A, in an example embodiment, the substrate 4201A may be shown in its un-mounted state (as shown in FIG. 41B through 41D) with the edge trusses 4202 configured along folds 4203. The substrate 4201A may be dimensionally configured such that the total span of the substrate with edge trusses may be slightly smaller than the span between the opposing frame member elements that the substrate is forced to conform to, and be engaged by. The dimensions of the substrate may be configured larger or smaller, which may function to decrease, or increase tension within the substrate respectively after attachment to the frame system.

One side of the substrate may be inserted sufficiently deep into the channel 4290 of the corresponding frame member 4211 as shown by the left arrow, wherein the perimeter edge 4220 of the edge truss 4202 may engage against the edge truss retention feature 4220, and the substrate 4201B may become lodged against the frame member first surface 4212, wherein the edge truss and abutting section of the substrate 4201B may become securely lodged and "locked" within the channel 4290.

A simple installation tool may be utilized to insert the edge trusses 4202 into the channels 4290 of frame members 4211. An example tool is shown in FIG. 42B. The installation tool 4263 with a triangular shaped head 4264 can be inserted between the substrate 4201 and the edge truss 4202, and inserted into the channel 4290 in the general direction as shown by the arrow. The tool may be any practical length, but a tool that is a similar length to the entire length of the edge truss it will be used with may enable quicker and more efficient installation. The triangular head 4264 may force the edge truss 4202 to flex outward after insertion, which may ensure that the edge truss 4202 becomes engaged by the edge truss retention feature, and is evenly seated without distortions along its full length in the channel. In a similar manner as described, the edge truss from an adjacent edge of the substrate may be inserted into the channel of the corresponding frame member. Subsequently, a third edge of the substrate which may be adjacent to the first edge of the substrate may be inserted into the channel of the corresponding frame member. The final edge of the substrate may subsequently be installed as previously described.

In an example embodiment, FIG. 42F shows a system configuration that may be identical to that shown in FIG. 42A. Certain elements indicated on the left side of the drawing that are identical to their opposing corresponding elements on the right side may not be indicated for simplification purposes. The substrate 4201A with the length L between opposing edge trusses, when installed on the frame as shown by 4201B, may create an initial tension IT in the substrate 4201B. If the substrate 4201C, which may be identical to substrate 4201B except for a shorter length L− between opposing edge trusses, is installed on the same frame, the subsequent tension in the substrate 4201C may be IT+ which may be greater than IT. This may be due to the shorter length of substrate L− being forced to span the same distance between the same frame members.

Most frames, especially thinner frames, which may be more cost effective and compact, will exhibit some deflection of its frame members. This deflection may provide a means of tensioning substrates in addition to tensioning means that may be subsequently described, and may be advantageous to example embodiments of substrate tensioning systems. In example embodiments, frame members may comprise a slight outward bow similar to window screen frame members, wherein the outward bow may function to counteract inward sagging of the frame members and provide additional, and more even tension to the substrate. In subsequent descriptions of tensioning features of example embodiments of substrate tensioning systems, any possible deflection of any frame members, and any subsequent tensioning therein created, will be ignored for simplification purposes.

Again referring to FIG. 42A, in an example embodiment, frame members 4211 may comprise a rounded corner 4293B, wherein the substrate may form a corresponding curved shape 4293A when installed with sufficient tension on the frame members 4211. Additionally, the rounded corner 4293B may facilitate the mechanical tensioning of the substrate. Due to the elastic modulus of the of the substrate, and the curved portion of the substrate 4293A that has been bent at an approximate angle of 90 degrees, the curved portions of the substrate 4293A may function as substrate tensioners. If sufficient tensioning force is applied by decreasing the dimensions between opposing edge trusses as described, the substrate surface 4293A may fully contact the frame surface 4293B, wherein any further tension applied to the substrate may create additional axial loading on the edge trusses 4202, that may cause them to deflect somewhat in the direction of the arrow F1. FIG. 42C shows a side cut-away view of a small periphery portion of the substrate 4201 attached to a frame member 4211, with deflection of the edge truss 4202 shown. Accordingly, this described deflection of the edge trusses may cause the edge trusses 4202 to function as tensioners. The degree of resistance of edge trusses to axial loading caused by tension applied to the substrate, along with a corresponding degree of deflection of the edge trusses, may be varied by changing certain configuration parameters of the frame members and or the edge trusses and substrate as may subsequently be described.

In an example embodiment as described in FIG. 42A, the elastic modulus of a particular substrate may be sufficiently high that even with the maximum tension that can be applied to the substrate in the tension system, the curved section 4293A of the substrate 4201B may not fully contact the curved portion 4293B of the frame member 4211, which may cause a gap. This may cause a small but noticeable bump around the perimeter of the substrate, which may be unacceptable in some critical applications. In such cases, the curved section (similar to 4293A in FIG. 42A) of the substrate may be perforated, scored, or otherwise weakened in that region to lower the elastic modulus in that region. Another way to minimize or alleviate the bump as described may be shown in FIG. 42G, which may be described in detail later in this application.

In an example embodiment as shown in FIG. 42E1, an example experimental condition shall be assumed as follows. FIG. 42E1 represents a close-up side cutaway view of one side of an example embodiment of substrate tensioning system similar to that shown in FIG. 42C, with the substrate 4201 installed on a frame and dimensionally configured as previously described such that sufficient tension exists in the substrate 4201, to cause the substrate to fully contact the curved frame portion and the edge truss 4202 to exhibit a degree of deflection. Under said conditions, a given axial load AL (shown with double arrows) may be imparted into the edge truss 4202. The opposing side of the frame and remaining portions of the substrate are not shown for illustrative purposes. The edge truss 4202 may have a length L, and deflection of D (as represented by the double arrows D). The system shown in FIG. 42E2 may be identical as shown in FIG. 42E1, except for the edge truss length of L− which may be shorter than the length L, and the width of the frame channel which may be narrower to accommodate the shorter edge truss 4201. The axial load AL applied to the edge truss 4202 should be assumed to be identical as in FIG. 42E1. Under the conditions as described, the edge truss 4202 in FIG. 42E2 may deflect (as represented by the arrow D−) less than the edge truss 4202 in FIG. 42E1. Since the thickness of the substrate remains constant in both example scenarios, the ratio of length to thickness may be smaller in FIG. 42E2 compared to that of FIG. 42E1, such that the edge truss 4202 in FIG. 42E2 may present a greater resistance to the axial load AL, and may exhibit decreased deflection D−. Accordingly, varying the length of edge trusses in example embodiments of substrate tensioning systems may vary the degree of edge truss deflection, which may affect the maximum level of tension that can be applied to the substrate.

Although overall tension in example embodiments may be decreased when longer edge truss lengths are utilized, this may be advantageous in certain applications. Due to the increased deflection of the edge trusses, even tension may be imparted into the substrate over a wider range of dimensional variances of the substrate. For example, there may be variances in the dimensions of the substrate due to tolerance variances caused by a die cutting process during manufacturing. Temperature variations in a display application may cause the substrate to expand or contract. In either example, the increased deflection of the edge trusses as described may allow a more constant tension to be applied to a substrate over a wider range of dimensional variances.

Flexibility in edge trusses may be increased if required by scoring the edge trusses in a direction parallel to the corresponding substrate edge, or by any other means that may function to increase the elastic modulus of the edge trusses. The degree of flexibility in edge trusses, as well as the tensioning characteristics of an entire tensioning system in example embodiments may also be varied by the selection of the substrate itself. Thinner substrates may enable edge trusses that exhibit higher degrees of deflection. Thinner substrates may also be lighter in mass, and may require less overall tensioning force to keep them acceptably flat under tension. Substrates that have a higher modulus of elasticity, such as biaxially oriented PETG films for example, may enable stiffer edge trusses. Generally speaking, thinner substrates may have cost advantages over thicker ones. This may be a major advantage in example embodiments of substrate tensioning systems as described, in that thin substrates can be utilized that would normally be too thin and prone to damage in other types of substrate tension systems.

Figure 44A:
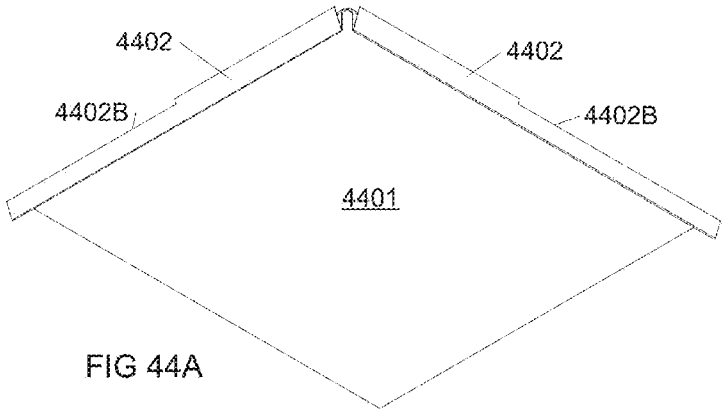
FIG. 44A shows a bottom perspective cut-away view of one corner section of an example embodiment of substrate (in its configuration as if it were installed on an example embodiment of frame as shown in FIG. 42A) with edge trusses similar to that shown in FIG. 41A, wherein the edge trusses are notched.
Figure 44B:
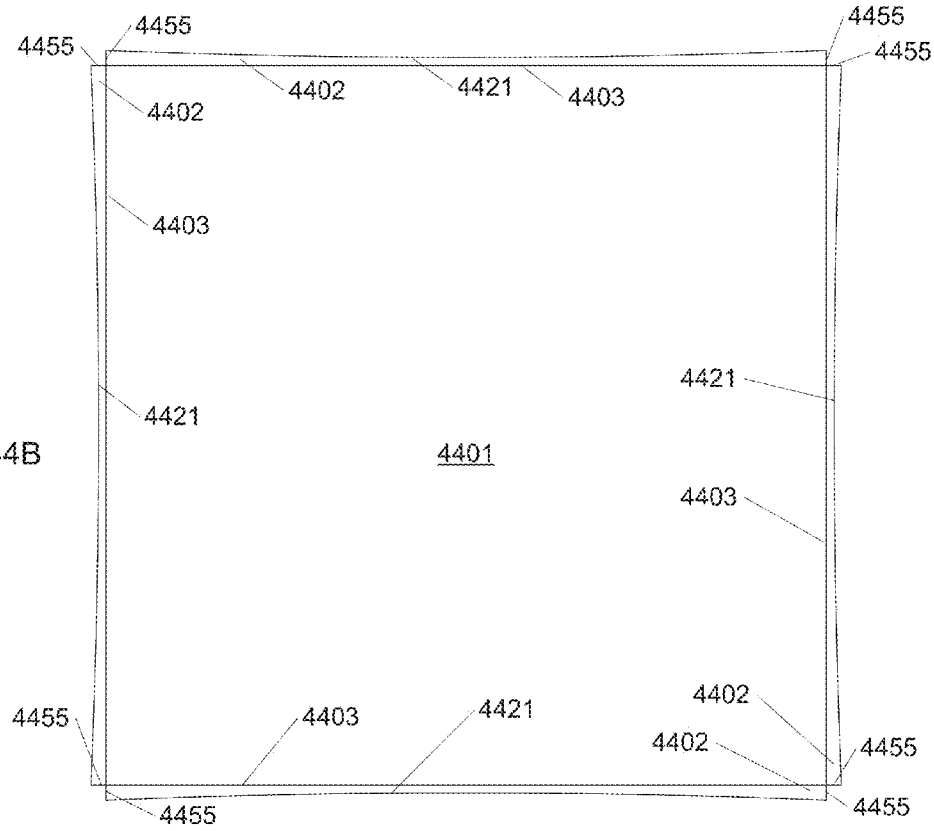
FIG. 44B shows a substrate cutting template for an example embodiment of substrate comprising one edge truss on each major edge, wherein the outer perimeter edge forms an arc.

In an example embodiment, the edge trusses may be notched between each corner section as shown in FIG. 44A. FIG. 44A shows a perspective cut-away of one corner of an example embodiment of substrate similar to that shown in FIG. 41C in its installed state (the frame is not shown for simplification), wherein the substrate 4401 has edge trusses 4402. Notches 4402B have been configured into the edge trusses 4402, such that the corner sections of the edge trusses are wider than the notched sections 4402B. This configuration may function to apply the tension to the substrate as previously described, but predominantly in the corner sections and thus allowing the middle notched sections 4402B to "float" relatively speaking, which may minimize or eliminate any distortions in the substrate in certain applications such as applications with uneven, bent or warped frames, larger sized frames, thinner substrates etc. Although the notched sections 4402B have been shown as discrete notches in the edge trusses 4402, they may be configured in alternate ways as well. For example, as shown in FIG. 44B, the outer perimeter edge 4421 of each outermost edge truss 4402 configured along fold lines 4403 could be one continuous arc extending from one corner region to the other, wherein the tension imparted into the substrate 4401 may be varied in a somewhat linear fashion across each edge of the substrate 4401. The corner cuts 4455 in this example embodiment of substrate may be configured perpendicular to each other, and may form a square corner cutout.

Figure 43:
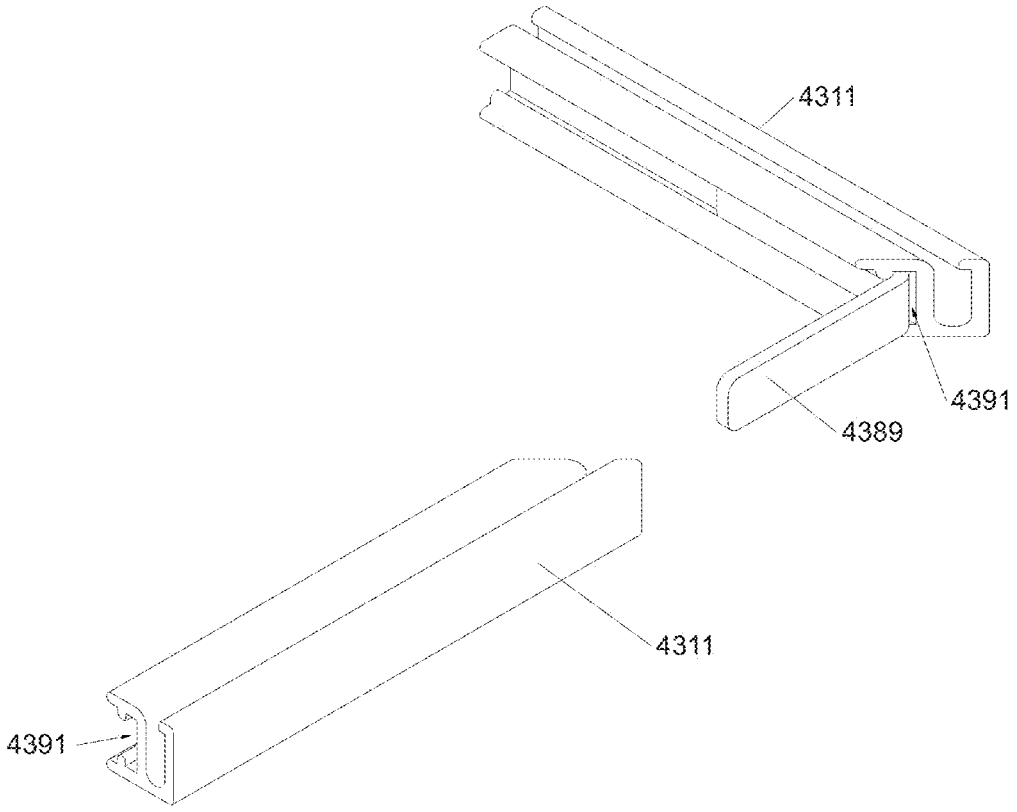
FIG. 43 shows an exploded cut-away perspective view of one corner of the frame of the example embodiment of substrate tensioning system as shown in FIG. 41A.

In an example embodiment as shown in FIG. 43, frame connectors may be utilized to join each frame member to an adjacent frame member. An exploded view is shown of one corner section of an example embodiment of frame is shown, similar to that shown in FIGS. 42A and 42B. Connector 4389 may insert in connector channels 4391 of adjacent frame members 4311 as shown. Connector channels 4291 are also indicated in FIG. 42A. Other conventional or suitable methods of mechanically joining adjacent frame members together may also be utilized.

An example embodiment will now be described which may be configured similarly to that shown in FIGS. 42A and 42B, but may possess certain advantageous features. In an example embodiment, FIG. 45A shows a frame comprising four frame members 4511 which may be attached together at each end. A substrate 4501 may be attached to the frame members in a similar manner to that previously described. Substrate 4501 may be configured substantially similar to the substrate shown in FIGS. 42A and 42B, with the exception of an additional fold along each of the four perimeter regions of the substrate. In an example embodiment, FIG. 46B shows a cutting template for the substrate 4501 (FIG. 45A). In an example embodiment, the substrate 4601 includes two sets of perforated lines 4603 wherein folds may be created along the perforated lines 4603. Folds may be created along the inner perforated lines wherein the resultant edge trusses may be disposed towards the back side of the substrate 4602, and folds may be created along the outer perforated lines wherein the edge trusses may be oriented towards the front surface of the substrate. Corner cut-outs may be created along cut lines 4655.

Referring to FIG. 45B in an example embodiment, a side cut-away view of two opposing sides of the assembly as shown in FIG. 45A is depicted. Certain elements indicated on the left side of the drawing that are identical to their opposing corresponding elements on the right side may not be indicated for simplification purposes. The folds 4503A may function to create edge trusses 4502A, which may function to keep the substrate 4501 disposed in a substantially planar configuration as described in related applications. The edge trusses 4502A may be inserted into channels 4590 as previously described, wherein the perimeter edges 4521 of the edge trusses 4502B may engage with the edge truss retention features 4520. The substrate 4501 may be dimensionally configured such that the span between opposing edge trusses 4502A may be slightly smaller than the span of the corresponding frame member contact surfaces 4512, wherein tension may be created in the region of the folds 4503A which may cause the fold regions to flex, as shown by the arrow F1 on the left side of the figure. Accordingly, the folds 4503A may function as tensioners. Additionally, the edge trusses 4502B may flex (in the direction of the arrow F2 as shown on the left side of the figure) in circumstances where the region around the folds 4503A is fully flexed and contacting the frame member surface 4593B, and the degree of tension and elasticity of the substrate will allow for deflection of the edge trusses.

Figure 46A:
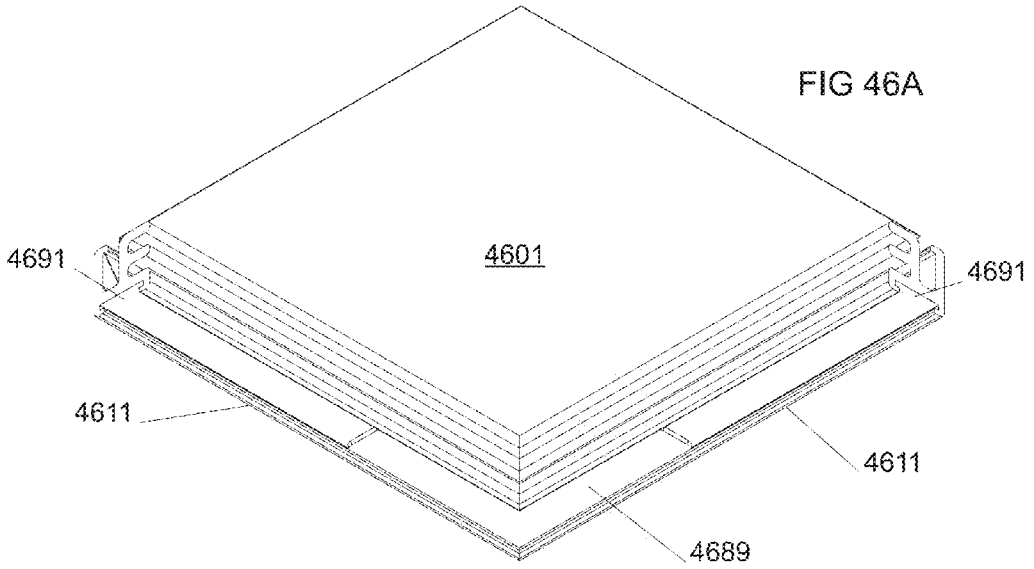
FIG. 46A shows an upside-down perspective cut-away view of a corner section of the example embodiment of substrate tensioning system comprising a frame and a substrate as shown in FIG. 45A.
Figure 46B:
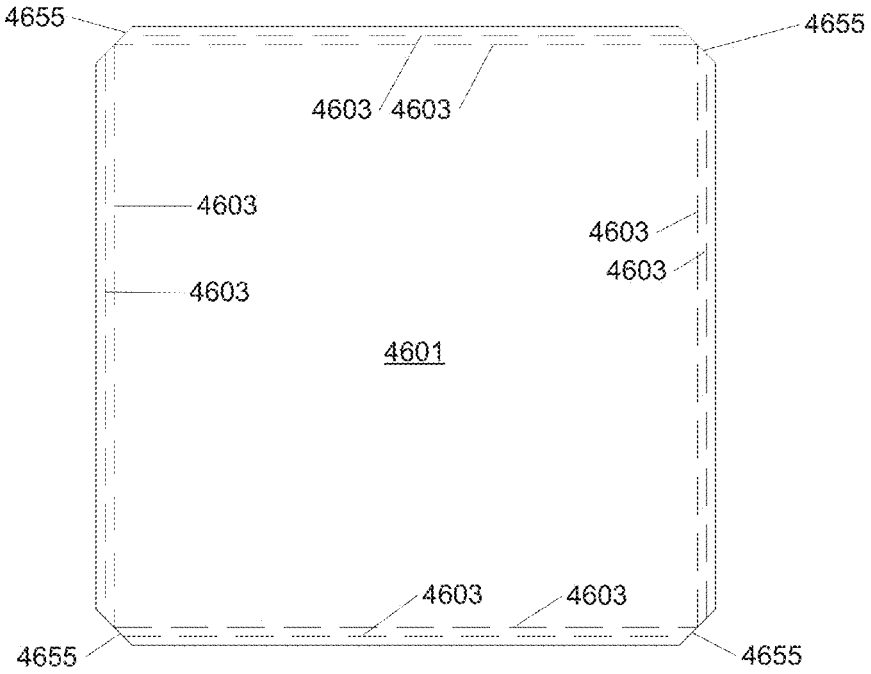
FIG. 46B shows a substrate cutting template for the example embodiment of substrate comprising two edge trusses on each major edge as shown in FIG. 45A.

In an example embodiment as shown in FIG. 46A, the frame members 4611 may be joined together by connectors 4689, wherein each end of a connector 4689 may insert in the channels 4691. The connectors 4689 may comprise a thin, flat, right angled configuration, and fabricated utilizing plastic, steel or aluminum etc. This method of connecting frame members may be advantageous in that the connectors may be fabricated by a low cost stamping process.

Figure 42G:
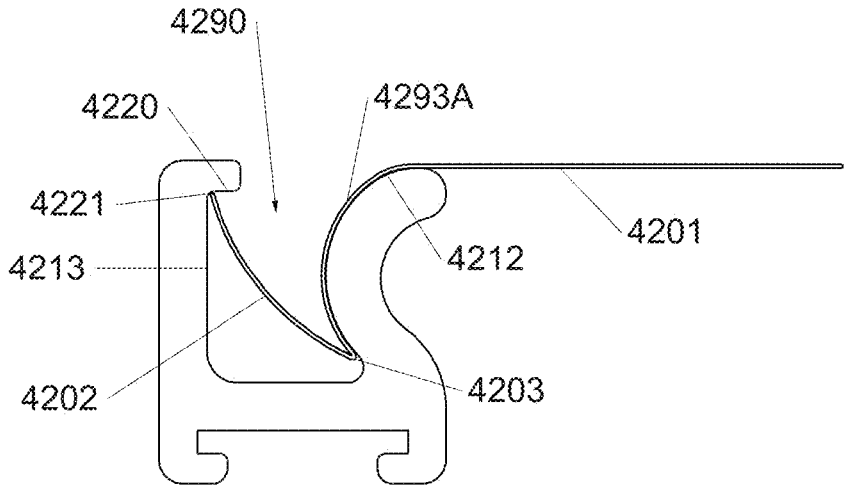
FIG. 42G shows a side cut-away view of a frame member and attached substrate of an example embodiment of substrate tensioning system.

FIG. 42G shows a side cut-away view of one side of an example embodiment of a substrate tensioning system. Folds 4203 may function to create edge trusses 4202. The edge trusses 4202 may be inserted into the channels 4290 as previously described, wherein the perimeter edges 4221 of the edge trusses 4202 may engage with the edge truss retention features 4220 located on the end regions of the second surfaces 4213 of the frame channels. The example embodiment of substrate tensioning system may be configured, and may function in a similar manner to example embodiments previously described, and for brevity, some of the details therein may not be repeated here. The curved semi-circular shape of the first surfaces 4212 of the frame members 4211 may allow the curved region 4293A of the substrate 4201 to fully contact the first surface 4212 with substantially less substrate tension than in example embodiments previously described such as in FIG. 42A for example. This may eliminate or minimize any gap around the perimeter of the substrate as previously described.

Figure 48A:
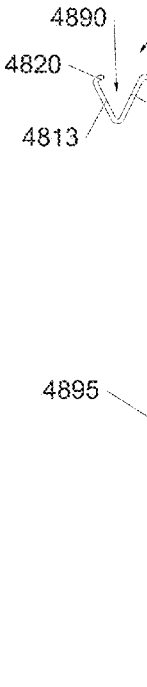
FIG. 48A shows a cutaway side profile view of an example embodiment of a tensioning frame that is integrally configured into an enclosure structure.
Figures 2, 48A:
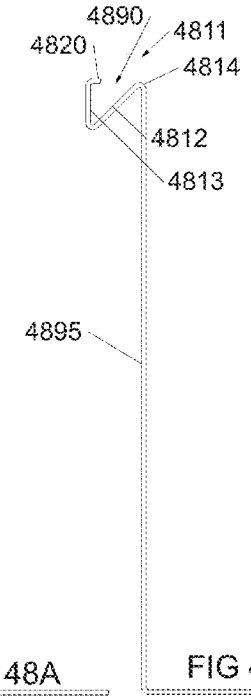
Figure 48B:
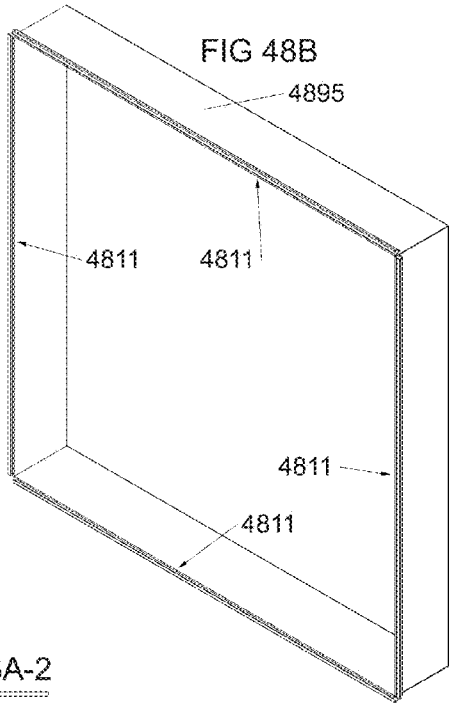

In another example embodiment, the first surface of frame members may be a planar surface configured at an angle relative to the plane of the substrate, such as a 45 degree angle for example, similar to the first surface 4812 shown in FIG. 48A-2, which may also function to eliminate or minimize any gap around the perimeter of the substrate as previously described.

An example embodiment of film tensioning system is shown in FIGS. 47A and 47B and 47C. Frame members 4711 may attach adjacent to the opening of an enclosure 4795. The enclosure 4795 may represent any type of enclosure. For example, the enclosure may be for a light fixture, display or any light emitting device. In an example embodiment, each frame member 4711 may comprise substrate attachment and tensioning features as previously described, such as a channel 4790, a curved surface 4793B, top surface 4790, and edge truss retention feature 4720 as shown in FIG. 47C. The substrate 4701 may attach to, and be tensioned by the frame members 4711 as previously described. Screws, rivets or other suitable fasteners may protrude through holes in the section of the frame member 4796 and through corresponding holes in the walls of the enclosure 4795. This example embodiment may be advantageous in applications that include a suitable enclosure, wherein the enclosure walls may function as the main supporting structure to resist tension. This may allow frame members to be extremely thin and lightweight. Utilizing extruded aluminum of 0.04" thickness and a standard cavity ratio of 3.5:1, a profile as thin as ¼" may be obtained.

In an example embodiment, substrate tensioning systems as described may be configured to nest in a ceiling grid of a suspended ceiling system. Referring to FIG. 27C, an example embodiment of substrate tensioning system such as that shown in FIG. 42B for example, may be substituted for lens 2701, wherein the front of the frame and periphery of the substrate may be disposed on, or directly over the ceiling grid members 2760, and the top surface of the enclosure's mounting flanges 2723 may be disposed on, or directly over the back side of the substrate tensioning system's frame. In an example embodiment, gasket material such as weather stripping may by attached to the back of the frame members to create a seal between the frame members and the tops surfaces of the mounting flanges 2723, and also to prevent any squeaks or rattling etc.

An example embodiment of substrate tensioning system is shown in FIG. 31A through FIG. 31C and described in the related U.S. patent application Ser. No. 14/490,188 entitled "Light Fixtures and Multi-Plane Light Modifying Elements," filed Sep. 18, 2014. It should be understood that the various methods and elements of creating substrate tensioning systems, and the various descriptions and teachings of substrate tensioning systems set forth in this patent application may also be applied to the substrate tensioning system from the said related application.

In an example embodiment, channels with edge truss retention features that may function similarly to frame members previously described in example embodiments of substrate tensioning systems, that may be suitable to tension substrates as previously described, may be fabricated as integral elements of an enclosure structure. For example, on an enclosure fabricated out of sheet metal that comprises a major opening, such as an aperture of a light fixture enclosure for example, the enclosure sides around the periphery of the major opening may be formed with the appropriate bends to form channels comprising at least a first surface and an opposing second surface, wherein at least one of the first or second channel surfaces comprises an edge truss retention feature.

Figure 48C:
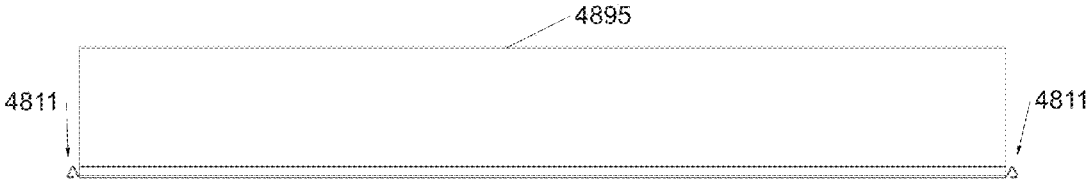

In an example embodiment, FIG. 48 B shows a perspective view of an enclosure 4895, with channels and edge truss retention features 4811 formed into the enclosure, and FIG. 48C shows a side view of the same. A cutaway profile view of one side of the same enclosure is shown in FIG. 48A, and an alternate profile is shown in FIG. 48A-2. Enclosure 4895 has a channel with edge truss retention features 4811 formed into the top edge of the enclosure sides. A first surface 4212 comprises an opposing second surface 4813, with an edge truss retention feature 4620. In an example embodiment where the enclosure is an enclosure for a light emitting device that is configured for mounting in a grid frame of a suspended ceiling, the edge truss retention feature 4820 and the lip 4814 together may function as the top edge surface (mounting flange) of the enclosure 4895 that may be disposed on the surface of a grid frame of a suspended ceiling when the light emitting device is mounted in the ceiling grid. Although not shown, a substrate configured in a similar manner to example embodiments previously described, such as that shown in FIG. 41B, through FIG. 41D may be attached to the channels, and function in a similar manner to that as previously described. With some manufacturing methods, due to the inward bend, the edge truss retention feature 4820 may be unable to be created. In such a case, the edge truss retention feature may be omitted, and replaced by an extrusion that may be configured and attached to the edge of the second surface 4813. Any other configurations of channels with edge truss retention features may be configured integrally into the enclosure that may enable a substrate tension system that functions in a similar manner to example embodiments of substrate tensioning systems previously described.

Figure 48D:
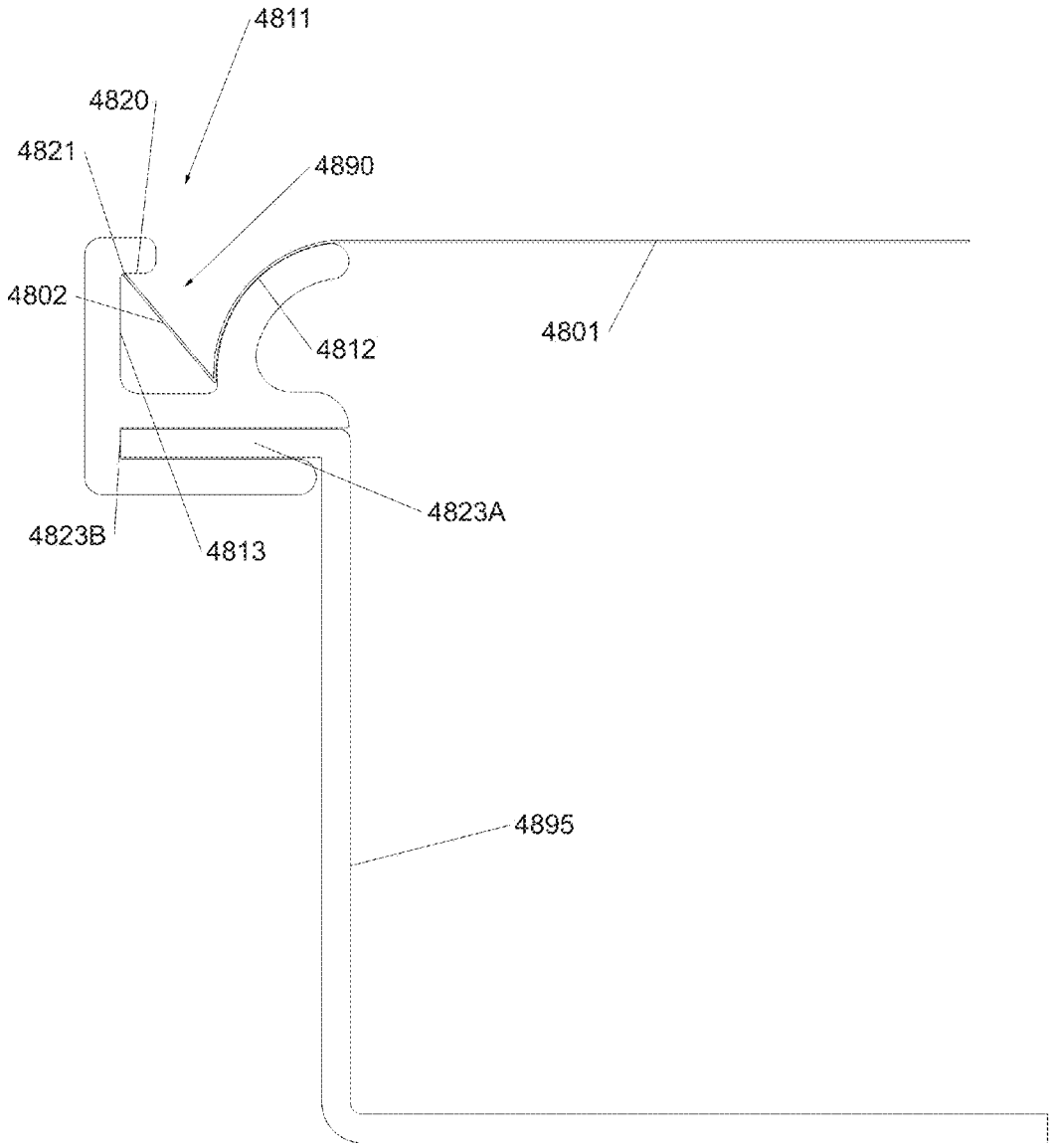

FIG. 48D shows a side cut-away view of one side of an example embodiment of a substrate tensioning system with extruded frame members 4811. The frame members 4211 may be fabricated in any manner previously described. The edge trusses 4802 may be inserted into the channels 4890 as previously described, wherein the perimeter edges 4821 of the edge trusses 4802 may engage with the edge truss retention features 4820 located on the end regions of the second surfaces 4813 of the frame channels 4811. The example embodiment of substrate tensioning system may be configured, and may function in a similar manner to example embodiments previously described, and for brevity, some of the details therein may not be repeated here. The curved semi-circular shape of the first surfaces 4812 of the frame members 4811 may allow the substrate 4801 to fully contact the first surface 4812 with substantially less substrate tension than in example embodiments previously described such as in FIG. 42A for example. This may eliminate or minimize any gap around the perimeter of the substrate as previously described. This example embodiment may have the advantage of not requiring any fasteners or corner frame connectors. The lower channels 4823B of the frame members 4811 may engage the top edge surfaces 2823A of the enclosure 4895, thereby securing them from up or down movement, or inward movement. Outward movement of the frame members 4811 may be prevented by the substrate tension after the substrate is attached to the fame channels 4811. The structural rigidity of the enclosure 4895 may allow the frame members 4811 to be fabricated from relatively thin material, which may save on manufacturing costs.

Example embodiments of substrate tensioning systems that may have frame elements fabricated as integral elements of the enclosure structure as described, may be utilized with light emitting devices such as displays, light fixtures etc.

Example embodiments of substrate tensioning systems described herein may be utilized with many light emitting device applications, for example, displays. Displays such as television, computer monitors etc. may be well suited to benefit from the advantages of example embodiments of film tensioning systems, such as the elimination of a diffuser plate, low cost, no parts other than the film and frame, lower labor costs, thin frame profiles etc.

Figure 49:
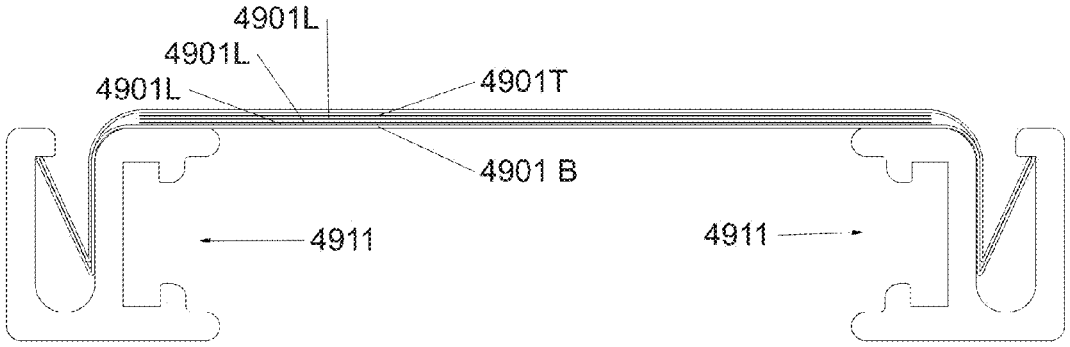

In an example embodiment and cutaway view similar to that shown in FIG. 42A, FIG. 49 shows two substantially similar substrates 4901T and 4901B that may attach to frame members 4911, one on top of each other, wherein one or more layers of substrates 4901L (three are shown) without any folds, may nest between the two attached substrates 4901T and 4901B. (The spacing between all the substrate layers has been exaggerated for illustrative purposes). This may allow film stacks comprising many films to be utilized in example embodiments of substrate tensioning systems that may be used in display applications for example.

In an example embodiment, a method for tensioning a substrate is provided. The steps of the method are shown in FIG. 50, and may be as follows:

As represented by block 501, providing a frame comprising four sides, wherein each frame side comprises a channel, and each channel comprises a first surface, a second surface that opposes the first surface, and an edge truss retention feature;

As represented by block 502, providing at least one piece of substrate comprising four major edges and a first surface, wherein the at least one piece of substrate is dimensionally configured so that after attachment to the frame, tension is imparted into the at least one piece of substrate;

As represented by block 503, configuring one or more edge trusses on each major edge of the at least one piece of substrate, wherein each edge truss is configured from a corresponding fold in the at least one piece of substrate, and each edge truss extends along all, or a portion of a corresponding major edge, such that each of the one or more edge trusses is configured at an angle relative to the first surface of the at least one piece of substrate, and wherein the outermost edge trusses on each of the four major edges of the at least one piece of substrate comprises an outer perimeter edge;

As represented by block 504, inserting each of the one or more edge trusses on each of the four major edges of the at least one piece of substrate into a corresponding frame channel, wherein the perimeter edge of each outermost edge truss is engaged by the corresponding channel's edge truss retention feature, such that each of the outermost edge trusses becomes lodged and secured within each corresponding frame channel and resists the tension imparted in the at least one piece of substrate.

In an example embodiment of substrate tensioning system, only two opposing sides of a substrate may be tensioned as described in example embodiments of substrate tensioning systems. In certain applications, this may be sufficient to keep a substrate in an acceptably flat configuration. For example, applications where the elastic modulus of the substrate is sufficiently high, and/or where the span of the substrate to be suspended is sufficiently small. In an example embodiment, the non-tensioned sides of the substrate may be configured with edge trusses wherein the edge trusses nest in frame channels but are not attached to the frame channels. In an example embodiment, the non-tensioned sides of the substrate may be configured with edge trusses wherein the edge trusses do not nest in frame channels. In an example embodiment, the non-tensioned sides of the substrate may be configured with edge trusses wherein the edge trusses nest in and attach to frame channels but are not tensioned with significant tension therein. In an example embodiment, the non-tensioned sides of the substrate may be configured without edge trusses.

Figure 51A:
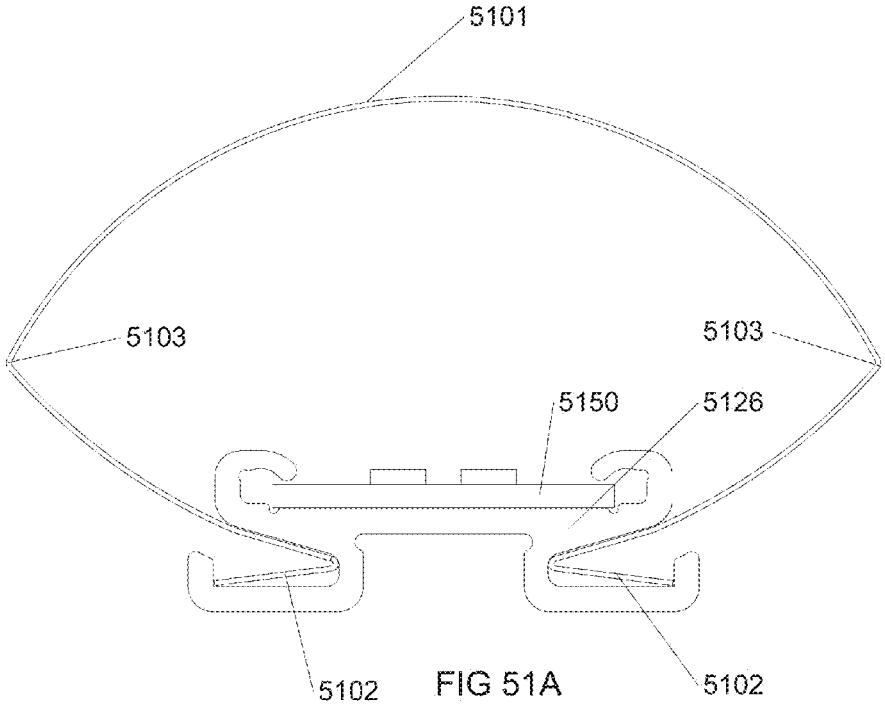
Figure 51B:
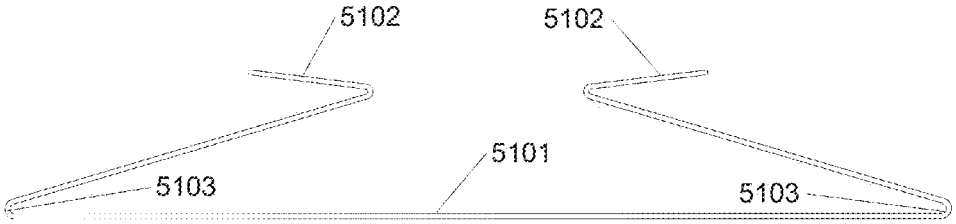

An example embodiment of a light fixture retrofit assembly similar to that as shown in FIG. 28A is shown in FIG. 51A. All the elements and function of the light fixture retrofit assembly shown in FIG. 28A that are related to, and previously described, (with the exception of the optical film lens) may be substantially similar, and may not be repeated here for brevity. FIG. 51A shows an LED array 5150 mounted on a base 5126. An optical film lens 5101 with edge trusses 5102 may attach to the base 5126 as previously described. The lens 5101 may comprise two additional folds 5103. FIG. 51B shows a side view of the lens 5101 from FIG. 51A wherein the lens 5101 may be in an uncompressed state before attachment to the base 5126. When the lens 5101 is attached to the base 5126 as shown in FIG. 51A, the lens 5101 may form a shape similar to that shown. This lens configuration may be advantageous in applications that require lower clearance for the lens. Additionally, the configuration shown may function to create a more narrow light distribution pattern than from the lens shown in FIG. 28A, and may create less light loss within a light fixture due to less light scattering. Many alternate lens shapes may be configured by varying the number of folds, the placement of folds, and the orientation of the folds (inward or outward folds etc.).

In an example embodiment of the disclosed technology, a substrate tensioning system may be configured to suspend a substrate in a substantially planar configuration, wherein the substrate tensioning system may comprise a frame comprising four sides. Each frame side may comprise a channel comprising a first surface, a second surface that opposes the first surface, and an edge truss retention feature. The example embodiment may further comprise at least one substrate comprising four major edges and a first surface, wherein each major edge may be configured with one or more edge trusses. Each edge truss may be configured from a corresponding fold in the at least one substrate, and each edge truss may extend along all, or a portion of a corresponding major edge of the at least one substrate. Each of the one or more edge trusses may be configured at an angle relative to the first surface of the at least one substrate, and the outermost edge trusses on each of the four major edges of the at least one substrate may comprise an outer perimeter edge. The at least one substrate may be configured for attachment to the frame such that each of the at least one edge trusses on each of the four major edges of the at least one substrate may nest inside a corresponding frame channel, and the perimeter edge of each outermost edge truss may be engaged by the corresponding frame channel's edge truss retention feature such that each of the outermost edge trusses may become lodged and secured within each corresponding frame channel.

In an example embodiment, the first surface of the at least one substrate may be further defined as the front surface of the at least one substrate, and the at least one substrate may be further characterized by a back surface. The at least one substrate may be configured such that the back surface may contact the first surface of the frame channels of the frame after attachment to the frame.

In an example embodiment, the one or more edge trusses configured on each major edge of the at least one substrate may be further defined as only one edge truss configured on each major edge of the at least one substrate.

In an example embodiment, the one or more edge trusses configured on each major edge of the at least one substrate may be further defined as two edge truss configured on each major edge of the at least one substrate.

In an example embodiment, each of the outermost edge trusses may resist tension imparted into the at least one substrate.

In an example embodiment, the substrate tensioning system may be a lens assembly for a light emitting device.

In an example embodiment, the substrate tensioning system may be a light modifying assembly for a display.

In an example embodiment, the at least one substrate may be at least one piece of optical film, wherein the first surface of the at least one piece of optical film may be further defined as the front light-emitting side of the at least one piece of optical film. The at least one piece of optical film may be further characterized by a back light-receiving side. The at least one piece of optical film may be configured such that back light-receiving side contacts the first surface of the frame channels of the frame after attachment to the frame.

In an example embodiment, each frame side may be a frame member configured to attach along or adjacent to an opening of an enclosure.

In an example embodiment, the at least one substrate may comprise two or more substrates.

In an example embodiment, the at least one substrate may comprise two or more substrates and one or more optical film layers nested in between two of the two or more substrates.

In an example embodiment, one or more elements of the frame may be integrally incorporated into the structure of an enclosure.

In an example embodiment, the substrate tensioning system may further comprise a light fixture. The light fixture may further comprise an enclosure configured for mounting on a grid frame of a suspended ceiling. The enclosure may comprise four sides, an opening defined by the four sides, and a top edge surface associated with each of the four sides, wherein the top edge surfaces may be disposed adjacent to the opening and wherein the top edge surfaces may be configured to contact the grid frame of a suspended ceiling. The frame may further comprise a front and a back, wherein all or a portion of a periphery of the front of the frame may be configured for contacting, or being disposed on or directly over the grid frame of the suspended ceiling after mounting in the grid frame. The back of the frame may be configured for contacting, or being disposed on or directly under the entirety of, or a portion of the top edge surface of each of the four sides of the enclosure after mounting in the grid frame.

In an example embodiment of the disclosed technology, a substrate structure may comprise at least one piece of substrate with a first surface and four corner regions, each corner region having one or more associated minor edges defining one or more corner cuts that define a corner cutout. The substrate structure may also comprise four major edges, wherein each major edge may be configured with one or more edge trusses, wherein each edge truss may be configured from a corresponding fold in the at least one piece of substrate. Each edge truss may extend along all, or a portion of a corresponding major edge of the at least one piece of substrate, wherein each of the one or more edge trusses may be configured at an angle relative to the first surface of the at least one piece of substrate, and wherein the outermost edge trusses on each of the four major edges of the at least one piece of substrate comprises an outer perimeter edge. The substrate structure may be configured for attachment to a substrate tensioning frame.

In an example embodiment of the disclosed technology, a light emitting device may comprise an enclosure configured for mounting on a grid frame of a suspended ceiling. The enclosure may comprise four sides, an opening defined by the four sides, and a top edge surface associated with each of the four sides, wherein the top edge surfaces may be disposed adjacent to the opening, and wherein the top edge surfaces may be configured to contact the grid frame of a suspended ceiling. Each of the top edge surfaces may each further be characterized by a channel comprising a first surface, a second surface that opposes the first surface, and an edge truss retention feature. The light emitting device may further comprise at least one substrate comprising four major edges and a first surface, wherein each major edge may be configured with one or more edge trusses, wherein each edge truss may be configured from a corresponding fold in the at least one substrate. Each edge truss may extend along all, or a portion of a corresponding major edge of the at least one substrate, wherein each of the one or more edge trusses may be configured at an angle relative to the first surface of the at least one substrate, and wherein the outermost edge trusses on each of the four major edges of the at least one substrate may comprise an outer perimeter edge. The at least one substrate may be configured for attachment to the enclosure such that each of the at least one edge trusses on each of the four major edges of the substrate may nest inside a corresponding channel of a top edge surface, and the perimeter edge of each outermost edge truss may be engaged by the corresponding channel's edge truss retention feature such that each of the outermost edge trusses may become lodged and secured within each corresponding channel.

In an example embodiment, one or more elements of the channels of the top edge surfaces may be integrally configured in the enclosure sides.

In an example embodiment, one or more elements of the channels of the top edge surfaces may not be integrally configured in the enclosure sides, and the one or more elements of the channels of the top edge surfaces may be attached to the enclosure sides.

Although example embodiments of frame members have been described with a particular profile as shown, this should not limit the general scope of example embodiments, as many other possible profile configurations may be utilized. Different applications may have different design requirements, such as aesthetic concerns, structural stiffness, size constraints, substrate positioning, mounting compatibility to other structures (such as a light fixture) etc.

While certain implementations of the disclosed technology have been described in connection with what is presently considered to be the most practical implementations, it is to be understood that the disclosed technology is not to be limited to the disclosed implementations, but on the contrary, is intended to cover various modifications and equivalent arrangements included within the scope of the appended claims. Although specific terms are employed herein, they are used in a generic and descriptive sense only and not for purposes of limitation.

This written description may use examples to disclose certain implementations of the disclosed technology, including the best mode, and may also to enable any person skilled in the art to practice certain implementations of the disclosed technology, including making and using any devices or systems and performing any incorporated methods. The patentable scope of certain implementations of the disclosed technology is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

I claim:

1. A substrate tensioning system configured to suspend a substrate in a substantially planar configuration, the substrate tensioning system comprising:

a frame comprising four sides, wherein each frame side comprises a channel comprising a first surface, a second surface that opposes the first surface, and an edge truss retention feature;

at least one substrate comprising four major edges and a first surface, wherein each major edge is configured with one or more edge trusses, wherein each edge truss is configured from a corresponding fold in the at least one substrate, and each edge truss extends along all, or a portion of a corresponding major edge of the at least one substrate, wherein each of the one or more edge trusses is configured at an angle relative to the first surface of the at least one substrate, and wherein the outermost edge trusses on each of the four major edges of the at least one substrate comprises an outer perimeter edge;

wherein the at least one substrate is configured for attachment to the frame such that each of the at least one edge trusses on each of the four major edges of the at least one substrate nest inside a corresponding frame channel, and the perimeter edge of each outermost edge truss is engaged by the corresponding frame channel's edge truss retention feature such that each of the outermost edge trusses becomes lodged and secured within each corresponding frame channel.

2. The substrate tensioning system of claim 1, wherein the first surface of the at least one substrate is further defined as the front surface of the at least one substrate, and the at least one substrate is further characterized by a back surface, and wherein the at least one substrate is configured such that the back surface contacts the first surface of the frame channels of the frame after attachment to the frame.

3. The substrate tensioning system of claim 1, wherein the one or more edge trusses configured on each major edge of the at least one substrate are further defined as only one edge truss configured on each major edge of the at least one substrate.

4. The substrate tensioning system of claim 1, wherein the one or more edge trusses configured on each major edge of the at least one substrate are further defined as two edge truss configured on each major edge of the at least one substrate.

5. The substrate tensioning system of claim 1, wherein each of the outermost edge trusses resist tension imparted into the at least one substrate.

6. The substrate tensioning system of claim 1 is a lens assembly for a light emitting device.

7. The substrate tensioning system of claim 1 is a light modifying assembly for a display.

8. The substrate tensioning system of claim 1, wherein the at least one substrate is at least one piece of optical film, wherein the first surface of the at least one piece of optical film is further defined as the front light-emitting side of the at least one piece of optical film, and the at least one piece of optical film is further characterized by a back light-receiving side, and wherein the at least one piece of optical film is configured such that back light-receiving side contacts the first surface of the frame channels of the frame after attachment to the frame.

9. The substrate tensioning system of claim 1, wherein each frame side is a frame member configured to attach along or adjacent to an opening of an enclosure.

10. The substrate tensioning system of claim 1, wherein the at least one substrate comprises two or more substrates.

11. The substrate tensioning system of claim 1, wherein the at least one substrate comprises two or more substrates and one or more optical film layers nested in between two of the two or more substrates.

12. The substrate tensioning system of claim 1, wherein one or more elements of the frame are integrally incorporated into the structure of an enclosure.

13. The substrate tensioning system of claim 1 further comprises a light fixture, the light fixture comprising:

an enclosure configured for mounting on a grid frame of a suspended ceiling, the enclosure comprising four sides, an opening defined by the four sides, and a top edge surface associated with each of the four sides, wherein the top edge surfaces are disposed adjacent to the opening and wherein the top edge surfaces are configured to contact the grid frame of a suspended ceiling;

wherein the frame further comprises a front and a back, wherein all or a portion of a periphery of the front of the frame is configured for contacting, or being disposed on or directly over the grid frame of the suspended ceiling after mounting in the grid frame, and wherein the back of the frame is configured for contacting, or being disposed on or directly under the entirety of, or a portion of the top edge surface of each of the four sides of the enclosure after mounting in the grid frame.

14. A substrate structure comprising:

at least one piece of substrate configured as a light modifying element, the at least one piece of substrate comprising:

a first surface; and four corner regions, each having one or more associated minor edges defining one or more corner cuts that define a corner cutout; and four major edges, wherein each major edge is configured with one or more edge trusses, wherein each edge truss is configured from a corresponding fold in the at least one piece of substrate, and each edge truss extends along all, or a portion of a corresponding major edge of the at least one piece of substrate, wherein each of the one or more edge trusses is configured at an angle relative to the first surface of the at least one piece of substrate, and wherein the outermost edge trusses on each of the four major edges of the at least one piece of substrate comprises an outer perimeter edge;

wherein the substrate structure is configured for attachment to a substrate tensioning frame of a light fixture.

15. A method for tensioning a substrate, the method comprising:

providing a frame comprising four sides, wherein each frame side comprises a channel, and each channel comprises a first surface, a second surface that opposes the first surface, and an edge truss retention feature;

providing at least one piece of substrate comprising four major edges and a first surface, wherein the at least one piece of substrate is dimensionally configured so that after attachment to the frame, tension is imparted into the at least one piece of substrate;

configuring one or more edge trusses on each major edge of the at least one piece of substrate, wherein each edge truss is configured from a corresponding fold in the at least one piece of substrate, and each edge truss extends along all, or a portion of a corresponding major edge, such that each of the one or more edge trusses is configured at an angle relative to the first surface of the at least one piece of substrate, and wherein the outermost edge trusses on each of the four major edges of the at least one piece of substrate comprises an outer perimeter edge;

inserting each of the one or more edge trusses on each of the four major edges of the at least one piece of substrate into a corresponding frame channel, wherein the perimeter edge of each outermost edge truss is engaged by the corresponding channel's edge truss retention feature, such that each of the outermost edge trusses becomes lodged and secured within each corresponding frame channel and resists the tension imparted in the at least one piece of substrate.

16. A light emitting device comprising:

an enclosure configured for mounting on a grid frame of a suspended ceiling, the enclosure comprising:

four sides, an opening defined by the four sides, and a top edge surface associated with each of the four sides, wherein the top edge surfaces are disposed adjacent to the opening and wherein the top edge surfaces are configured to contact the grid frame of a suspended ceiling, and wherein each of the top edge surfaces are each further characterized by a channel comprising a first surface, a second surface that opposes the first surface, and an edge truss retention feature;

at least one substrate comprising four major edges and a first surface, wherein each major edge is configured with one or more edge trusses, wherein each edge truss is configured from a corresponding fold in the at least one substrate, and each edge truss extends along all, or a portion of a corresponding major edge of the at least one substrate, wherein each of the one or more edge trusses is configured at an angle relative to the first surface of the at least one substrate, and wherein the outermost edge trusses on each of the four major edges of the at least one substrate comprises an outer perimeter edge;

wherein the at least one substrate is configured for attachment to the enclosure such that each of the at least one edge trusses on each of the four major edges of the substrate nest inside a corresponding channel of a top edge surface, and the perimeter edge of each outermost edge truss is engaged by the corresponding channel's edge truss retention feature such that each of the outermost edge trusses becomes lodged and secured within each corresponding channel.

17. The light emitting device of claim 16, wherein one or more elements of the channels of the top edge surfaces are integrally configured in the enclosure sides.

18. The light emitting device of claim 16, wherein one or more elements of the channels of the top edge surfaces are not integrally configured in the enclosure sides, and the one or more elements of the channels of the top edge surfaces are attached to the enclosure sides.

* * * * *